US011692748B2

(12) United States Patent
Satou et al.

(10) Patent No.: US 11,692,748 B2
(45) Date of Patent: Jul. 4, 2023

(54) HEAT EXCHANGER AND AIR CONDITIONING APPARATUS INCLUDING THE SAME

(71) Applicant: Daikin Industries, LTD., Osaka (JP)

(72) Inventors: Ken Satou, Osaka (JP); Masanori Jindou, Osaka (JP); Yoshio Oritani, Osaka (JP); Kouju Yamada, Osaka (JP); Hiroaki Matsuda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 395 days.

(21) Appl. No.: 16/648,040

(22) PCT Filed: Sep. 20, 2018

(86) PCT No.: PCT/JP2018/034922
§ 371 (c)(1),
(2) Date: Mar. 17, 2020

(87) PCT Pub. No.: WO2019/059316
PCT Pub. Date: Mar. 28, 2019

(65) Prior Publication Data

US 2020/0256597 A1 Aug. 13, 2020

(30) Foreign Application Priority Data

Sep. 25, 2017 (JP) ..... 2017-183571

(51) Int. Cl.
*F25B 39/02* (2006.01)
*F28D 1/047* (2006.01)
(Continued)

(52) U.S. Cl.
CPC ..... *F25B 39/02* (2013.01); *F28D 1/0476* (2013.01); *F28D 1/05333* (2013.01); *F28F 1/022* (2013.01); *F28F 1/04* (2013.01)

(58) Field of Classification Search
CPC .... F25B 39/02; F28D 1/0476; F28D 1/05333; F28F 1/022; F28F 1/04
(Continued)

(56) References Cited

U.S. PATENT DOCUMENTS

2009/0084131 A1* 4/2009 Reifel ..... F28D 1/0471 29/890.035
2014/0338874 A1 11/2014 Jindou et al.
(Continued)

FOREIGN PATENT DOCUMENTS

EP 1983270 A1 * 10/2008 ..... F24F 1/0059
EP 1983270 A1 10/2008
(Continued)

OTHER PUBLICATIONS

Extended European Search Report issued in corresponding European Patent Application No. 18858343.9, dated Oct. 27, 2020 (7 pages).
(Continued)

*Primary Examiner* — Tho V Duong
*Assistant Examiner* — Raheena R Malik
(74) *Attorney, Agent, or Firm* — Osha Bergman Watanabe & Burton LLP

(57) ABSTRACT

A heat exchanger includes: flat pipes disposed in multiple stages in a stage direction corresponding to an up-down direction; and fins that partition a space between adjacent two of the flat pipes into air flow passages through which air flows. Each of the flat pipes includes a passage for a refrigerant inside thereof. The flat pipes are divided into heat exchange paths arrayed in multiple stages in the stage direction. One of the heat exchange paths that includes a lowermost one of the flat pipes is defined as a first heat exchange path. A length of the passage from a first end to a
(Continued)

second end of a flow of the refrigerant in each of the heat exchange paths is defined as a path effective length.

10 Claims, 21 Drawing Sheets

(51) Int. Cl.
*F28D 1/053* (2006.01)
*F28F 1/02* (2006.01)
*F28F 1/04* (2006.01)

(58) Field of Classification Search
USPC ..... 165/173
See application file for complete search history.

(56) References Cited

U.S. PATENT DOCUMENTS

| | | | | |
|---|---|---|---|---|
| 2015/0059401 | A1 | 3/2015 | Matsuda et al. | |
| 2016/0169586 | A1* | 6/2016 | Ito | F28F 1/022 29/890.03 |
| 2018/0135900 | A1 | 5/2018 | Jindou et al. | |

FOREIGN PATENT DOCUMENTS

| | | | | | |
|---|---|---|---|---|---|
| EP | 2667134 | A1 | | 11/2013 | |
| JP | H02-68494 | A | | 3/1990 | |
| JP | H09-145187 | A | | 6/1997 | |
| JP | H10-19416 | A | | 1/1998 | |
| JP | 2004-076961 | A | | 3/2004 | |
| JP | 2004076961 | A | * | 3/2004 | F28D 1/0477 |
| JP | 2007-205661 | A | | 8/2007 | |
| JP | 2007205661 | A | * | 8/2007 | F24F 1/0059 |
| JP | 2015-10728 | A | | 1/2015 | |
| JP | 2015010728 | A | * | 1/2015 | |
| JP | 2015-87074 | A | | 5/2015 | |
| JP | 2015087074 | A | * | 5/2015 | F24F 1/14 |
| KR | 2015-0098835 | A | | 8/2015 | |
| WO | 2013/161799 | A1 | | 10/2013 | |
| WO | 2016174830 | A1 | | 11/2016 | |

OTHER PUBLICATIONS

International Search Report issued in International Application No. PCT/JP2018/034922, dated Dec. 11, 2018 (9 pages).
English translation of the International Preliminary Report on Patentability issued in corresponding International Patent Application No. PCT/JP2018/034922, dated Apr. 39, 2020 (23 pages).

* cited by examiner

HEAT EXCHANGER AND AIR CONDITIONING APPARATUS INCLUDING THE SAME

TECHNICAL FIELD

The present invention relates to a heat exchanger and an air conditioning apparatus including the heat exchanger. In particular, the present invention relates to a heat exchanger including a plurality of flat pipes arranged in multiple stages in a stage direction corresponding to the up-down direction, each of the flat pipes including a passage for a refrigerant formed inside thereof, and a plurality of fins that partition a space between adjacent flat pipes into a plurality of air flow passages through which air flows, the flat pipes being divided into a plurality of heat exchange paths arrayed in multiple stages in the stage direction, and an air conditioning apparatus including the heat exchanger.

BACKGROUND

In a conventional technique, a heat exchanger including a plurality of flat pipes arranged in multiple stages in a stage direction corresponding to the up-down direction, each of the flat pipes including a passage for a refrigerant formed inside thereof, and a plurality of fins that partition a space between adjacent flat pipes into a plurality of air flow passages through which air flows may be employed as an outdoor heat exchanger housed in an outdoor unit of an air conditioning apparatus. Further, for example, such a heat exchanger includes a heat exchanger as described in Patent Literature 1 (WO2013/161799 A) in which flat pipes are divided into a plurality of heat exchange paths arrayed in multiples stages in the stage direction.

The above conventional heat exchanger may be employed in an air conditioning apparatus that performs a heating operation and a defrosting operation in a switching manner. When the air conditioning apparatus performs the heating operation, the above conventional heat exchanger is used as an evaporator for a refrigerant. When the air conditioning apparatus performs the defrosting operation, the above conventional heat exchanger is used as a radiator for the refrigerant. Specifically, when the above conventional heat exchanger is used as the evaporator for the refrigerant, the refrigerant in a gas-liquid two-phase state is divided and flows into each heat exchange path, is heated in each heat exchange path, and flows out of each heat exchange path. Then, flows of the refrigerant merge with each other. Further, when the above conventional heat exchanger is used as the radiator for the refrigerant, the refrigerant in a gas state is divided and flows into each heat exchange path, is cooled in each heat exchange path, and flows out of each heat exchange path. Then, flows of the refrigerant merge with each other.

However, in the air conditioning apparatus that employs the above conventional heat exchanger, the amount of frost formation in the lowermost heat exchange path tends to increase in the heating operation. Thus, the time required for melting frost adhered to the lowermost heat exchange path may become longer than the time required for melting frost adhered to the other heat exchange paths located on the upper side relative to the lowermost heat exchange path in the defrosting operation. Thus, frost may remain unmelted in the lowermost heat exchange path even after the defrosting operation, which may result in insufficient defrosting.

One or more embodiments of the present invention reduce frost formation in the lowermost heat exchange path to reduce unmelted frost in a defrosting operation when a heat exchanger including a plurality of flat pipes arranged in multiple stages in a stage direction corresponding to the up-down direction, each of the flat pipes including a passage for a refrigerant formed inside thereof, and a plurality of fins that partition a space between adjacent flat pipes into a plurality of air flow passages through which air flows, the flat pipes being divided into a plurality of heat exchange paths arrayed in multiple stages in the stage direction, is employed in an air conditioning apparatus that performs a heating operation and a defrosting operation in a switching manner.

SUMMARY

A heat exchanger according to one or more embodiments of the present invention includes: a plurality of flat pipes arranged in multiple stages in a stage direction corresponding to an up-down direction, each of the flat pipes including a passage for a refrigerant formed inside thereof; and a plurality of fins that partition a space between each adjacent two of the flat pipes into a plurality of air flow passages through which air flows. The flat pipes are divided into a plurality of heat exchange paths arrayed in multiple stages in the stage direction. Further, when one of the heat exchange paths including a lowermost one of the flat pipes is defined as a first heat exchange path, and a length of the passage from one end to the other end of a flow of the refrigerant in each of the heat exchange paths is defined as a path effective length, the path effective length of the first heat exchange path is longer than the path effective length of each of the other heat exchange paths.

First, the reason why the amount of frost formation in the lowermost heat exchange path tends to increase in the heating operation when the above conventional heat exchanger is employed in the air conditioning apparatus that performs the heating operation (when the heat exchanger is used as the evaporator for the refrigerant) and the defrosting operation (when the heat exchanger is used as the radiator for the refrigerant) in a switching manner will be described.

In the conventional heat exchanger, the same number of flat pipes having the same shape (in the pipe length, and the size and the number of through holes each serving as the refrigerant passage) are connected in series in each heat exchange path. That is, in the conventional heat exchanger, the path effective length is equal between the heat exchange paths.

In the conventional configuration, in the heating operation, the refrigerant in a liquid state tends to flow into the lowermost heat exchange path including the lowermost flat pipe, and flows out of the lowermost heat exchange path with the temperature of the refrigerant not sufficiently raised. As a result, the amount of frost formation in the lowermost heat exchange path tends to increase. That is, it is estimated that, in the configuration of the conventional heat exchanger, the reason why the amount of frost formation in the lowermost heat exchange path tends to increase is that, in the heating operation, the refrigerant in a liquid state tends to flow into the lowermost heat exchange path, and flows out of the lowermost heat exchange path with the temperature of the refrigerant not sufficiently raised.

Thus, in one or more embodiments, differently from the conventional heat exchanger, the path effective length of the lowermost first heat exchange path including the lowermost flat pipe is longer than the path effective length of the other heat exchange paths as described above.

When the heat exchanger having such a configuration is employed in the air conditioning apparatus that performs the heating operation and the defrosting operation in a switching manner, a flow resistance of the refrigerant in the first heat exchange path can be increased by the long path effective length of the first heat exchange path. Thus, the refrigerant in a liquid state becomes less likely to flow into the first heat exchange path in the heating operation, which facilitates raising the temperature of the refrigerant flowing through the lowermost heat exchange path. Accordingly, it is possible to reduce frost formation in the first heat exchange path. Further, in one or more embodiments, a heat transfer area in the first heat exchange path can be increased by the long path effective length of the first heat exchange path. Thus, it is possible to accelerate a temperature rise in the refrigerant flowing through the lowermost heat exchange path. As a result, unmelted frost in the first heat exchange path in the defrosting operation can be reduced as compared to the case where the conventional heat exchanger is employed.

In this manner, in one or more embodiments, it is possible to reduce frost formation in the lowermost heat exchange path to reduce unmelted frost in the defrosting operation by employing the heat exchanger having the above configuration in the air conditioning apparatus that performs the heating operation and the defrosting operation in a switching manner.

In a heat exchanger according to one or more embodiments, the path effective length of the first heat exchange path is equal to or longer than twice the path effective length of the other heat exchange paths.

In one or more embodiments, since the path effective length of the first heat exchange path is sufficiently long as described above, it is possible to sufficiently increase the flow resistance of the refrigerant and the heat transfer area in the first heat exchange path to increase the effect of reducing frost formation in the lowermost heat exchange path.

In a heat exchanger according to one or more embodiments, the first heat exchange path includes a first lower side heat exchange section including the lowermost flat pipe and a first upper side heat exchange section connected in series to the first lower side heat exchange section on an upper side of the first lower side heat exchange section.

In one or more embodiments, as described above, the first heat exchange path has the configuration in which the first upper side heat exchange section and the first lower side heat exchange section are connected in series. Accordingly, it is possible to increase the path effective length of the first heat exchange path.

In a heat exchanger according to one or more embodiments, the first lower side heat exchange section and the first upper side heat exchange section are configured so that, when the heat exchanger is used as a radiator for the refrigerant, the first lower side heat exchange section serves as an entrance of the first heat exchange path.

In the configuration of the first heat exchange path in which the first upper side heat exchange section and the first lower side heat exchange section are connected in series, when the operation is switched from the heating operation to the defrosting operation, the refrigerant in a liquid state tends to be accumulated in the first lower side heat exchange section including the lowermost flat pipe.

Thus, in one or more embodiments, as described above, when the heat exchanger is used as the radiator for the refrigerant, among the first upper side heat exchange section and the first lower side heat exchange section which constitute the first heat exchange path, the first lower side heat exchange section including the lowermost flat pipe serves as the entrance of the first heat exchange path.

Accordingly, in the defrosting operation, when the refrigerant in a gas state is introduced into the first heat exchange path, the refrigerant in a gas state flows into the first lower side heat exchange section. That is, in one or more embodiments, in the defrosting operation, the first lower side heat exchange section including the lowermost flat pipe is located on the upstream side in the flow of the refrigerant. Thus, in one or more embodiments, among the first upper side heat exchange section and the first lower side heat exchange section which constitute the first heat exchange path, the refrigerant in a gas state is introduced into the first lower side heat exchange section including the lowermost flat pipe to actively heat and evaporate the refrigerant in a liquid state accumulated in the lowermost first lower side heat exchange section. Accordingly, the temperature of the lowermost first heat exchange path can be promptly raised. As a result, in one or more embodiments, it is possible to further reduce unmelted frost in the first heat exchange path in the defrosting operation.

In a heat exchanger according to one or more embodiments, each of the heat exchange paths includes a plurality of heat exchange sections connected in series, and a number of the heat exchange sections constituting the first heat exchange path is larger than a number of the heat exchange sections constituting each of the other heat exchange paths.

In one or more embodiments, as described above, each of the heat exchange paths includes the heat exchange sections connected in series, and the number of the heat exchange sections constituting the first heat exchange path is larger than the number of the heat exchange sections constituting each of the other heat exchange paths. Accordingly, it is possible to increase the path effective length of the first heat exchange path.

In a heat exchanger according to one or more embodiments, the flat pipes are arranged in multiple rows in a row direction corresponding to an air flow direction of the air passing through the air flow passages. Each of the heat exchange paths other than the first heat exchange path includes a windward side heat exchange section on the windward side in the row direction and a leeward side heat exchange section connected in series to the windward side heat exchange section on the leeward side of the windward side heat exchange section. The first heat exchange path includes a first windward lower side heat exchange section including the lowermost flat pipe on the windward side in the row direction, a first windward upper side heat exchange section on the upper side of the first windward lower side heat exchange section, a first leeward lower side heat exchange section including the lowermost flat pipe on the leeward side of the windward side heat exchange sections, and a first leeward upper side heat exchange section on the upper side of the first leeward lower side heat exchange section. The first windward lower side heat exchange section, the first windward upper side heat exchange section, the first leeward lower side heat exchange section, and the first leeward upper side heat exchange section are connected in series.

In one or more embodiments, as described above, the heat exchange paths other than the first heat exchange path have the configuration in which the windward side heat exchange section and the leeward side heat exchange section are connected in series, and the first heat exchange path has the configuration in which the first windward lower side heat exchange section, the first windward upper side heat exchange section, the first leeward lower side heat exchange section, and the first leeward upper side heat exchange section are connected in series. Accordingly, it is possible to increase the path effective length of the first heat exchange path.

In a heat exchanger according to one or more embodiments, the first windward lower side heat exchange section, the first windward upper side heat exchange section, the first leeward lower side heat exchange section, and the first leeward upper side heat exchange section are configured so that, when the heat exchanger is used as a radiator for the refrigerant, the first windward lower side heat exchange section or the first leeward lower side heat exchange section serves as an entrance of the first heat exchange path.

In the configuration of the first heat exchange path in which the first windward lower side heat exchange section, the first windward upper side heat exchange section, the first leeward lower side heat exchange section, and the first leeward upper side heat exchange section are connected in series, when the operation is switched from the heating operation to the defrosting operation, the refrigerant in a liquid state tends to be accumulated in the first windward lower side heat exchange section or the first leeward lower side heat exchange section including the lowermost flat pipe.

Thus, in one or more embodiments, as described above, when the heat exchanger is used as the radiator for the refrigerant, among the first windward lower side heat exchange section, the first windward upper side heat exchange section, the first leeward lower side heat exchange section, and the first leeward upper side heat exchange section which constitute the first heat exchange path, the first windward lower side heat exchange section or the first leeward lower side heat exchange section including the lowermost flat pipe serves as the entrance of the first heat exchange path.

Accordingly, in the defrosting operation, when the refrigerant in a gas state is introduced into the first heat exchange path, the refrigerant in a gas state flows into the first windward lower side heat exchange section or the first leeward lower side heat exchange section. That is, in one or more embodiments, in the defrosting operation, the first windward lower side heat exchange section or the first leeward lower side heat exchange section including the lowermost flat pipe is located on the upstream side in the flow of the refrigerant. Thus, in one or more embodiments, among the first windward lower side heat exchange section, the first windward upper side heat exchange section, the first leeward lower side heat exchange section, and the first leeward upper side heat exchange section which constitute the first heat exchange path, the refrigerant in a gas state is introduced into the first windward lower side heat exchange section or the first leeward lower side heat exchange section including the lowermost flat pipe to actively heat and evaporate the refrigerant in a liquid state accumulated in the lowermost first windward lower side heat exchange section or the lowermost first leeward lower side heat exchange section. Accordingly, the temperature of the lowermost first heat exchange path can be promptly raised. As a result, in one or more embodiments, it is possible to further reduce unmelted frost in the first heat exchange path in the defrosting operation.

In a heat exchanger according to one or more embodiments, the first windward lower side heat exchange section, the first windward upper side heat exchange section, the first leeward lower side heat exchange section, and the first leeward upper side heat exchange section are configured so that, when the heat exchanger is used as a radiator for the refrigerant, the first windward lower side heat exchange section or the first windward upper side heat exchange section serves as an entrance of the first heat exchange path.

In the configuration in which each of the heat exchange paths includes the windward side heat exchange section located on the windward side in the row direction (in the first heat exchange path, the first windward lower side heat exchange section and the first windward upper side heat exchange section) and the leeward side heat exchange section located on the leeward side in the row direction (in the first heat exchange path, the first leeward lower side heat exchange section and the first leeward upper side heat exchange section), the amount of frost adhered to the windward side heat exchange section tends to increase in the heating operation. Thus, unmelted frost in the lowermost first heat exchange path (in particular, the first windward lower side heat exchange section and the first windward upper side heat exchange section) may increase in the defrosting operation.

Thus, in one or more embodiments, as described above, when the heat exchanger is used as the radiator for the refrigerant, among the first windward lower side heat exchange section, the first windward upper side heat exchange section, the first leeward lower side heat exchange section, and the first leeward upper side heat exchange section which constitute the first heat exchange path, the first windward lower side heat exchange section or the first windward upper side heat exchange section located on the windward side in the row direction serves as the entrance of the first heat exchange path.

Accordingly, in the defrosting operation, when the refrigerant in a gas state is introduced into the first heat exchange path, the refrigerant in a gas state flows into the first windward lower side heat exchange section or the first windward upper side heat exchange section. That is, in one or more embodiments, the first windward lower side heat exchange section or the first windward upper side heat exchange section located on the windward side in the row direction is located on the upstream side in the flow of the refrigerant in the defrosting operation. Thus, in one or more embodiments, among the first windward lower side heat exchange section, the first windward upper side heat exchange section, the first leeward lower side heat exchange section, and the first leeward upper side heat exchange section which constitute the first heat exchange path, the refrigerant in a gas state can be introduced into the first windward lower side heat exchange section or the first windward upper side heat exchange section located on the windward side in the row direction to actively heat and melt frost adhered to the first windward lower side heat exchange section or the first windward upper side heat exchange section located on the windward side in the row direction. Accordingly, in one or more embodiments, it is possible to further reduce unmelted frost in the first heat exchange path in the defrosting operation.

A heat exchanger according to one or more embodiments includes: a plurality of flat pipes arranged in multiple stages in a stage direction corresponding to an up-down direction, each of the flat pipes including a passage for a refrigerant formed inside thereof; and a plurality of fins that partition a space between each adjacent two of the flat pipes into a plurality of air flow passages through which air flows. The flat pipes are divided into a plurality of heat exchange paths arrayed in multiple stages in the stage direction. Further, when one of the heat exchange paths including a lowermost one of the flat pipes is defined as a first heat exchange path, and a cross-sectional area of the passage in each of the heat exchange paths is defined as a path effective cross-sectional area, the path effective cross-sectional area of the first heat exchange path is smaller than the path effective cross-sectional area of the other heat exchange paths.

First, the reason why the amount of frost formation in the lowermost heat exchange path tends to increase in the heating operation when the above conventional heat exchanger is employed in the air conditioning apparatus that performs the heating operation (when the heat exchanger is used as the evaporator for the refrigerant) and the defrosting operation (when the heat exchanger is used as the radiator for the refrigerant) in a switching manner will be described.

In the conventional heat exchanger, the same number of flat pipes having the same shape (in the pipe length, and the size and the number of through holes each serving as the refrigerant passage) are connected in series in each heat exchange path. That is, in the conventional heat exchanger, the path effective cross-sectional area is equal between the heat exchange paths.

In the conventional configuration, in the heating operation, the refrigerant in a liquid state tends to flow into the lowermost heat exchange path including the lowermost flat pipe, and flows out of the lowermost heat exchange path with the temperature of the refrigerant not sufficiently raised. As a result, the amount of frost formation in the lowermost heat exchange path tends to increase. That is, it is estimated that, in the configuration of the conventional heat exchanger, the reason why the amount of frost formation in the lowermost heat exchange path tends to increase is that, in the heating operation, the refrigerant in a liquid state tends to flow into the lowermost heat exchange path, and flows out of the lowermost heat exchange path with the temperature of the refrigerant not sufficiently raised.

Thus, in one or more embodiments, differently from the conventional heat exchanger, the path effective cross-sectional area of the lowermost first heat exchange path including the lowermost flat pipe is smaller than the path effective cross-sectional area of the other heat exchange paths as described above.

When the heat exchanger having such a configuration is employed in the air conditioning apparatus that performs the heating operation and the defrosting operation in a switching manner, a flow resistance of the refrigerant in the first heat exchange path can be increased by the small path effective cross-sectional area of the first heat exchange path. Thus, the refrigerant in a liquid state becomes less likely to flow into the first heat exchange path in the heating operation, which facilitates raising the temperature of the refrigerant flowing through the lowermost heat exchange path. Accordingly, it is possible to reduce frost formation in the first heat exchange path. As a result, unmelted frost in the first heat exchange path in the defrosting operation can be reduced as compared to the case where the conventional heat exchanger is employed.

In this manner, in one or more embodiments, it is possible to reduce frost formation in the lowermost heat exchange path to reduce unmelted frost in the defrosting operation by employing the heat exchanger having the above configuration in the air conditioning apparatus that performs the heating operation and the defrosting operation in a switching manner.

In a heat exchanger according to one or more embodiments, the path effective cross-sectional area of the first heat exchange path is equal to or smaller than 0.5 times the path effective cross-sectional area of the other heat exchange paths.

In one or more embodiments, as described above, the path effective cross-sectional area of the first heat exchange path is sufficiently small Therefore, it is possible to sufficiently increase the flow resistance of the refrigerant in the first heat exchange path to increase the effect of reducing frost formation in the lowermost heat exchange path.

In a heat exchanger according to one or more embodiments, each of the flat pipes includes a plurality of through holes each serving as the passage, and a size of the through holes of the flat pipes constituting the first heat exchange path is smaller than a size of the through holes of the flat pipes constituting the other heat exchange paths, and/or a number of the through holes of each of the flat pipes constituting the first heat exchange path is smaller than a number of the through holes of each of the flat pipes constituting the other heat exchange paths.

In one or more embodiments, as described above, each of the flat pipes includes the through holes each serving as the passage, and the size of the through holes of the flat pipes constituting the first heat exchange path is set smaller than the size of the through holes of the flat pipes constituting the other heat exchange paths, or the number of the through holes of each of the flat pipes constituting the first heat exchange path is set smaller than the number of the through holes of each of the flat pipes constituting the other heat exchange paths. Accordingly, it is possible to reduce the path effective cross-sectional area of the first heat exchange path.

In a heat exchanger according to one or more embodiments, a number of the flat pipes constituting the first heat exchange path is smaller than a number of the flat pipes constituting each of the other heat exchange paths.

When the configuration in which the number of the flat pipes constituting the first heat exchange path is smaller than the number of the flat pipes constituting each of the other heat exchange paths is employed, a drift tends to occur when the refrigerant is divided and introduced into the heat exchange paths.

However, in one or more embodiments, as described above, the configuration in which the path effective length of the first heat exchange path is longer than the path effective length of the other heat exchange paths or the path effective cross-sectional area of the first heat exchange path is smaller than the path effective cross-sectional area of the other heat exchange paths is employed to increase the flow resistance of the refrigerant in the first heat exchange path. Thus, it is possible to reduce the occurrence of a drift when the refrigerant is divided and introduced into the heat exchange paths.

In a heat exchanger according to one or more embodiments, each of the fins includes a plurality of cutouts into which the flat pipes are inserted, the cutouts extending from the leeward side toward the windward side in an air flow direction of the air passing through the air flow passages, a plurality of fin main parts each interposed between each adjacent two of the cutouts, and a fin windward part extending continuously with the plurality of fin main parts on the windward side in the air flow direction relative to the cutouts.

In one or more embodiments, as described above, the cutouts into which the flat pipes are inserted extend from the leeward side toward the windward side in the air flow direction, and the fin windward part extends continuously with the plurality of fin main parts, each of which is interposed between adjacent cutouts, on the windward side in the air flow direction relative to the cutouts. In the heat exchanger having such a configuration, the amount of frost adhered to the fin windward part tends to increase in the defrosting operation. Thus, unmelted frost in the lowermost first heat exchange path may increase in the defrosting operation.

However, as described above, one or more embodiments employ the configuration in which the path effective length of the first heat exchange path is longer than the path effective length of the other heat exchange paths or the configuration in which the path effective cross-sectional area of the first heat exchange path is smaller than the path effective cross-sectional area of the other heat exchange paths. Thus, it is possible to reduce frost formation in the lowermost heat exchange path including frost adhered to the fin windward part to reduce unmelted frost in the defrosting operation.

An air conditioning apparatus according to one or more embodiments includes the heat exchanger according to any one of one or more embodiments.

In one or more embodiments, the air conditioning apparatus employs the heat exchanger according to any one of one or more embodiments. Thus, it is possible to reduce frost formation in the lowermost heat exchange path to reduce unmelted frost in the defrosting operation.

DETAILED DESCRIPTION

Hereinbelow, embodiments and modifications of a heat exchanger and an air conditioning apparatus including the heat exchanger according to the present invention will be described with reference to the drawings. Specific configurations of the heat exchanger and the air conditioning apparatus including the heat exchanger according to the present invention are not limited to the embodiments and the modifications described below, and can be changed without departing from the gist of the invention.

(1) Configuration of Air Conditioning Apparatus

Figure 1:
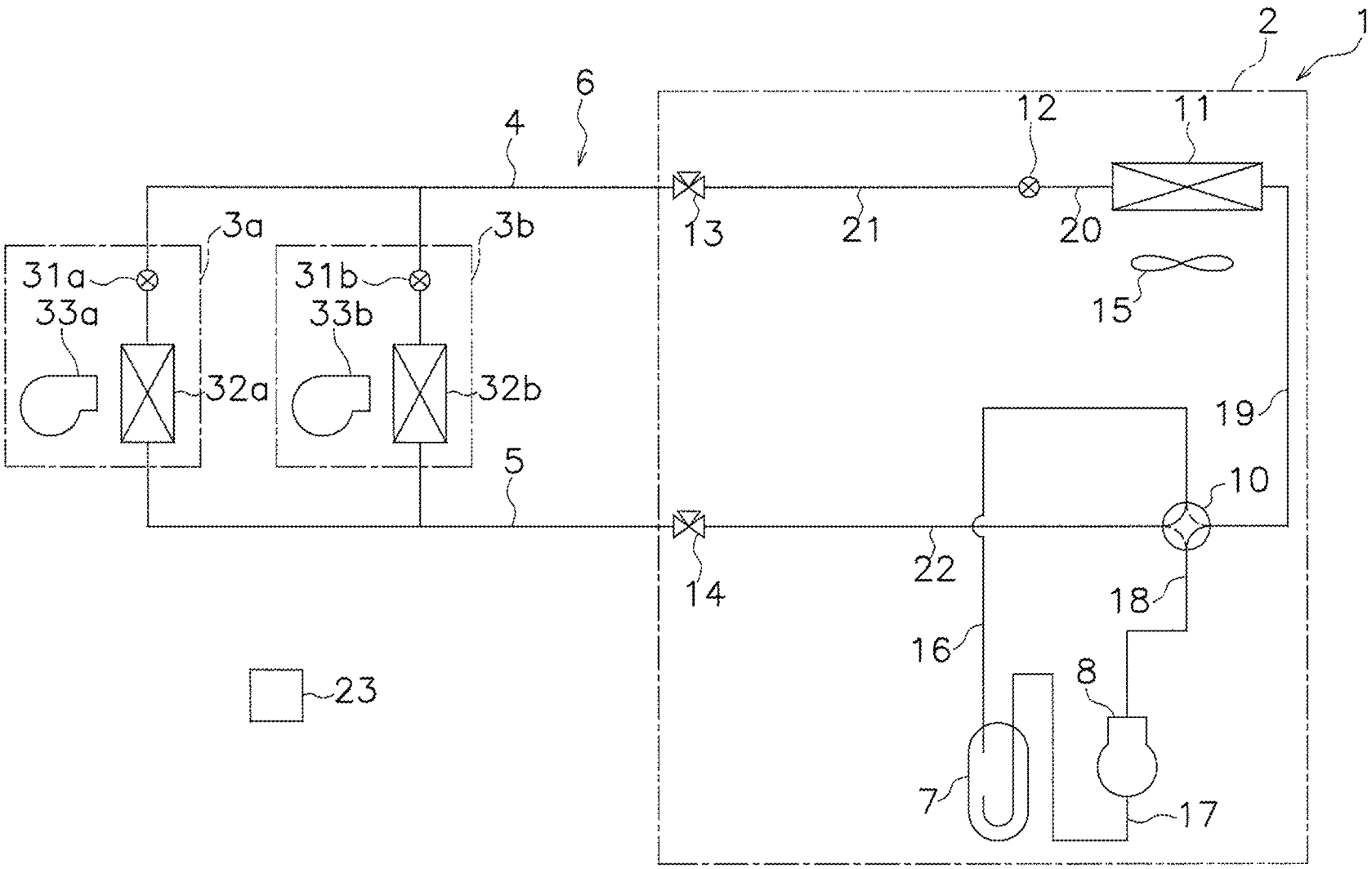
FIG. 1 is a schematic configuration diagram of an outdoor heat exchanger as a heat exchanger according to one or more embodiments of the present invention and an air conditioning apparatus including the outdoor heat exchanger.

FIG. 1 is a schematic configuration diagram of an outdoor heat exchanger 11 as a heat exchanger according to one or more embodiments of the present invention and an air conditioning apparatus 1 including the outdoor heat exchanger 11.

The air conditioning apparatus 1 is an apparatus capable of performing cooling and heating inside a room of a building or the like by preforming a vapor compression refrigeration cycle. The air conditioning apparatus 1 mainly includes an outdoor unit 2, indoor units 3*a*, 3*b*, a liquid-refrigerant connection pipe 4 and a gas-refrigerant connection pipe 5 which connect the outdoor unit 2 to the indoor units 3*a*, 3*b*, and a control unit 23 which controls constituent devices of the outdoor unit 2 and the indoor units 3*a*, 3*b*. A vapor compression refrigerant circuit 6 of the air conditioning apparatus 1 is formed by connecting the outdoor unit 2 to the indoor units 3*a*, 3*b* through the refrigerant connection pipes 4, 5.

The outdoor unit 2 is installed outside the room (on the roof of the building or near a wall surface of the building, or the like), and constitutes a part of the refrigerant circuit 6. The outdoor unit 2 mainly includes an accumulator 7, a compressor 8, a four-way switching valve 10, an outdoor heat exchanger 11, an outdoor expansion valve 12 as an expansion mechanism, a liquid-side shutoff valve 13, a gas-side shutoff valve 14, and an outdoor fan 15. These devices and valves are connected through refrigerant pipes 16 to 22.

The indoor units 3*a*, 3*b* are installed inside the room (in a living room or in a ceiling space, or the like), and constitute a part of the refrigerant circuit 6. The indoor unit 3*a* mainly includes an indoor expansion valve 31*a*, an indoor heat exchanger 32*a*, and an indoor fan 33*a*. The indoor unit 3*b* mainly includes an indoor expansion valve 31*b* as an expansion mechanism, an indoor heat exchanger 32*b*, and an indoor fan 33*b*.

The refrigerant connection pipes 4, 5 are constructed in a site when the air conditioning apparatus 1 is installed in an installation place such as a building. One end of the liquid-refrigerant connection pipe 4 is connected to the liquid-side shutoff valve 13 of the outdoor unit 2, and the other end of the liquid-refrigerant connection pipe 4 is connected to liquid-side ends of the indoor expansion valves 31*a*, 31*b* of the indoor units 3*a*, 3*b*. One end of the gas-refrigerant connection pipe 5 is connected to the gas-side shutoff valve 14 of the outdoor unit 2, and the other end of the gas-refrigerant connection pipe 5 is connected to gas-side ends of the indoor heat exchangers 32*a*, 32*b* of the indoor units 3*a*, 3*b*.

The control unit 23 is constituted by communicably connecting control boards (not illustrated) included in the outdoor unit 2 and the indoor units 3*a*, 3*b*. In FIG. 1, for convenience, the control unit 23 is illustrated at a location away from the outdoor unit 2 and the indoor units 3*a*, 3*b*. The control unit 23 controls the constituent devices 8, 10, 12, 15, 31*a*, 31*b*, 33*a*, 33*b* of the air conditioning apparatus 1 (in one or more embodiments, the outdoor unit 2 and the indoor units 3*a*, 3*b*), that is, controls the operation of the entire air conditioning apparatus 1.

(2) Operation of Air Conditioning Apparatus

Next, the operation of the air conditioning apparatus 1 will be described with reference to FIG. 1. The air conditioning apparatus 1 performs a cooling operation which circulates a refrigerant through the compressor 8, the outdoor heat exchanger 11, the outdoor expansion valve 12, the indoor expansion valves 31*a*, 31*b*, and the indoor heat exchangers 32*a*, 32*b* in this order and a heating operation which circulates the refrigerant through the compressor 8, the indoor heat exchangers 32*a*, 32*b*, the indoor expansion valves 31*a*, 31*b*, the outdoor expansion valve 12, and the outdoor heat exchanger 11 in this order. In the heating operation, a defrosting operation for melting frost adhered to the outdoor heat exchanger 11 is performed. In one or more embodiments, an inversed cycle defrosting operation which circulates the refrigerant through the compressor 8, the outdoor heat exchanger 11, the outdoor expansion valve 12, the indoor expansion valves 31*a*, 31*b*, and the indoor heat exchangers 32*a*, 32*b* in this order in a manner similar to the cooling operation is performed. The control unit 23 performs the cooling operation, the heating operation, and the defrosting operation.

In the cooling operation, the four-way switching valve 10 is switched to an outdoor heat radiation state (a state indicated by a solid line in FIG. 1). In the refrigerant circuit 6, a low-pressure gas refrigerant of the refrigeration cycle is sucked into the compressor 8, compressed until the refrigerant becomes high pressure of the refrigeration cycle, and then discharged. The high-pressure gas refrigerant discharged from the compressor 8 is fed to the outdoor heat exchanger 11 through the four-way switching valve 10. The high-pressure gas refrigerant fed to the outdoor heat exchanger 11 radiates heat by heat exchange with outdoor air which is supplied as a cooling source by the outdoor fan 15 and thereby becomes a high-pressure liquid refrigerant in the outdoor heat exchanger 11 which functions as a radiator for the refrigerant. The high-pressure liquid refrigerant after the heat radiation in the outdoor heat exchanger 11 is fed to the indoor expansion valves 31*a*, 31*b* through the outdoor expansion valve 12, the liquid-side shutoff valve 13, and the liquid-refrigerant connection pipe 4. The refrigerant fed to the indoor expansion valves 31*a*, 31*b* is decompressed to low pressure of the refrigeration cycle by the indoor expansion valves 31*a*, 31*b* and thereby becomes a low-pressure refrigerant in a gas-liquid two-phase state. The low-pressure refrigerant in a gas-liquid two-phase state decompressed by the indoor expansion valves 31*a*, 31*b* is fed to the indoor heat exchangers 32*a*, 32*b*. The low-pressure refrigerant in a gas-liquid two-phase state fed to the indoor heat exchangers 32*a*, 32*b* evaporates by heat exchange with indoor air which is supplied as a heating source by the indoor fans 33*a*, 33*b* in the indoor heat exchangers 32*a*, 32*b*. Accordingly, the indoor air is cooled and then supplied into the room, thereby cooling the inside of the room. The low-pressure gas refrigerant evaporated in the indoor heat exchangers 32*a*, 32*b* is sucked into the compressor 8 again through the gas-refrigerant connection pipe 5, the gas-side shutoff valve 14, the four-way switching valve 10, and the accumulator 7.

In the heating operation, the four-way switching valve 10 is switched to an outdoor evaporation state (a state indicated by a broken line in FIG. 1). In the refrigerant circuit 6, a low-pressure gas refrigerant of the refrigeration cycle is sucked into the compressor 8, compressed until the refrigerant becomes high pressure of the refrigeration cycle, and then discharged. The high-pressure gas refrigerant discharged from the compressor 8 is fed to the indoor heat exchangers 32*a*, 32*b* through the four-way switching valve 10, the gas-side shutoff valve 14, and the gas-refrigerant connection pipe 5. The high-pressure gas refrigerant fed to the indoor heat exchangers 32*a*, 32*b* radiates heat by heat exchange with indoor air which is supplied as a cooling source by the indoor fans 33*a*, 33*b* and thereby becomes a high-pressure liquid refrigerant in the indoor heat exchangers 32*a*, 32*b*. Accordingly, the indoor air is heated and then supplied into the room, thereby heating the inside of the room. The high-pressure liquid refrigerant after the heat radiation in the indoor heat exchangers 32*a*, 32*b* is fed to the outdoor expansion valve 12 through the indoor expansion valves 31*a*, 31*b*, the liquid-refrigerant connection pipe 4, and the liquid-side shutoff valve 13. The refrigerant fed to the outdoor expansion valve 12 is decompressed to low pressure of the refrigeration cycle by the outdoor expansion valve 12 and thereby becomes a low-pressure refrigerant in a gas-liquid two-phase state. The low-pressure refrigerant in a gas-liquid two-phase state decompressed by the outdoor expansion valve 12 is fed to the outdoor heat exchanger 11. The low-pressure refrigerant in a gas-liquid two-phase state fed to the outdoor heat exchanger 11 evaporates by heat exchange with outdoor air which is supplied as a heating source by the outdoor fan 15 and thereby becomes a low-pressure gas refrigerant in the outdoor heat exchanger 11 which functions as an evaporator for the refrigerant. The low-pressure gas refrigerant evaporated in the outdoor heat exchanger 11 is sucked into the compressor 8 again through the four-way switching valve 10 and the accumulator 7.

When frost formation in the outdoor heat exchanger 11 is detected according to, for example, the temperature of the refrigerant in the outdoor heat exchanger 11 lower than a predetermined temperature, that is, when a condition for starting defrosting in the outdoor heat exchanger 11 is satisfied, the defrosting operation for melting frost adhered to the outdoor heat exchanger 11 is performed.

The defrosting operation is performed by switching the four-way switching valve 22 to the outdoor heat radiation state (the state indicated by the solid line in FIG. 1) to cause the outdoor heat exchanger 11 to function as the radiator for the refrigerant in a manner similar to the cooling operation. Accordingly, frost adhered to the outdoor heat exchanger 11 can be melted. The defrosting operation is performed until a defrosting time, which is set taking into consideration, for example, a state of the heating operation before defrosting, elapses or until it is determined that defrosting in the outdoor heat exchanger 11 has been completed according to the temperature of the refrigerant in the outdoor heat exchanger 11 higher than the predetermined temperature, and the operation then returns to the heating operation. The flow of the refrigerant in the refrigerant circuit 10 in the defrosting operation is similar to that in the cooling operation. Thus, description thereof will be omitted.

(3) Entire Configuration of Outdoor Unit

Figure 2:
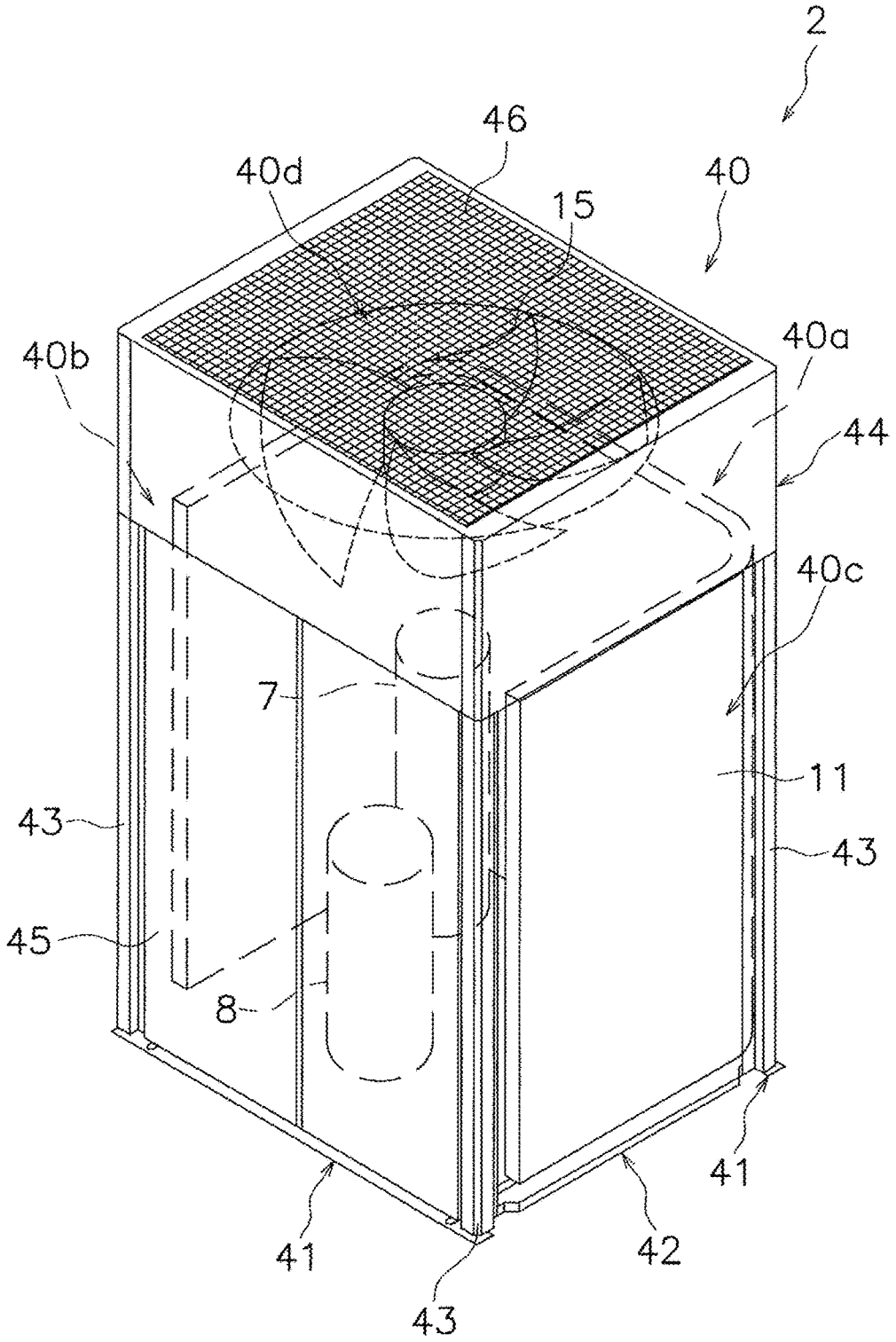
FIG. 2 is an external perspective view of an outdoor unit.
Figure 3:
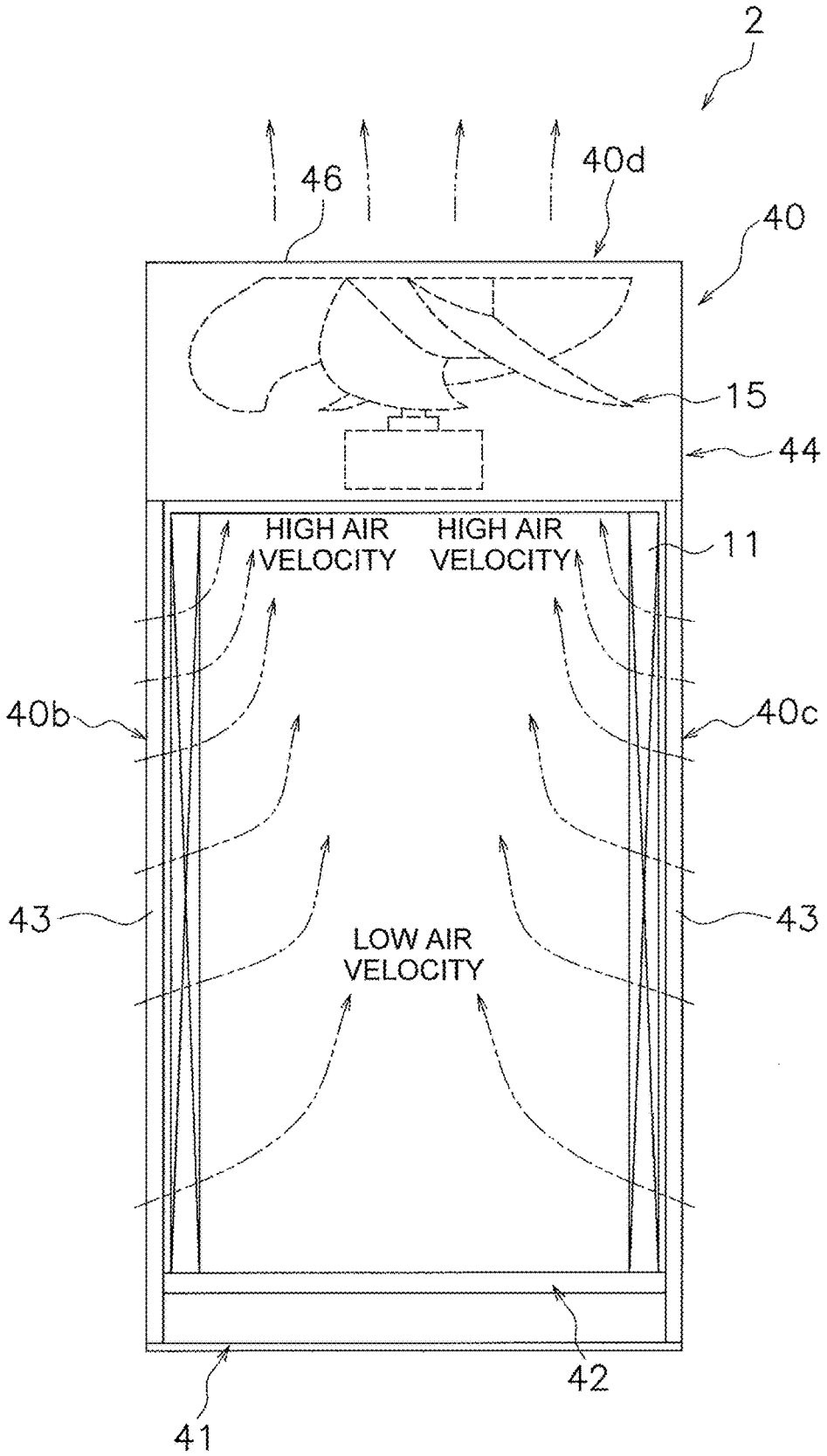
FIG. 3 is a front view of the outdoor unit (except refrigerant circuit constituent components other than the outdoor heat exchanger).

FIG. 2 is an external perspective view of the outdoor unit 2. FIG. 3 is a front view of the outdoor unit 2 (except the refrigerant circuit constituent components other than the outdoor heat exchanger 11).

The outdoor unit 2 is a top blow-out type heat exchange unit which draws in air from the side face of a casing 40 and blows out air from the top face of the casing 40. The outdoor unit 2 mainly includes the casing 40 having a substantially rectangular parallelepiped box shape, the outdoor fan 15 as a fan, and the refrigerant circuit constituent components which constitute a part of the refrigerant circuit 6 including the devices 7, 8, 11 including the compressor and the outdoor heat exchanger, the valves 10, and 12 to 14 including the four-way switching valve and the outdoor expansion valve, the refrigerant pipes 16 to 22, and the like. In the following description, "up", "down", "left", "right", "front", "back", "front face", and "back face" indicate directions in a case where the outdoor unit 2 illustrated in FIG. 2 is viewed from the front (the diagonally left front side) unless otherwise particularly noted.

The casing 40 mainly includes a bottom frame 42 which is put across a pair of installation legs 41 which extend in the right-left direction, supports 43 which extend in the vertical direction from corners of the bottom frame 42, a fan module 44 which is attached to the upper ends of the supports 43, and a front panel 45. The casing 40 includes inlet ports 40*a*, 40*b*, 40*c* for air on the side faces (in one or more embodiments, the back face, and the right and left side faces) and a blow-out port 40*d* for air on the top face.

The bottom frame 42 forms the bottom face of the casing 40. The outdoor heat exchanger 11 is disposed on the bottom frame 42. The outdoor heat exchanger 11 is a heat exchanger which has a substantially U shape in plan view and faces the back face and the right and left side faces of the casing 40. The outdoor heat exchanger 11 substantially forms the back face and the right and left side faces of the casing 40. The bottom frame 42 is in contact with a lower end part of the outdoor heat exchanger 11, and functions as a drain pan which receives drain water generated in the outdoor heat exchanger 11 in the cooling operation and the defrosting operation.

The fan module 44 is disposed on the upper side of the outdoor heat exchanger 11 to form a part of the front face, the back face, and the right and left faces of the casing 40, which locates above the supports 43 and the top face of the casing 40. The fan module 44 is an aggregate including a substantially rectangular parallelepiped box body whose upper and lower faces are open and the outdoor fan 15 housed in the box body. The opening on the top face of the fan module 44 corresponds to the blow-out port 40*d*. A blow-out grille 46 is disposed on the blow-out port 40*d*. The outdoor fan 15 is disposed facing the blow-out port 40*d* inside the casing 40. The outdoor fan 15 is a fan which takes air into the casing 40 through the inlet ports 40*a*, 40*b*, 40*c* and discharges air through the blow-out port 40*d*.

The front panel 45 is put between the supports 43 on the front face side to form the front face of the casing 40.

The refrigerant circuit constituent components other than the outdoor fan 15 and the outdoor heat exchanger 11 (FIG. 2 illustrates the accumulator 7 and the compressor 8) are also housed inside the casing 40. The compressor 8 and the accumulator 7 are disposed on the bottom frame 42.

In this manner, the outdoor unit 2 includes the casing 40 which includes the inlet ports 40*a*, 40*b*, 40*c* for air formed on the side faces (in one or more embodiments, the back face and the right and left side faces) and the blow-out port 40*d* for air formed on the top face, the outdoor fan 15 (fan) which is disposed facing the blow-out port 40*d* inside the casing 40, and the outdoor heat exchanger 11 which is disposed under the outdoor fan 15 inside the casing 40. In such a top blow-out type unit configuration, as illustrated in FIG. 3, the outdoor heat exchanger 11 is disposed under the outdoor fan 15. Thus, the velocity of air passing through the upper part of the outdoor heat exchanger 11 tends to become higher than the velocity of air passing through the lower part of the outdoor heat exchanger 11.

(4) Outdoor Heat Exchanger According to One or More Embodiments

<Configuration>

Figure 4:
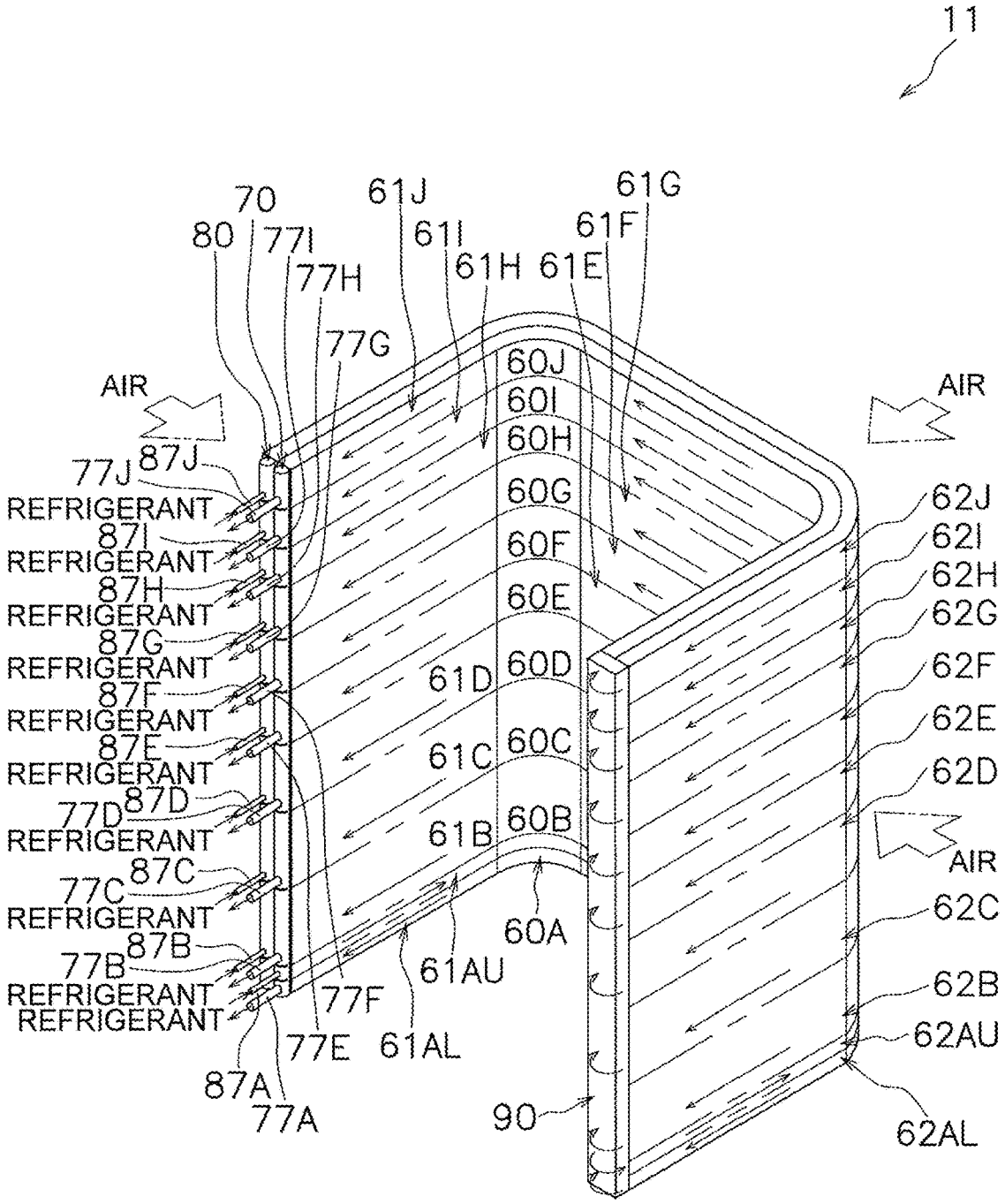
FIG. 4 is a schematic perspective view of an outdoor heat exchanger as a heat exchanger according to one or more embodiments.
Figure 5:
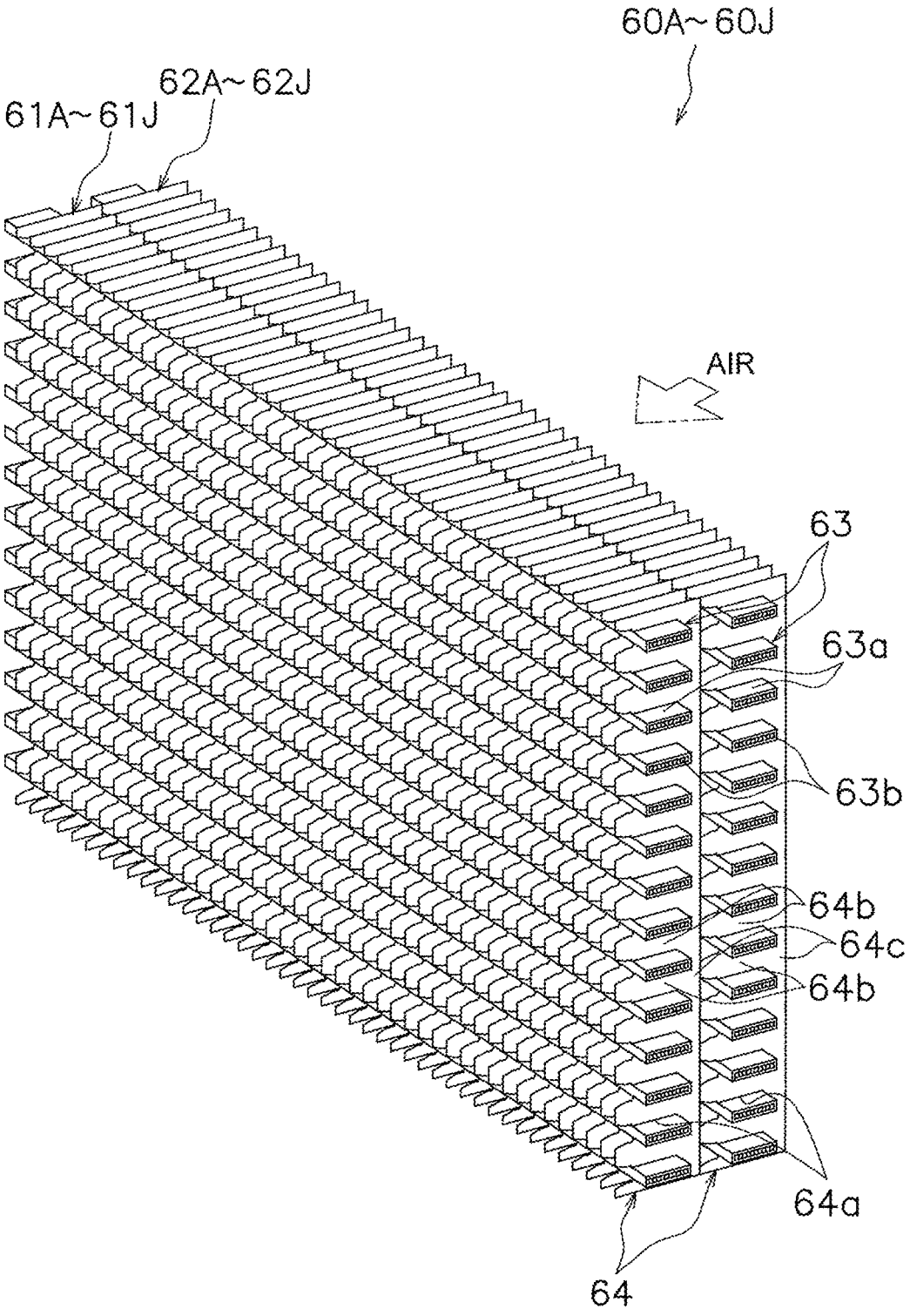
FIG. 5 is a partial enlarged perspective view of heat exchange paths of FIG. 4.
Figure 6:
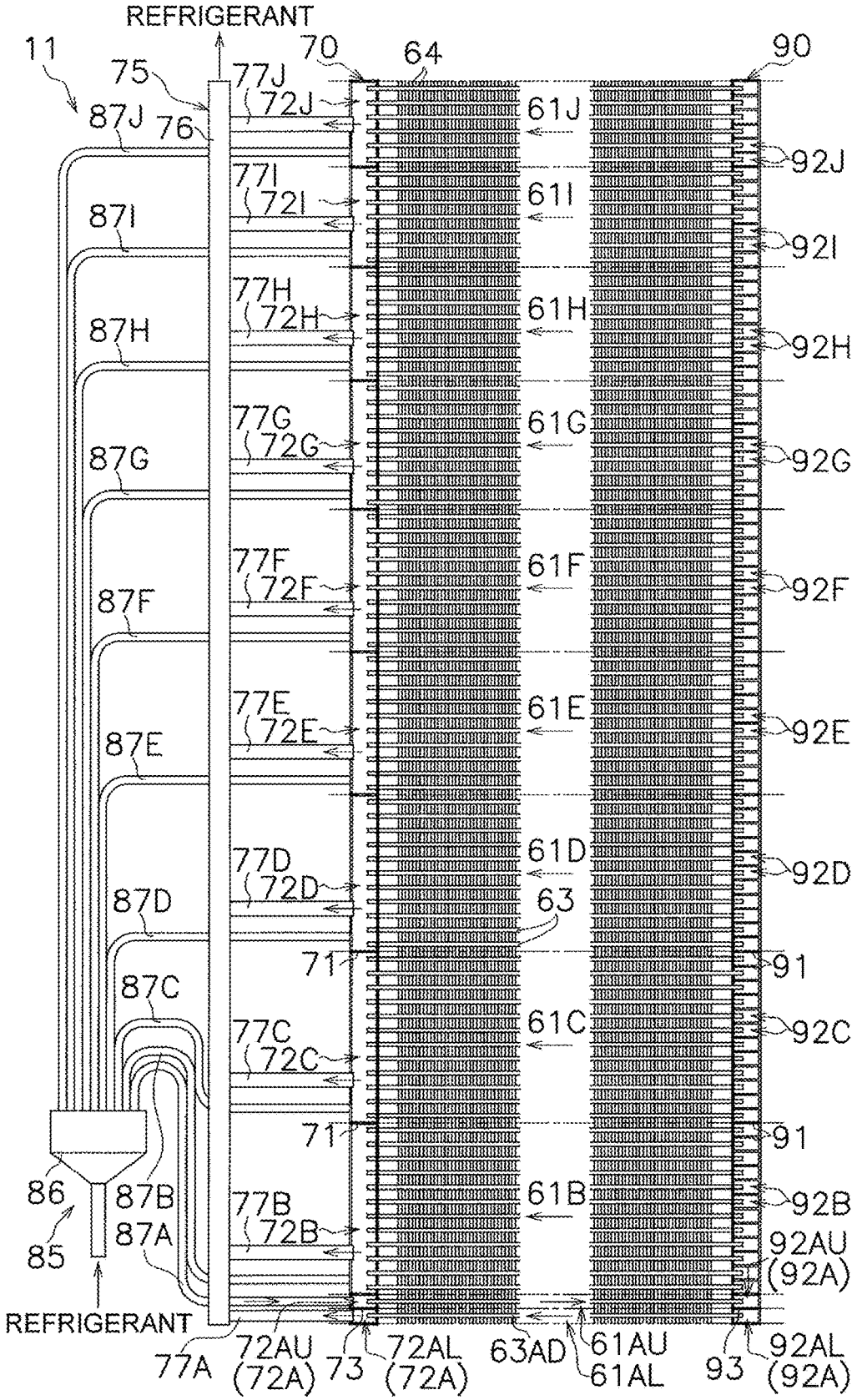
FIG. 6 is a schematic configuration diagram of the outdoor heat exchanger as the heat exchanger according to one or more embodiments (viewed from the leeward side).
Figure 7:
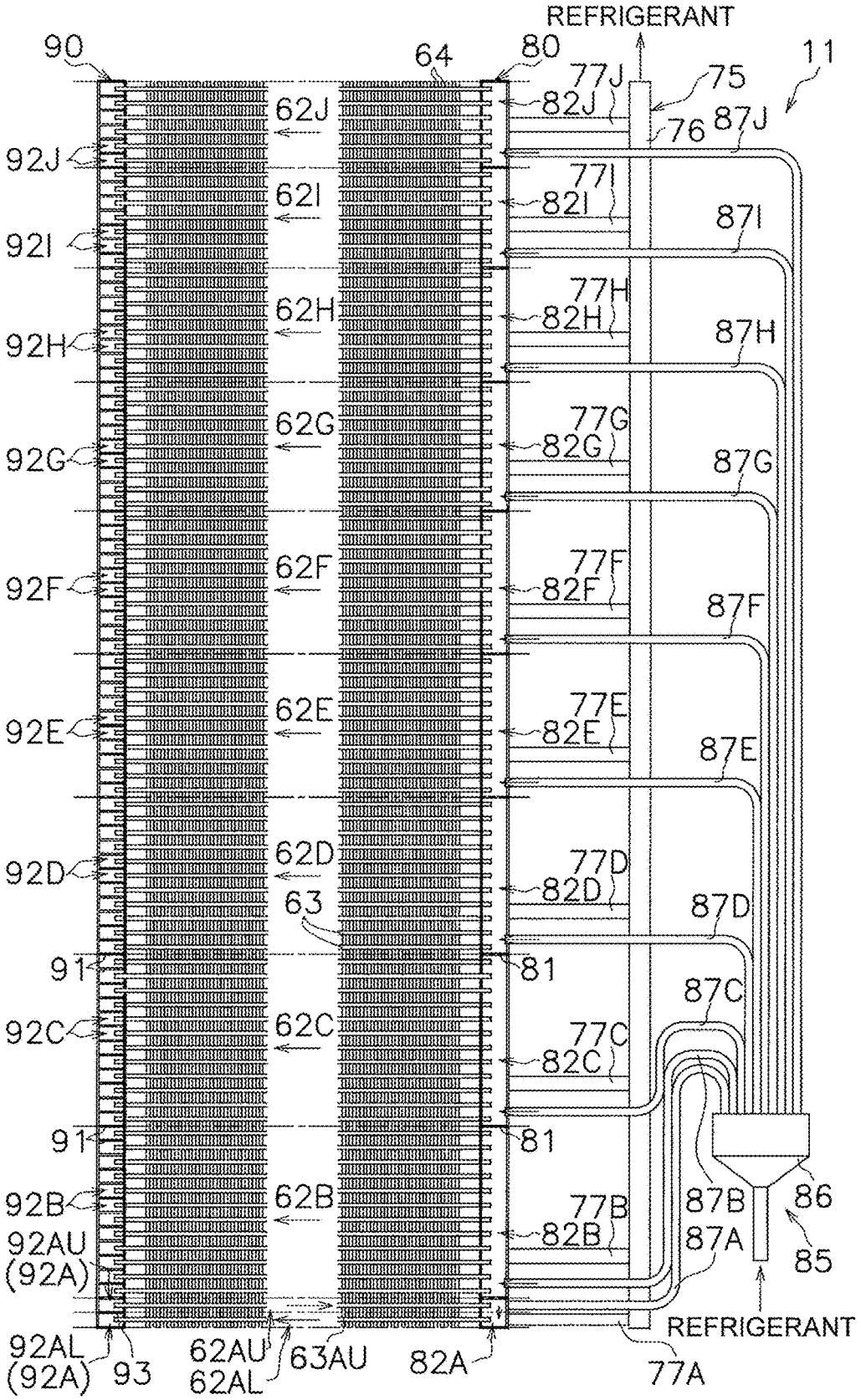
FIG. 7 is a schematic configuration diagram of the outdoor heat exchanger as the heat exchanger according to one or more embodiments (viewed from the windward side).
Figure 8:
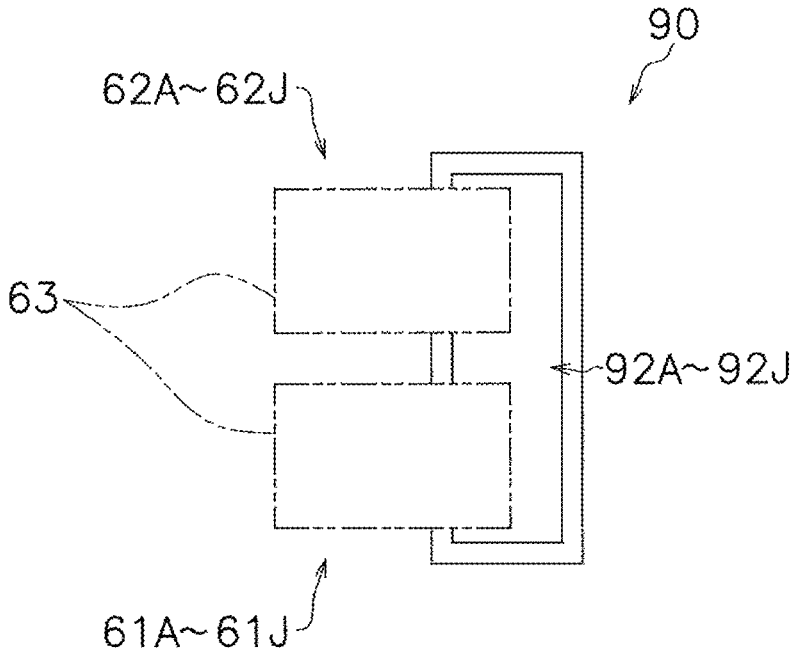
FIG. 8 is a plane sectional view of a coupling header.
Figure 9:
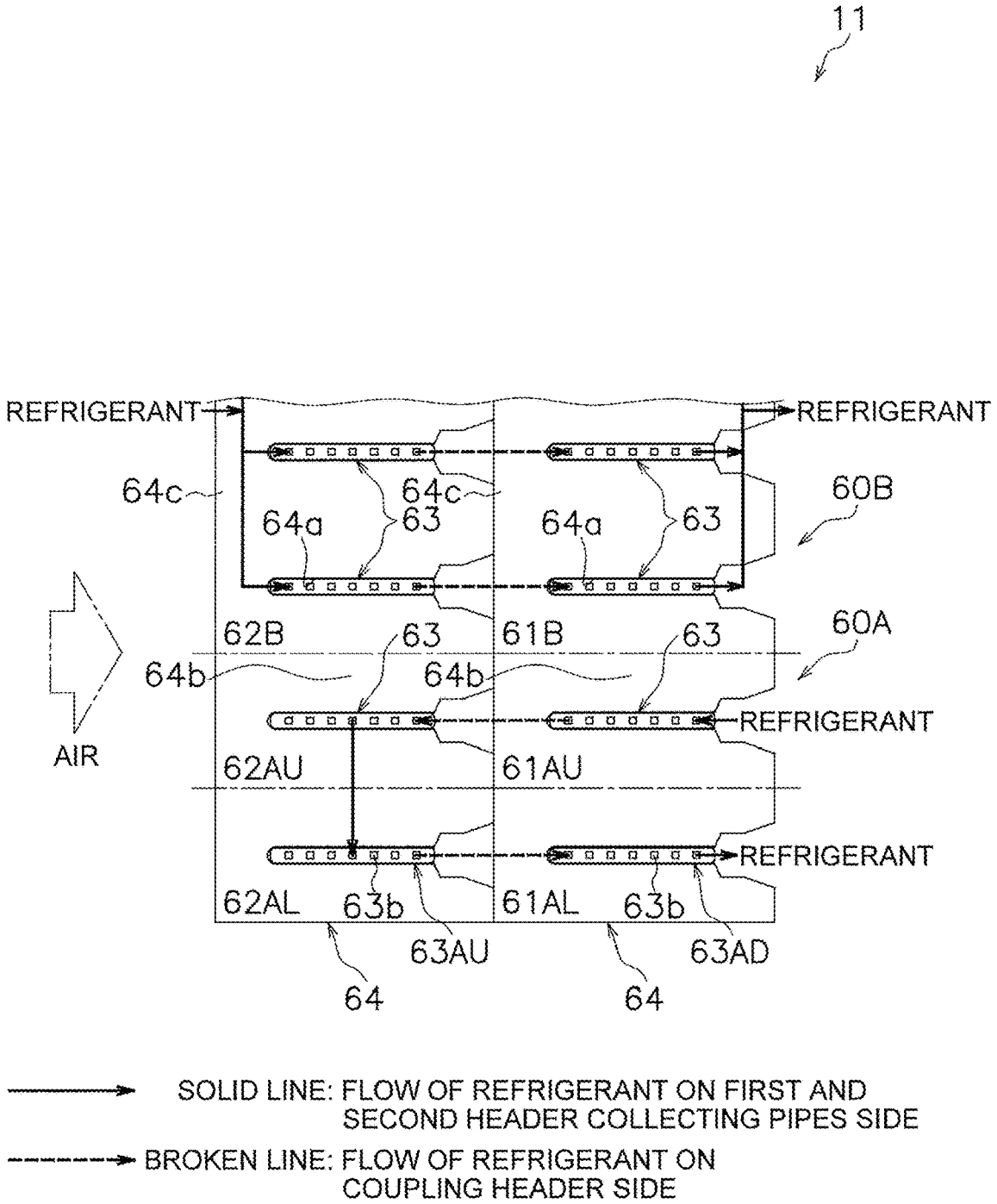
FIG. 9 is a diagram illustrating a path configuration near a first heat exchange path of the outdoor heat exchanger as the heat exchanger according to one or more embodiments.

FIG. 4 is a schematic perspective view of the outdoor heat exchanger 11 as a heat exchanger according to one or more embodiments. FIG. 5 is a partial enlarged view of heat exchange paths 60A to 60J of FIG. 4. FIG. 6 is a schematic configuration diagram of the outdoor heat exchanger 11 as the heat exchanger according to one or more embodiments (viewed from the leeward side). FIG. 7 is a schematic configuration diagram of the outdoor heat exchanger 11 as the heat exchanger according to one or more embodiments (viewed from the windward side). FIG. 8 is a plane sectional view of a coupling header 90. FIG. 9 is a diagram illustrating a path configuration near the first heat exchange path 60A of the outdoor heat exchanger 11 as the heat exchanger according to one or more embodiments. In FIGS. 4, 6, 7, and 9, the arrows which indicate the refrigerant flow direction show the direction of the refrigerant flow in the heating operation (when the outdoor heat exchanger 11 functions as the evaporator for the refrigerant).

The outdoor heat exchanger 11 is a heat exchanger that exchanges heat between the refrigerant and outdoor air. The outdoor heat exchanger 11 mainly includes a first header collecting pipe 70, a second header collecting pipe 80, a coupling header 90, a plurality of flat pipes 63, and a plurality of fins 64. In one or more embodiments, the first header collecting pipe 70, the second header collecting pipe 80, the coupling header 90, the flat pipes 63, and the fins 64 are all made of aluminum or an aluminum alloy and joined to each other by, for example, brazing.

The first header collecting pipe 70 is a vertically long hollow tubular member whose upper and lower ends are closed. The first header collecting pipe 70 stands on one end side (in one or more embodiments, the left front end side in FIG. 4 or the left end side in FIG. 6) of the outdoor heat exchanger 11.

The second header collecting pipe 80 is a vertically long hollow tubular member whose upper and lower ends are closed. The second header collecting pipe 80 stands on one end side (in one or more embodiments, the left front end side in FIG. 4 or the right end side in FIG. 7) of the outdoor heat exchanger 11. In one or more embodiments, the second header collecting pipe 80 is disposed on the windward side in the air flow direction relative to the first header collecting pipe 70.

The coupling header 90 is a vertically long hollow tubular member whose upper and lower ends are closed. The second header collecting pipe 80 stands on one end side (in one or more embodiments, the right front end side in FIG. 4, the right end side in FIG. 6, or the left end side in FIG. 7) of the outdoor heat exchanger 11.

Each of the flat pipes 63 is a flat multi-perforated pipe including a flat part 63*a* which serves as a heat transfer surface and faces in the vertical direction and a passage 63*b* including a large number of small through holes through which the refrigerant flows, the passage 63*b* being formed inside the flat pipe 63. The flat pipes 63 are arranged in multiple stages in the up-down direction (stage direction) and arranged in multiple rows (in one or more embodiments, two rows) in the air flow direction (row direction). One end of each of the flat pipes 63 disposed on the leeward side in the air flow direction is connected to the first header collecting pipe 70, and the other end thereof is connected to the coupling header 90. One end of each of the flat pipes 63 disposed on the windward side in the air flow direction is connected to the second header collecting pipe 80, and the other end thereof is connected to the coupling header 90. The fins 64 partition a space between adjacent flat pipes 63 into a plurality of air flow passages through which air flows. Each of the fins 64 includes a plurality of cutouts 64*a* each of which horizontally extends long so that the flat pipes 63 can be inserted into the cutouts 64*a*. In one or more embodiments, the facing direction of the flat part 63*a* of the flat pipe 63 corresponds to the up-down direction (stage direction), and the longitudinal direction of the flat pipe 63 corresponds to the horizontal direction extending along the side face (in one or more embodiments, the right and left side faces) and the back face of the casing 40. Thus, the extending direction of the cutouts 64*a* indicates the horizontal direction (row direction) intersecting the longitudinal direction of the flat pipes 63 and also substantially coincides with the air flow direction (row direction) inside the casing 40. The cutout 64*a* extends long in the horizontal direction (row direction) so that the flat pipe 63 is inserted from the leeward side toward the windward side in the air flow direction. The shape of the cutout 64*a* of the fin 64 substantially coincides with the outer shape of the cross section of the flat pipe 63. The cutouts 64*a* of the fin 64 are formed at predetermined intervals in the up-down direction (stage direction) on the fin 64. The fin 64 includes a plurality of fin main parts 64*b* each of which is interposed between cutouts 64*a* adjacent in the up-down direction (stage direction) and a fin windward part 64*c* which extends continuously with the plurality of fin main parts 64*b* on the windward side in the air flow direction (row direction) relative to the plurality of cutouts 64*a*. The fins 64 are arranged in multiple rows (in one or more embodiments, two rows) in the direction in which air passes through the air flow passages (the air flow direction, the row direction) in a manner similar to the flat pipes 63.

In the outdoor heat exchanger 11, the flat pipes 63 are divided into a plurality of heat exchange paths 60A to 60J which are arrayed in multiple stages (in one or more embodiments, ten stages) in the up-down direction (stage direction). Further, the flat pipes 63 are arranged in multiple rows (in one or more embodiments, two rows) in the air flow direction of air passing through the air flow passages (row direction). Specifically, in one or more embodiments, the first heat exchange path 60A which is the lowermost heat exchange path, the second heat exchange path 60B, . . . , the ninth heat exchange path 60I, and the tenth heat exchange path 60J are formed in this order from bottom to top. The first heat exchange path 60A includes two stages and two rows of flat pipes 63 (four flat pipes 63 in total) including the lowermost flat pipes 63AU, 63AD. Each of the second and third heat exchange paths 60B, 60C includes twelve stages and two rows of flat pipes 63 (twenty-four flat pipes 63 in total). The fourth heat exchange path 60D includes eleven stages and two rows of flat pipes 63 (twenty-two flat pipes 63 in total). Each of the fifth and sixth heat exchange paths 60E, 60F includes ten stages and two rows of flat pipes 63 (twenty flat pipes 63 in total). The seventh heat exchange path 60G includes nine stages and two rows of flat pipes 63 (eighteen flat pipes 63 in total). The eighth heat exchange path 60H includes eight stages and two rows of flat pipes 63 (sixteen flat pipes 63 in total). The ninth heat exchange path 60I includes seven stages and two rows of flat pipes 63 (fourteen flat pipes 63 in total). The tenth heat exchange path 60J includes six stages and two rows of flat pipes 63 (twelve flat pipes 63 in total).

An internal space of the first header collecting pipe 70 is vertically partitioned by partition plates 71 so that communication spaces 72A to 72J respectively corresponding to the heat exchange paths 60A to 60J are formed. Further, the first communication space 72A corresponding to the first heat exchange path 60A is further vertically partitioned by a partition plate 73 so that a first gas-side gateway space 72AL on the lower side and a first liquid-side gateway space 72AU on the upper side are formed. In the following description, the communication spaces 72B to 72J other than the first communication space 72A are referred to as the gas-side gateway spaces 72B to 72J.

The first gas-side gateway space 72AL communicates with one end of the flat pipe 63AD which is located on the leeward side in the row direction. The flat pipe 63AD (first leeward lower side heat exchange section 61AL) is the lowermost one of the flat pipes 63 constituting the first heat exchange path 60A. The first liquid-side gateway space 72AU communicates with one end of the flat pipe 63 which is one of the flat pipes 63 constituting the first heat exchange path 60A and located on the upper side of the first leeward lower side heat exchange section 61AL (first leeward upper side heat exchange section 61AU). The second gas-side gateway space 72B communicates with one end of each of leeward twelve, in the row direction, of the flat pipes 63 constituting the second heat exchange path 60B (second leeward side heat exchange section 61B). The third gas-side gateway space 72C communicates with one end of each of leeward twelve, in the row direction, of the flat pipes 63 constituting the third heat exchange path 60C (third leeward side heat exchange section 61C). The fourth gas-side gateway space 72D communicates with one end of each of leeward eleven, in the row direction, of the flat pipes 63 constituting the fourth heat exchange path 60D (fourth leeward side heat exchange section 61D). The fifth gas-side gateway space 72E communicates with one end of each of leeward ten, in the row direction, of the flat pipes 63 constituting the fifth heat exchange path 60E (fifth leeward side heat exchange section 61E). The sixth gas-side gateway space 72F communicates with one end of each of leeward ten, in the row direction, of the flat pipes 63 constituting the sixth heat exchange path 60F (sixth leeward side heat exchange section 61F). The seventh gas-side gateway space 72G communicates with one end of each of leeward nine, in the row direction, of the flat pipes 63 constituting the seventh heat exchange path 60G (seventh leeward side heat exchange section 61G). The eighth gas-side gateway space 72H communicates with one end of each of leeward eight, in the row direction, of the flat pipes 63 constituting the eighth heat exchange path 60H (eighth leeward side heat exchange section 61H). The ninth gas-side gateway space 72I communicates with one end of each of leeward seven, in the row direction, of the flat pipes 63 constituting the ninth heat exchange path 60I (ninth leeward side heat exchange section 61I). The tenth gas-side gateway space 72J communicates with one end of each of leeward six, in the row direction, of the flat pipes 63 constituting the tenth heat exchange path 60J (tenth leeward side heat exchange section 61J).

An internal space of the second header collecting pipe 80 is vertically partitioned by partition plates 81 so that communication spaces 82A to 82J respectively corresponding to the heat exchange paths 60A to 60J are formed. In the following description, the first communication space 82A is referred to as the first vertical return space 82A, and the communication spaces 82B to 82J other than the first communication space 82A are referred to as the liquid-side gateway spaces 82B to 82J.

The lower part of the first vertical return space 82A communicates with one end of the flat pipe 63AU which is located on the windward side in the row direction. The flat pipe 63AU (first windward lower side heat exchange section 62AL) is the lowermost one of the flat pipes 63 constituting the first heat exchange path 60A. The upper part of the first vertical return space 82A communicates with one end of the flat pipe 63 which is one of the flat pipes 63 constituting the first heat exchange path 60A and located on the upper side of the first windward lower side heat exchange section 62AL (first windward upper side heat exchange section 62AU). The second liquid-side gateway space 82B communicates with one end of each of windward twelve, in the row direction, of the flat pipes 63 constituting the second heat exchange path 60B (second windward side heat exchange section 62B). The third liquid-side gateway space 82C communicates with one end of each of windward twelve, in the row direction, of the flat pipes 63 constituting the third heat exchange path 60C (third windward side heat exchange section 62C). The fourth liquid-side gateway space 82D communicates with one end of each of windward eleven, in the row direction, of the flat pipes 63 constituting the fourth heat exchange path 60D (fourth windward side heat exchange section 62D). The fifth liquid-side gateway space 82E communicates with one end of each of windward ten, in the row direction, of the flat pipes 63 constituting the fifth heat exchange path 60E (fifth windward side heat exchange section 62E). The sixth liquid-side gateway space 82F communicates with one end of each of windward ten, in the row direction, of the flat pipes 63 constituting the sixth heat exchange path 60F (sixth windward side heat exchange section 62F). The seventh liquid-side gateway space 82G communicates with one end of each of windward nine, in the row direction, of the flat pipes 63 constituting the seventh heat exchange path 60G (seventh windward side heat exchange section 62G). The eighth liquid-side gateway space 82H communicates with one end of each of windward eight, in the row direction, of the flat pipes 63 constituting the eighth heat exchange path 60H (eighth windward side heat exchange section 62H). The ninth liquid-side gateway space 82I communicates with one end of each of windward seven, in the row direction, of the flat pipes 63 constituting the ninth heat exchange path 60I (ninth windward side heat exchange section 62I). The tenth liquid-side gateway space 82J communicates with one end of each of windward six, in the row direction, of the flat pipes 63 constituting the tenth heat exchange path 60J (tenth windward side heat exchange section 62J).

An internal space of the coupling header 90 is vertically partitioned by partition plates 91 so that communication spaces 92A to 92J respectively corresponding to the heat exchange paths 60A to 60J are formed. Further, the first communication space 92A corresponding to the first heat exchange path 60A is further vertically partitioned by a partition plate 93 so that a first lower side horizontal return space 92AL on the lower side and a first upper side horizontal return space 92AU on the upper side are formed. In the following description, the communication spaces 92B to 92J other than the first communication space 92A are referred to as the horizontal return spaces 92B to 92J.

Each of the horizontal return spaces 92A to 92J communicates with the flat pipes 63 constituting the corresponding one of the heat exchange paths 60A to 60J. Specifically, the first lower side horizontal return space 92AL communicates with the other end of the flat pipe 63AU (first windward lower side heat exchange section 62AL) and the other end of the flat pipe 63AD (first leeward lower side heat exchange section 61AL). The flat pipe 63AU is located on the windward side in the row direction. The flat pipe 63AU is the lowermost one of the flat pipes 63 constituting the first heat exchange path 60A The flat pipe 63AD is located on the leeward side in the row direction. The flat pipe 63AD is the lowermost one of the flat pipes 63 constituting the first heat exchange path 60A. The first upper side horizontal return space 92AU communicates with the other end of the flat pipe 63 which is one of the flat pipes 63 constituting the first heat exchange path 60A and located on the upper side of the first windward lower side heat exchange section 62AL (first windward upper side heat exchange section 62AU) and the other end of the flat pipe 63 which is one of the flat pipes 63 constituting the first heat exchange path 60A and located on the upper side of the first leeward lower side heat exchange section 61AL (first leeward upper side heat exchange section 61AU). The second horizontal return space 92B communicates with the other end of each of windward twelve, in the row direction, of the flat pipes 63 constituting the second heat exchange path 60B (second windward side heat exchange section 62B) and the other end of each of leeward twelve, in the row direction, of the flat pipes 63 constituting the second heat exchange path 60B (second leeward side heat exchange section 61B). The third horizontal return space 92C communicates with the other end of each of windward twelve, in the row direction, of the flat pipes 63 constituting the third heat exchange path 60C (third windward side heat exchange section 62C) and the other end of each of leeward twelve, in the row direction, of the flat pipes 63 constituting the third heat exchange path 60C (third leeward side heat exchange section 61C). The fourth horizontal return space 92D communicates with the other end of each of windward eleven, in the row direction, of the flat pipes 63 constituting the fourth heat exchange path 60D (fourth windward side heat exchange section 62D) and the other end of each of leeward eleven, in the row direction, of the flat pipes 63 constituting the fourth heat exchange path 60D (fourth leeward side heat exchange section 61D). The fifth horizontal return space 92E communicates with the other end of each of windward ten, in the row direction, of the flat pipes 63 constituting the fifth heat exchange path 60E (fifth windward side heat exchange section 62E) and the other end of each of leeward ten, in the row direction, of the flat pipes 63 constituting the fifth heat exchange path 60E (fifth leeward side heat exchange section 61E). The sixth horizontal return space 92F communicates with the other end of each of windward ten, in the row direction, of the flat pipes 63 constituting the sixth heat exchange path 60F (sixth windward side heat exchange section 62F) and the other end of each of leeward ten, in the row direction, of the flat pipes 63 constituting the sixth heat exchange path 60F (sixth leeward side heat exchange section 61F). The seventh horizontal return space 92G communicates with the other end of each of windward nine, in the row direction, of the flat pipes 63 constituting the seventh heat exchange path 60G (seventh windward side heat exchange section 62G) and the other end of each of leeward nine, in the row direction, of the flat pipes 63 constituting the seventh heat exchange path 60G (seventh leeward side heat exchange section 61G). The eighth horizontal return space 92H communicates with the other end of each of windward eight, in the row direction, of the flat pipes 63 constituting the eighth heat exchange path 60H (eighth windward side heat exchange section 62H) and the other end of each of leeward eight, in the row direction, of the flat pipes 63 constituting the eighth heat exchange path 60H (eighth leeward side heat exchange section 61H). The ninth horizontal return space 92I communicates with the other end of each of windward seven, in the row direction, of the flat pipes 63 constituting the ninth heat exchange path 60I (ninth windward side heat exchange section 62I) and the other end of each of leeward seven, in the row direction, of the flat pipes 63 constituting the ninth heat exchange path 60I (ninth leeward side heat exchange section 61I). The tenth horizontal return space 92J communicates with the other end of each of windward six, in the row direction, of the flat pipes 63 constituting the tenth heat exchange path 60J (tenth windward side heat exchange section 62J) and the other end of each of leeward six, in the row direction, of the flat pipes 63 constituting the tenth heat exchange path 60J (tenth leeward side heat exchange section 61J). In one or more embodiments, the partition plates 91, 93 are disposed so that the flat pipes 63 adjacent in the row direction communicate with each other at the other end. Accordingly, the horizontal return spaces 92A to 92J are formed so that the flat pipes 63 adjacent in the row direction communicate with each other at the other end. However, the present disclosure is not limited thereto. The partition plates 91, 93 may not be disposed inside each of the heat exchange sections 61A to 61J, 62A to 62J so that the horizontal return spaces 92A to 92J are formed between the heat exchange sections 61A to 61J and 62A to 62J adjacent in the row direction.

Further, a liquid-side flow dividing member 85 which divides and feeds the refrigerant fed from the outdoor expansion valve 12 (refer to FIG. 1) into the liquid-side gateway spaces 72AU, 82B to 82J in the heating operation and a gas-side flow dividing member 75 which divides and feeds the refrigerant fed from the compressor 8 (refer to FIG. 1) into the gas-side gateway spaces 72AL, 72B to 72J in the cooling operation are connected to the first header collecting pipe 70 and the second header collecting pipe 80.

The liquid-side flow dividing member 85 includes a liquid-side refrigerant flow divider 86 which is connected to the refrigerant pipe 20 (refer to FIG. 1) and liquid-side refrigerant flow dividing pipes 87A to 87F which extend from the liquid-side refrigerant flow divider 86 and are connected to the liquid-side gateway spaces 72AU, 82B to 82J, respectively. Each of the liquid-side refrigerant flow dividing pipes 87A to 87F includes a capillary tube and has a length corresponding to a flow dividing ratio to each of the heat exchange paths 60A to 60J.

The gas-side flow dividing member 75 includes a gas-side refrigerant flow dividing header pipe 76 which is connected to the refrigerant pipe 19 (refer to FIG. 1) and gas-side refrigerant flow dividing branch pipes 77A to 77J which extend from the gas-side refrigerant flow dividing header pipe 76 and are connected to the gas-side gateway spaces 72AL, 72B to 72J, respectively.

Accordingly, the heat exchange paths 60B to 60J other than the first heat exchange path 60A include the windward side heat exchange sections 62B to 62J on the windward side in the row direction and the leeward side heat exchange sections 61B to 61J which are connected in series to the windward side heat exchange sections 62B to 62J on the leeward side of the windward side heat exchange sections 62B to 62J. More specifically, the second heat exchange path 60B has a configuration in which the twelve flat pipes 63 constituting the second leeward side heat exchange section 61B which communicates with the second gas-side gateway space 72B and the twelve flat pipes 63 constituting the second windward side heat exchange section 62B which is located on the windward side of the second leeward side heat exchange section 61B and communicates with the second liquid-side gateway space 82B are connected in series through the second horizontal return space 92B. The third heat exchange path 60C has a configuration in which the twelve flat pipes 63 constituting the third leeward side heat exchange section 61C which communicates with the third gas-side gateway space 72C and the twelve flat pipes 63 constituting the third windward side heat exchange section 62C which is located on the windward side of the third leeward side heat exchange section 61C and communicates with the third liquid-side gateway space 82C are connected in series through the third horizontal return space 92C. The fourth heat exchange path 60D has a configuration in which the eleven flat pipes 63 constituting the fourth leeward side heat exchange section 61D which communicates with the fourth gas-side gateway space 72D and the eleven flat pipes 63 constituting the fourth windward side heat exchange section 62D which is located on the windward side of the fourth leeward side heat exchange section 61D and communicates with the fourth liquid-side gateway space 82D are connected in series through the fourth horizontal return space 92D. The fifth heat exchange path 60E has a configuration in which the ten flat pipes 63 constituting the fifth leeward side heat exchange section 61E which communicates with the fifth gas-side gateway space 72E and the ten flat pipes 63 constituting the fifth windward side heat exchange section 62E which is located on the windward side of the fifth leeward side heat exchange section 61E and communicates with the fifth liquid-side gateway space 82E are connected in series through the fifth horizontal return space 92E. The sixth heat exchange path 60F has a configuration in which the ten flat pipes 63 constituting the sixth leeward side heat exchange section 61F which communicates with the sixth gas-side gateway space 72F and the ten flat pipes 63 constituting the sixth windward side heat exchange section 62F which is located on the windward side of the sixth leeward side heat exchange section 61F and communicates with the sixth liquid-side gateway space 82F are connected in series through the sixth horizontal return space 92E The seventh heat exchange path 60G has a configuration in which the nine flat pipes 63 constituting the seventh leeward side heat exchange section 61G which communicates with the seventh gas-side gateway space 72G and the nine flat pipes 63 constituting the seventh windward side heat exchange section 62G which is located on the windward side of the seventh leeward side heat exchange section 61G and communicates with the seventh liquid-side gateway space 82G are connected in series through the seventh horizontal return space 92G. The eighth heat exchange path 60H has a configuration in which the eight flat pipes 63 constituting the eighth leeward side heat exchange section 61H which communicates with the eighth gas-side gateway space 72H and the eight flat pipes 63 constituting the eighth windward side heat exchange section 62H which is located on the windward side of the eighth leeward side heat exchange section 61H and communicates with the eighth liquid-side gateway space 82H are connected in series through the eighth horizontal return space 92H. The ninth heat exchange path 60I has a configuration in which the seven flat pipes 63 constituting the ninth leeward side heat exchange section 61I which communicates with the ninth gas-side gateway space 72I and the seven flat pipes 63 constituting the ninth windward side heat exchange section 62I which is located on the windward side of the ninth leeward side heat exchange section 61I and communicates with the ninth liquid-side gateway space 82I are connected in series through the ninth horizontal return space 92I. The tenth heat exchange path 60J has a configuration in which the six flat pipes 63 constituting the tenth leeward side heat exchange section 61J which communicates with the tenth gas-side gateway space 72J and the six flat pipes 63 constituting the tenth windward side heat exchange section 62J which is located on the windward side of the tenth leeward side heat exchange section 61J and communicates with the tenth liquid-side gateway space 82J are connected in series through the tenth horizontal return space 92J. The first heat exchange path 60A includes the first windward lower side heat exchange section 62AL which is located on the windward side in the row direction and includes the lowermost flat pipe 63AU, the first windward upper side heat exchange section 62AU which is located on the upper side of the first windward lower side heat exchange section 62AL, the first leeward lower side heat exchange section 61AL which is located on the leeward side of the windward side heat exchange sections 62AL, 62AU and includes the lowermost flat pipe 63AD, and the first leeward upper side heat exchange section 61AU which is located on the upper side of the first leeward lower side heat exchange section 61AL. More specifically, the first heat exchange path 60A has a configuration in which the lowermost flat pipe 63AD constituting the first leeward lower side heat exchange section 61AL which communicates with the first gas-side gateway space 72AL, the lowermost flat pipe 63AU constituting the first windward lower side heat exchange section 62AL which is located on the windward side of the first leeward lower side heat exchange section 61AL, the flat pipe 63 constituting the first windward upper side heat exchange section 62AU which is located on the upper side of the first windward lower side heat exchange section 62AL, and the flat pipe 63 constituting the first leeward upper side heat exchange section 61AU which communicates with the first liquid-side gateway space 72AU are connected in series in order. In one or more embodiments, the lowermost flat pipe 63AD constituting the first leeward lower side heat exchange section 61AL which communicates with the first gas-side gateway space 72AL is connected in series to the lowermost flat pipe 63AU constituting the first windward lower side heat exchange section 62AL through the first lower side horizontal return space 92AL. The lowermost flat pipe 63AU constituting the first windward lower side heat exchange section 62AL is connected in series to the flat pipe 63 constituting the first windward upper side heat exchange section 62AU through the first vertical return space 82A. The flat pipe 63 constituting the first windward upper side heat exchange section 62AU is connected in series to the flat pipe 63 constituting the first leeward upper side heat exchange section 61AU through the first upper side horizontal return space 92AU.

<Operation (Flow of Refrigerant)>

Next, the flow of the refrigerant in the outdoor heat exchanger 11 having the above configuration will be described.

In the cooling operation, the outdoor heat exchanger 11 functions as a radiator for the refrigerant discharged from the compressor 8 (refer to FIG. 1). In the cooling operation, the refrigerant flows in a direction opposite to the direction indicated by arrows showing the refrigerant flows in FIGS. 4, 6, 7, and 9.

The refrigerant discharged from the compressor 8 (refer to FIG. 1) is fed to the gas-side flow dividing member 75 through the refrigerant pipe 19 (refer to FIG. 1). The refrigerant fed to the gas-side flow dividing member 75 is divided into the gas-side refrigerant flow dividing branch pipes 77A to 77J from the gas-side refrigerant flow dividing header pipe 76 and fed to the gas-side gateway spaces 72AL, 72B to 72J of the first header collecting pipe 70.

The refrigerant fed to each of the gas-side gateway spaces 72B to 72J other than the first gas-side gateway space 72AL is divided into the flat pipes 63 constituting the corresponding one of the leeward side heat exchange sections 61B to 61J of the heat exchange paths 60B to 60J. The refrigerant fed to the flat pipes 63 radiates heat by heat exchange with outdoor air while flowing through the passages 63*b*, and is fed to these flat pipes 63 constituting each of the windward side heat exchange sections 62B to 62J of the heat exchange paths 60B to 60J through the corresponding one of the horizontal return spaces 92B to 92J of the coupling header 90. The refrigerant fed to these flat pipes 63 further radiates heat by heat exchange with outdoor air while passing through the passages 63*b*, and flows of the refrigerant merge with each other in each of the liquid-side gateway spaces 82B to 82J of the second header collecting pipe 80. That is, the refrigerant passes through the heat exchange paths 60B to 60J in the order from the leeward side heat exchange sections 61B to 61J to the windward side heat exchange sections 62B to 62J. At this time, the refrigerant radiates heat until the refrigerant becomes a saturated liquid state or a subcooled liquid state from a superheated gas state.

The refrigerant fed to the first gas-side gateway space 72AL is fed to the flat pipe 63 (lowermost flat pipe 63AD) constituting the first leeward lower side heat exchange section 61AL of the first heat exchange path 60A. The refrigerant fed to this flat pipe 63 radiates heat by heat exchange with outdoor air while flowing through the passage 63*b*, and is fed to the flat pipe 63 (lowermost flat pipe 63AD) constituting the first windward lower side heat exchange section 62AL of the first heat exchange path 60A through the first lower side horizontal return space 92AL of the coupling header 90. The refrigerant fed to this flat pipe 63 further radiates heat by heat exchange with outdoor air while flowing through the passage 63*b*, and is fed to the flat pipe 63 constituting the first windward upper side heat exchange section 62AU of the first heat exchange path 60A through the first vertical return space 82A of the second header collecting pipe 80. The refrigerant fed to this flat pipe 63 further radiates heat by heat exchange with outdoor air while flowing through the passage 63*b*, and is fed to the flat pipe 63 constituting the first leeward upper side heat exchange section 61AU of the first heat exchange path 60A through the first upper side horizontal return space 92AU of the coupling header 90. The refrigerant fed to this flat pipe 63 further radiates heat by heat exchange with outdoor air while flowing through the passage 63*b*, and is fed to the first liquid-side gateway space 72AU of the first header collecting pipe 70. That is, the refrigerant passes through the first heat exchange path 60A in the order of the first leeward lower side heat exchange section 61AL, the first windward lower side heat exchange section 62AL, the first windward upper side heat exchange section 62AU, and the first leeward upper side heat exchange section 61AU. At this time, the refrigerant radiates heat until the refrigerant becomes a saturated liquid state or a subcooled liquid state from a superheated gas state.

The refrigerant fed to the liquid-side gateway spaces 72AU, 82B to 82J is fed to the liquid-side refrigerant flow dividing pipes 87A to 87J of the liquid-side refrigerant flow dividing member 85, and flows of the refrigerant merge with each other in the liquid-side refrigerant flow divider 86. The refrigerant merged in the liquid-side refrigerant flow divider 86 is fed to the outdoor expansion valve 12 (refer to FIG. 1) through the refrigerant pipe 20 (refer to FIG. 1).

In the heating operation, the outdoor heat exchanger 11 functions as an evaporator for the refrigerant decompressed by the outdoor expansion valve 12 (refer to FIG. 1). In the heating operation, the refrigerant flows in the direction indicated by the arrows showing the refrigerant flows in FIGS. 4, 6, 7, and 9.

The refrigerant decompressed in the outdoor expansion valve 12 is fed to the liquid-side refrigerant flow dividing member 85 through the refrigerant pipe 20 (refer to FIG. 1). The refrigerant fed to the liquid-side refrigerant flow dividing member 85 is divided into the liquid-side refrigerant flow dividing pipes 87A to 87F from the liquid-side refrigerant flow divider 86 and fed to the liquid-side gateway spaces 72AU, 82B to 82J of the first and second header collecting pipes 70, 80.

The refrigerant fed to each of the liquid-side gateway spaces 82B to 82J other than the first liquid-side gateway space 72AU is divided into the flat pipes 63 constituting the corresponding one of the windward side heat exchange sections 62B to 62J of the heat exchange paths 60B to 60J. The refrigerant fed to these flat pipes 63 is heated by heat exchange with outdoor air while flowing through the passages 63*b* and fed to these flat pipes 63 constituting each of the leeward side heat exchange sections 62B to 62J of the heat exchange paths 60B to 60J through the corresponding one of the horizontal return spaces 92B to 92J of the coupling header 90. The refrigerant fed to these flat pipes 63 is further heated by heat exchange with outdoor air while flowing through the passages 63*b*, and flows of the refrigerant merge with each other in each of the gas-side gateway spaces 72B to 72J of the first header collecting pipe 70. That is, the refrigerant passes through the heat exchange paths 60B to 60J in the order from the windward side heat exchange sections 62B to 62J to the leeward side heat exchange sections 61B to 61J. At this time, the refrigerant is heated until the refrigerant becomes a superheated gas state from a liquid state or a gas-liquid two-phase state by evaporation.

The refrigerant fed to the first liquid-side gateway space 72AU is fed to the flat pipe 63 constituting the first leeward upper side heat exchange section 61AU of the first heat exchange path 60A. The refrigerant fed to this flat pipe 63 is heated by heat exchange with outdoor air while flowing through the passage 63*b* and fed to the flat pipe 63 constituting the first windward upper side heat exchange section 62AU of the first heat exchange path 60A through the first upper side horizontal return space 92AU of the coupling header 90. The refrigerant fed to this flat pipe 63 is further heated by heat exchange with outdoor air while flowing through the passage 63*b* and fed to the flat pipe 63 (lowermost flat pipe 63AU) constituting the first windward lower side heat exchange section 62AL of the first heat exchange path 60A through the first vertical return space 82A of the second header collecting pipe 80. The refrigerant fed to this flat pipe 63 is further heated by heat exchange with outdoor air while flowing through the passage 63*b* and fed to the flat pipe 63 (lowermost flat pipe 63AD) constituting the first leeward lower side heat exchange section 61AL of the first heat exchange path 60A through the first lower side horizontal return space 92AL of the coupling header 90. The refrigerant fed to this flat pipe 63 is further heated by heat exchange with outdoor air while flowing through the passage 63*b* and fed to the first gas-side gateway space 72AL of the first header collecting pipe 70. That is, the refrigerant passes through the first heat exchange path 60A in the order of the first leeward upper side heat exchange section 61AU, the first windward upper side heat exchange section 62AU, the first windward lower side heat exchange section 62AL, and the first leeward lower side heat exchange section 61AL. At this time, the refrigerant is heated until the refrigerant becomes a superheated gas state from a liquid state or a gas-liquid two-phase state by evaporation.

The refrigerant fed to the gas-side gateway spaces 72AL, 72B to 72J is fed to the gas-side refrigerant flow dividing branch pipes 77A to 77J of the gas-side refrigerant flow dividing member 75, and flows of the refrigerant merge with each other in the gas-side refrigerant flow dividing header pipe 76. The refrigerant merged in the gas-side refrigerant flow dividing header pipe 76 is fed to the suction side of the compressor 8 (refer to FIG. 1) through the refrigerant pipe 19 (refer to FIG. 1).

In the defrosting operation, the outdoor heat exchanger 11 functions as a radiator for the refrigerant discharged from the compressor 8 (refer to FIG. 1) in a manner similar to the cooling operation. The flow of the refrigerant in the outdoor heat exchanger 11 in the defrosting operation is similar to that in the cooling operation. Thus, description thereof will be omitted. However, differently from the cooling operation, the refrigerant mainly radiates heat while melting frost adhered to the heat exchange paths 60A to 60J in the defrosting operation.

<Characteristics>

The outdoor heat exchanger 11 (heat exchanger) according to one or more embodiments and the air conditioning apparatus 1 including the outdoor heat exchanger 11 have characteristics as described below.

A

As described above, the heat exchanger 11 according to one or more embodiments includes the plurality of flat pipes 63 vertically arrayed, each of the flat pipes 63 including the passage for the refrigerant formed inside thereof, and the plurality of fins 64 which partition the space between adjacent flat pipes 63 into the air flow passages through which air flows. The flat pipes 63 are divided into the plurality of (ten in one or more embodiments) heat exchange paths 60A to 60J arrayed in multiple stages in the stage direction. Further, when the length of the passage 63*b* from one end to the other end of the flow of the refrigerant in each of the heat exchange paths 60A to 60J is defined as the path effective length LA to LJ, the path effective length LA of the first heat exchange path 60A including the lowermost flat pipes 63AU, 63AD is longer than the path effective length LB to LJ of each of the other heat exchange paths 60B to 60J. Specifically, in the second to tenth heat exchange paths 60B to 60J, the flat pipes 63 constituting the windward side heat exchange sections 62B to 62J and the flat pipes 63 constituting the leeward side heat exchange sections 61B to 61J are connected in series from the liquid-side gateway spaces 82B to 82J as one end of the flow of the refrigerant to the gas-side gateway spaces 72B to 72J as the other end of the flow of the refrigerant. Thus, the path effective length LB to LJ of each of the second to tenth heat exchange paths 60B to 60J is the sum of the length of the passage 63*b* of the flat pipe 63 of each of the windward side heat exchange sections 62B to 62J and the length of the passage 63*b* of the flat pipe 63 of each of the leeward side heat exchange sections 61B to 61J (the total length of the passages 63*b* of two flat pipes). In the first heat exchange path 60A, the flat pipe 63 constituting the first leeward upper side heat exchange section 61AU, the flat pipe 63 constituting the first windward upper side heat exchange section 62AU, the lowermost flat pipe 63AU constituting the first windward lower side heat exchange section 62AL, and the lowermost flat pipe 63AD constituting the first leeward lower side heat exchange section 61AL are connected in series from the first liquid-side gateway space 72AU as one end of the flow of the refrigerant to the first gas-side gateway space 72AL as the other end of the flow of the refrigerant. Thus, the path effective length LA of the first heat exchange path 60A is the sum of the length of the passage 63*b* of the flat pipe 63 of the first leeward upper side heat exchange section 61AU, the length of the passage 63*b* of the flat pipe 63 of the first windward upper side heat exchange section 62AU, the length of the passage 63*b* of the lowermost flat pipe 63AU of the first windward lower side heat exchange section 62AL, and the length of the passage 63*b* of the lowermost flat pipe 63AD of the first leeward lower side heat exchange section 61AL (the total length of the passages 63*b* of four flat pipes). In this manner, the path effective length LA of the first heat exchange path 60A is longer than the path effective length LB to LJ of each of the other heat exchange paths 60B to 60J.

On the other hand, in the conventional heat exchanger, the same number of flat pipes having the same shape (in the pipe length, and the size and the number of through holes each serving as the refrigerant passage) are connected in series in each heat exchange path. That is, in the conventional heat exchanger described above, the path effective length is equal between the heat exchange paths. When the conventional heat exchanger having such a configuration is employed in the air conditioning apparatus that performs the heating operation (when the heat exchanger is used as the evaporator for the refrigerant) and the defrosting operation (when the heat exchanger is used as the radiator for the refrigerant) in a switching manner, the amount of frost formation in the lowermost heat exchange path tends to increase in the heating operation. First, the reason thereof will be described.

In the conventional configuration, in the heating operation, the refrigerant in a liquid state tends to flow into the lowermost heat exchange path including the lowermost flat pipe, and flows out of the lowermost heat exchange path with the temperature of the refrigerant not sufficiently raised. As a result, the amount of frost formation in the lowermost heat exchange path tends to increase. That is, it is estimated that, in the configuration of the conventional heat exchanger, the reason why the amount of frost formation in the lowermost heat exchange path tends to increase is that, in the heating operation, the refrigerant in a liquid state tends to flow into the lowermost heat exchange path, and flows out of the lowermost heat exchange path with the temperature of the refrigerant not sufficiently raised.

Thus, in one or more embodiments, differently from the conventional heat exchanger, the path effective length LA of the lowermost first heat exchange path 60A including the lowermost flat pipes 63AU, 63AD is longer than the path effective length LB to LJ of each of the other heat exchange paths 60B to 60J as described above.

When the heat exchanger 11 having such a configuration is employed in the air conditioning apparatus 1 which performs the heating operation and the defrosting operation in a switching manner, a flow resistance of the refrigerant in the first heat exchange path 60A can be increased by the long path effective length LA of the first heat exchange path 60A. Thus, the refrigerant in a liquid state becomes less likely to flow into the first heat exchange path 60A in the heating operation, which facilitates raising the temperature of the refrigerant flowing through the lowermost heat exchange path 60A. Accordingly, it is possible to reduce frost formation in the first heat exchange path 60A. Further, in one or more embodiments, a heat transfer area in the first heat exchange path 60A can be increased by the long path effective length LA of the first heat exchange path 60A. Thus, it is possible to accelerate a temperature rise in the refrigerant flowing through the lowermost heat exchange path 60A. As a result, unmelted frost in the first heat exchange path 60A in the defrosting operation can be reduced as compared to the case where the conventional heat exchanger is employed.

In this manner, in one or more embodiments, it is possible to reduce frost formation in the lowermost heat exchange path 60A to reduce unmelted frost in the defrosting operation by employing the heat exchanger 11 having the above configuration in the air conditioning apparatus 1 which performs the heating operation and the defrosting operation in a switching manner.

B

In the heat exchanger 11 according to one or more embodiments, the path effective length LA of the first heat exchange path 60A is twice the path effective length LB to LJ of each of the other heat exchange paths 60B to 60J. Thus, the path effective length LA of the first heat exchange path 60A is sufficiently long. Therefore, it is possible to sufficiently increase the flow resistance of the refrigerant and the heat transfer area in the first heat exchange path 60A to increase the effect of reducing frost formation in the lowermost heat exchange path 60A.

The path effective length LA of the first heat exchange path 60A is not limited to twice the path effective length LB to LJ of each of the other heat exchange paths 60B to 60J. The path effective length LA of the first heat exchange path 60A may be equal to or longer than twice the path effective length LB to LJ of each of the other heat exchange paths 60B to 60J. For example, heat exchange sections (flat pipes) of the first heat exchange path 60A may be further provided on the upper side and connected in series so that the path effective length LA of the first heat exchange path 60A is set to the total length of passages 63*b* of six flat pipes.

C

As described above, in the heat exchanger 11 according to one or more embodiments, the first heat exchange path 60A includes the first lower side heat exchange sections 62AL, 61AL including the lowermost flat pipes 63AU, 63AD and the first upper side heat exchange sections 62AU, 61AU which are connected in series to the first lower side heat exchange sections 62AL, 61AL on the upper side of the first lower side heat exchange sections 62AL, 61AL. In particular, in one or more embodiments, the flat pipes 63 are arranged in multiple rows (two rows) in the row direction which is the air flow direction of air passing through the air flow passages. The heat exchange paths 60B to 60J other than the first heat exchange path 60A respectively include the windward side heat exchange sections 62B to 62J on the windward side in the row direction and the leeward side heat exchange sections 61B to 61J which are connected in series to the windward side heat exchange sections 62B to 62J on the leeward side of the windward side heat exchange sections 62B to 62J. The first heat exchange path 60A includes the first windward lower side heat exchange section 62AL including the lowermost flat pipe 63AU and located on the windward side in the row direction, the first windward upper side heat exchange section 62AU on the upper side of the first windward lower side heat exchange section 62AL, the first leeward lower side heat exchange section 61AL including the lowermost flat pipe 63AD and located on the leeward side of the windward side heat exchange sections 62AL, 62AU, and the first leeward upper side heat exchange section 61AU on the upper side of the first leeward lower side heat exchange section 61AL. Further, the first windward lower side heat exchange section 62AL, the first windward upper side heat exchange section 62AU, the first leeward lower side heat exchange section 61AL, and the first leeward upper side heat exchange section 61AU are connected in series.

Thus, in one or more embodiments, the path effective length LA of the first heat exchange path 60A can be made longer than each path effective length LB to LJ of the other heat exchange paths 60B to 60J having no serial connection between the upper side and the lower side. In particular, in one or more embodiments, the heat exchange paths 60B to 60J other than the first heat exchange path 60A have the configuration in which the windward side heat exchange sections 62B to 62J and the leeward side heat exchange sections 61B to 61J are connected in series, and the first heat exchange path 60A has the configuration in which the first windward lower side heat exchange section 62AL, the first windward upper side heat exchange section 62AU, the first leeward lower side heat exchange section 61AL, and the first leeward upper side heat exchange section 61AU are connected in series. Accordingly, it is possible to increase the path effective length LA of the first heat exchange path 60A.

D

As described above, in the heat exchanger 11 according to one or more embodiments, each heat exchange path 60A to 60J includes the heat exchange section 61A to 61J, and the heat exchange section 62A to 62J which are connected in series, and the number of heat exchange sections 61AL, 61AU, 62AL, 61AU constituting the first heat exchange path 60A (four) is larger than the number of heat exchange sections 61B to 61J, 62B to 62J respectively constituting the other heat exchange paths 60B to 60J (two in each path). Thus, it is possible to make the path effective length LA of the first heat exchange path 60A longer than the path effective length LB to LJ of each of the other heat exchange paths 60B to 60J.

E

When the heat exchanger 11 according to one or more embodiments is used as the radiator for the refrigerant, among the first lower side heat exchange sections 62AL, 61AL and the first upper side heat exchange sections 62AU, 61AU, the first leeward lower side heat exchange section 61AL, which is one of the first lower side heat exchange sections, serves as the entrance of the first heat exchange path 60A. In particular, in one or more embodiments, when the heat exchanger 11 is used as the radiator for the refrigerant, among the first windward lower side heat exchange section 62AL, the first windward upper side heat exchange section 62AU, the first leeward lower side heat exchange section 61AL, and the first leeward upper side heat exchange section 61AU, the first leeward lower side heat exchange section 61AL serves as the entrance of the first heat exchange path 60A.

As described above, in the configuration of the first heat exchange path 60A in which the first upper side heat exchange sections 62AL, 61AL and the first lower side heat exchange sections 62AU, 61AU are connected in series, when the operation is switched from the heating operation to the defrosting operation, the refrigerant in a liquid state tends to be accumulated in the first lower side heat exchange sections 62AU, 61AU including the lowermost flat pipes 63AU, 63AD.

Thus, in one or more embodiments, as described above, when the heat exchanger 11 is used as the radiator for the refrigerant, among the first lower side heat exchange sections 62AL, 61AL and the first upper side heat exchange sections 62AU, 61AU which constitute the first heat exchange path 60A, the first leeward lower side heat exchange section 61AL, which is one of the first lower side heat exchange sections and includes the lowermost flat pipe (in one or more embodiments, the lowermost flat pipe 63AD), serves as the entrance of the first heat exchange path 60A.

Accordingly, in the defrosting operation, when the refrigerant in a gas state is introduced into the first heat exchange path 60A, the refrigerant in a gas state flows into the first lower side heat exchange section (in one or more embodiments, the first leeward lower side heat exchange section 61AL). That is, in one or more embodiments, in the defrosting operation, the first lower side heat exchange section including the lowermost flat pipe (in one or more embodiments, the first leeward lower side heat exchange section 61AL including the lowermost flat pipe 63AD) is located on the upstream side in the flow of the refrigerant. Thus, in one or more embodiments, among the first lower side heat exchange sections 62AL, 61AL and the first upper side heat exchange sections 62AU, 61AU which constitute the first heat exchange path 60A, the refrigerant in a gas state is introduced into the first lower side heat exchange section including the lowermost flat pipe (in one or more embodiments, the first leeward lower side heat exchange section 61AL including the lowermost flat pipe 63AD) to actively heat and evaporate the refrigerant in a liquid state accumulated in the lowermost first lower side heat exchange section (in one or more embodiments, the first leeward lower side heat exchange section 61AL). Accordingly, the temperature of the lowermost first heat exchange path 60A can be promptly raised. As a result, in one or more embodiments, it is possible to further reduce unmelted frost in the first heat exchange path 60A in the defrosting operation.

F

As described above, in the heat exchanger 11 according to one or more embodiments, the heat exchange paths 60B to 60J other than the first heat exchange path 60A are configured so that, when the heat exchanger 11 is used as the evaporator for the refrigerant, the refrigerant flows through the liquid-side gateway spaces 82B to 82J formed in the second header collecting pipe 80, the windward side heat exchange sections 62B to 62J, the horizontal return spaces 92B to 92J formed in the coupling header 90, the leeward side heat exchange sections 62B to 62J, and the gas-side gateway spaces 72B to 72J formed in the first header collecting pipe 70 in this order. Further, the first heat exchange path 60A is configured so that, when the heat exchanger 11 is used as the evaporator for the refrigerant, the refrigerant flows through the first liquid-side gateway space 72AU formed in the first header collecting pipe 70, the first leeward upper side heat exchange section 61AU, the first upper side horizontal return space 92AU formed in the coupling header 90, the first windward upper side heat exchange section 62AU, the first vertical return space 82A formed in the second header collecting pipe 80, the first windward lower side heat exchange section 62AL, the first lower side horizontal return space 92AL formed in the coupling header 90, the first leeward lower side heat exchange section 61AL, and the first gas-side gateway space 72AL formed in the first header collecting pipe 70 in this order.

In one or more embodiments, as described above, the gas-refrigerant side entrances of the heat exchange paths 60A to 60J are all disposed on the heat exchange sections 61AL, 61B to 61J on the leeward side. Thus, all the gas-side gateway spaces 72AL, 72B to 72J can be collectively formed in the first header collecting pipe 70.

Further, in one or more embodiments, the return direction of all the heat exchange paths 60A to 60J in the coupling header 90 is the horizontal direction as described above. Thus, the internal space of the coupling header 90 can be configured to have a simple structure merely vertically partitioned in each stage.

Further, in one or more embodiments, as described above, when the heat exchanger 11 is used as the evaporator for the refrigerant, among the first heat exchange sections 61AU, 62AU, 62AL, 61AL constituting the lowermost first heat exchange path 60A, the first lower side heat exchange sections 62AL, 61AL located on the upstream side in the flow of the refrigerant are disposed separately from the second heat exchange sections 61B, 62B constituting the second heat exchange path 60B located on the upper side of the first heat exchange path 60A. Thus, a heat loss between the first heat exchange path 60A and the second heat exchange path 60B can be reduced. Accordingly, it is possible to prevent the interruption of a temperature rise in the refrigerant flowing through the lowermost heat exchange path 60A, thereby contributing to reducing frost formation in the first heat exchange path 60A.

G

As described above, in the heat exchanger 11 according to one or more embodiments, the number of flat pipes 63 constituting the first heat exchange path 60A is smaller than the number of flat pipes 63 constituting each of the other heat exchange paths 60B to 60J.

When the configuration in which the number of flat pipes 63 constituting the first heat exchange path 60A is smaller than the number of flat pipes 63 constituting each of the other heat exchange paths 60B to 60J is employed, a drift tends to occur when the refrigerant is divided and introduced into the heat exchange paths 60A to 60J.

However, in one or more embodiments, as described above, the configuration in which the path effective length LA of the first heat exchange path 60A is longer than the path effective length LB to LJ of each of the other heat exchange paths 60B to 60J is employed to increase the flow resistance of the refrigerant in the first heat exchange path 60A. Thus, it is possible to reduce the occurrence of a drift when the refrigerant is divided and introduced into the heat exchange paths 60A to 60J.

Further, in one or more embodiments, in the heat exchange paths 60B to 60J other than the first heat exchange path 60A, the number of flat pipes 63 of the heat exchange section corresponding to a part where the velocity of air obtained by the outdoor fan 15 (fan) is low is larger than the number of flat pipes 63 of the heat exchange section corresponding to a part where the velocity of air obtained by the outdoor fan 15 (fan) is high. This is because, in a heat exchanger which exchanges heat between a refrigerant and air, the heat exchange efficiency is higher in a part where the velocity of air is higher and the heat exchange efficiency is lower in a part where the velocity of air is lower. Specifically, the number of flat pipes 63 constituting the ninth heat exchange path 60I (fourteen in total in seven stages and two rows) where the velocity of air is lower than that in the tenth heat exchange section 60J is larger than the number of flat pipes 63 constituting the tenth heat exchange path 60J (twelve in total in six stages and two rows) where the velocity of air is highest. In this manner, the heat exchange path on the lower side where the velocity of air is lower has a larger number of flat pipes 63 constituting the heat exchange path.

Thus, in one or more embodiments, in the most part of the heat exchanger 11 (the heat exchange paths 60B to 60J other than the lowermost first heat exchange path 60A), the heat exchange path on the lower side where the velocity of air is lower has a larger number of flat pipes 63 constituting the heat exchange path so as to correspond to the relationship between the air velocity distribution and the heat exchange efficiency. Further, in the lowermost first heat exchange path 60A including the lowermost flat pipes 63AU, 63AD, the path effective length LA is increased and the number of flat pipes 63 is reduced taking into consideration the amount of frost formation and unmelted frost differently from the other heat exchange paths 60B to 60J.

H

As described above, in the heat exchanger 11 according to one or more embodiments, each of the fins 64 includes the plurality of cutouts 64*a* into which the flat pipes 63 are inserted, the cutouts 64*a* extending from the leeward side toward the windward side in the air flow direction of air passing through the air flow passages, the plurality of fin main parts 64*b* each of which is interposed between adjacent cutouts 64*a*, and the fin windward part 64*c* which extends continuously with the plurality of fin main parts 64*b* on the windward side in the air flow direction relative to the cutouts 64*a*.

In the heat exchanger 11 having such a fin configuration, the amount of frost adhered to the fin windward part 64*c* tends to increase in the defrosting operation. Thus, unmelted frost in the lowermost first heat exchange path 60A may increase in the defrosting operation.

However, as described above, one or more embodiments employ the configuration in which the path effective length LA of the first heat exchange path 60A is longer than the path effective length LB to LJ of each of the other heat exchange paths 60B to 60J. Thus, it is possible to reduce frost formation in the lowermost heat exchange path 60A including frost adhered to the fin windward part 64*c* to reduce unmelted frost in the defrosting operation.

<Modifications>

A

In the outdoor heat exchanger 11 (heat exchanger) according to one or more embodiments, the first heat exchange path 60A has the configuration in which the first heat exchange sections are connected in series so that, when the heat exchanger 11 is used as the evaporator for the refrigerant, the refrigerant flows through the first leeward upper side heat exchange section 61AU, the first windward upper side heat exchange section 62AU, the first windward lower side heat exchange section 62AL, and the first leeward lower side heat exchange section 61AL in this order (refer to FIGS. 4 to 9).

However, the connection configuration between the first heat exchange sections 61AU, 61AL, 62AU, 62AL is not limited thereto.

Figure 10:
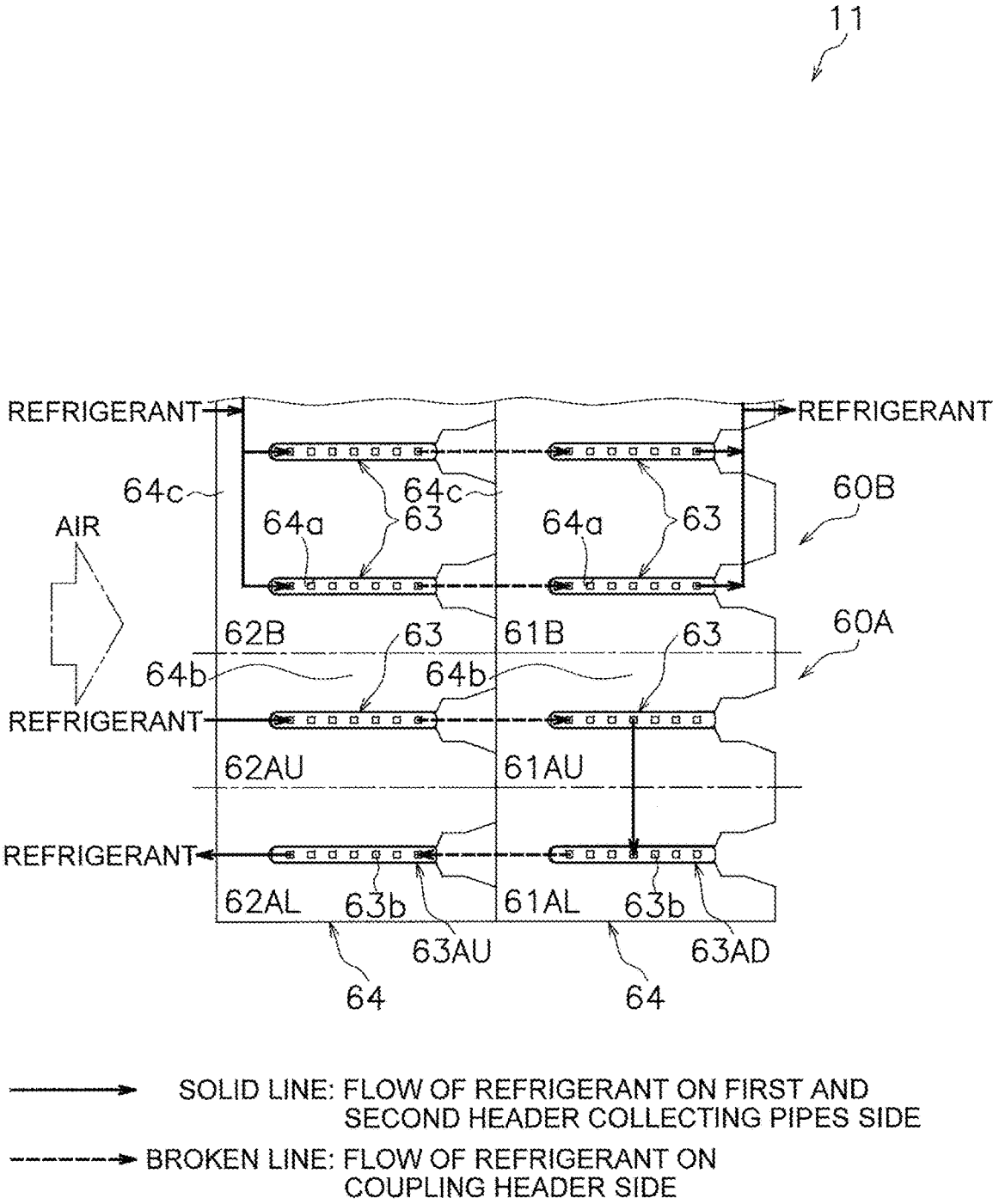
FIG. 10 is a diagram illustrating an outdoor heat exchanger as a heat exchanger according to Modification A of one or more embodiments and corresponding to FIG. 9.

For example, as illustrated in FIG. 10, the first heat exchange path 60A may have a configuration in which the first heat exchange sections are connected in series so that, when the heat exchanger 11 is used as the evaporator for the refrigerant, the refrigerant flows through the first windward upper side heat exchange section 62AU, the first leeward upper side heat exchange section 61AU, the first leeward lower side heat exchange section 61AL, and the first windward lower side heat exchange section 62AL in this order. When the heat exchanger 11 is used as the radiator for the refrigerant, the refrigerant flows in the opposite direction.

Also in the present modification, similarly to the embodiments described above, the path effective length LA of the first heat exchange path 60A is longer than the path effective length LB to LJ of the other heat exchange paths 60B to 60J. Thus, it is possible to reduce frost formation in the lowermost heat exchange path 60A to reduce unmelted frost in the defrosting operation.

In the present modification, when the heat exchanger 11 is used as the radiator for the refrigerant, the first windward lower side heat exchange section 62AL serves as the entrance of the first heat exchange path 60A. Thus, similarly to the embodiments described above, in the defrosting operation, the temperature of the lowermost first heat exchange path 60A can be promptly raised by actively heating and evaporating the refrigerant in a liquid state accumulated in the first windward lower side heat exchange section 62AL. Accordingly, it is possible to further reduce unmelted frost in the first heat exchange path 60A. Further, the first windward lower side heat exchange section 62AL is located on the windward side in the row direction. In the configuration in which the heat exchange paths 60A to 60J respectively include the windward side heat exchange sections 62A to 62J located on the windward side in the row direction (in the first heat exchange path 60A, the first windward lower side heat exchange section 62AL and the first windward upper side heat exchange section 62AU) and the leeward side heat exchange sections 61A to 61J located on the leeward side in the row direction (in the first heat exchange path 60A, the first leeward lower side heat exchange section 61AL and the first leeward upper side heat exchange section 61AU), the amount of frost adhered to the windward side heat exchange sections 62A to 62J tends to increase in the heating operation. Thus, unmelted frost in the lowermost first heat exchange path 60A (in particular, the first windward lower side heat exchange section 62AL and the first windward upper side heat exchange section 61AL) may increase in the defrosting operation. However, in the present modification, as described above, when the heat exchanger 11 is used as the radiator for the refrigerant, the first windward lower side heat exchange section 62AL located on the windward side in the row direction serves as the entrance of the first heat exchange path 60A. Thus, in the defrosting operation, when the refrigerant in a gas state is introduced into the first heat exchange path 60A, the refrigerant in a gas state flows into the first windward lower side heat exchange section 62AL. That is, in the present modification, the first windward lower side heat exchange section 62AL located on the windward side in the row direction is located on the upstream side in the flow of the refrigerant in the defrosting operation. Thus, in the present modification, among the first windward lower side heat exchange section 62AL, the first windward upper side heat exchange section 62AU, the first leeward lower side heat exchange section 61AL, and the first leeward upper side heat exchange section 61AU which constitute the first heat exchange path 60A, the refrigerant in a gas state can be introduced into the first windward lower side heat exchange section 62AL located on the windward side in the row direction to actively heat and melt frost adhered to the first windward lower side heat exchange section 62AL located on the windward side in the row direction. Accordingly, in the present modification, it is possible to further reduce unmelted frost in the first heat exchange path 60A in the defrosting operation.

Further, in the present modification, differently from the embodiments described above, the first liquid side gateway space 72AU is formed in the second header collecting pipe 80 so as to communicate with the first windward upper side heat exchange section 62AU, and the first gas-side gateway space 72AL is formed in the second header collecting pipe 80 so as to communicate with the first windward lower side heat exchange section 62AL. Further, the first vertical return space 82A is formed in the first header collecting pipe 70 so that the first leeward lower side heat exchange section 61AL and the first leeward upper side heat exchange section 61AU communicate with each other. In the present modification, the liquid-refrigerant side entrances of the heat exchange paths 60A to 60J are all disposed on the heat exchange sections 62AU, 62B to 62J on the windward side. Thus, all the liquid-side gateway spaces 72AU, 82B to 82J can be collectively formed in the second header collecting pipe 80. Further, in the present modification, similarly to the embodiments described above, the return direction of all the heat exchange paths 60A to 60J in the coupling header 90 is the horizontal direction. Thus, the internal space of the coupling header 90 can be configured to have a simple structure merely vertically partitioned in each stage. Further, in the present modification, similarly to the embodiments described above, when the heat exchanger 11 is used as the evaporator for the refrigerant, among the first heat exchange sections 61AU, 62AU, 62AL, 61AL constituting the lowermost first heat exchange path 60A, the first lower side heat exchange sections 62AL, 61AL located on the downstream side in the flow of the refrigerant are disposed separately from the second heat exchange sections 61B, 62B constituting the second heat exchange path 60B located on the upper side of the first heat exchange path 60A. Thus, a heat loss between the first heat exchange path 60A and the second heat exchange path 60B can be reduced. Accordingly, it is possible to prevent the interruption of a temperature rise in the refrigerant flowing through the lowermost heat exchange path 60A, thereby contributing to reducing frost formation in the first heat exchange path 60A.

B

In the outdoor heat exchanger 11 (heat exchanger) according to one or more embodiments, the first heat exchange path 60A has the configuration in which the first heat exchange sections are connected in series so that, when the heat exchanger 11 is used as the evaporator for the refrigerant, the refrigerant flows through the first leeward upper side heat exchange section 61AU, the first windward upper side heat exchange section 62AU, the first windward lower side heat exchange section 62AL, and the first leeward lower side heat exchange section 61AL in this order (refer to FIGS. 4 to 9). However, the connection configuration between the first heat exchange sections 61AU, 61AL, 62AU, 62AL is not limited thereto.

Figure 11:
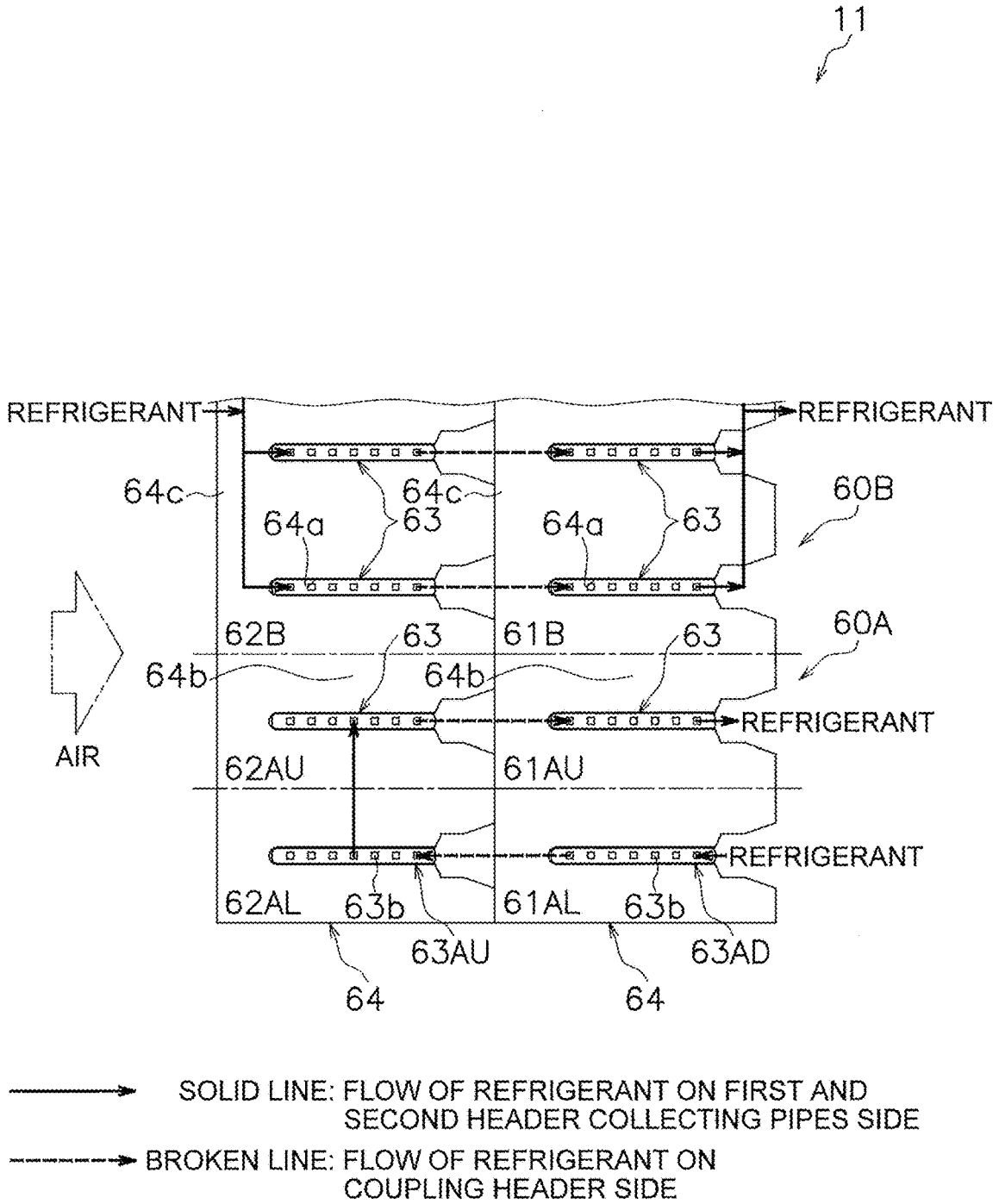
FIG. 11 is a diagram illustrating an outdoor heat exchanger as a heat exchanger according to Modification B of one or more embodiments and corresponding to FIG. 9.

For example, as illustrated in FIG. 11, the first heat exchange path 60A may have a configuration in which the first heat exchange sections are connected in series so that, when the heat exchanger 11 is used as the evaporator for the refrigerant, the refrigerant flows through the first leeward lower side heat exchange section 61AL, the first windward lower side heat exchange section 62AL, the first windward upper side heat exchange section 62AU, and the first leeward upper side heat exchange section 61AU in this order. When the heat exchanger 11 is used as the radiator for the refrigerant, the refrigerant flows in the opposite direction.

Also in the present modification, similarly to the embodiments described above, the path effective length LA of the first heat exchange path 60A is longer than each path effective length LB to LJ of the other heat exchange paths 60B to 60J. Thus, it is possible to reduce frost formation in the lowermost heat exchange path 60A to reduce unmelted frost in the defrosting operation.

Further, in the present modification, similarly to the embodiments described above, the first liquid-side gateway space 72AU and the first gas-side gateway space 72AL are formed in the first header collecting pipe 70. However, the vertical positions of the first liquid-side gateway space 72AU and the first gas-side gateway space 72AL are reversed. More specifically, the first liquid-side gateway space 72AU communicates with the first leeward lower side heat exchange section 61AL, and the first gas-side gateway space 72AL communicates with the first leeward upper side heat exchange section 61AU. In the present modification, similarly to the embodiments described above, the gas-refrigerant side entrances of the heat exchange paths 60A to 60J are all disposed on the heat exchange sections 61AL, 61B to 61J on the leeward side. Thus, all the gas-side gateway spaces 72AL, 72B to 72J can be collectively formed in the first header collecting pipe 70. In addition, differently from the embodiments described above, the first liquid-side gateway space 72AU is not disposed between the first gas-side gateway space 72AL and the second gas-side gateway space 72B in the up-down direction, but disposed on the lower side of the first gas-side gateway space 72AL. Thus, it is possible to simplify the structure of the first header collecting pipe 70 and reduce the length of the first header collecting pipe 70. Further, in the present modification, similarly to the embodiments described above, the return direction of all the heat exchange paths 60A to 60J in the coupling header 90 is the horizontal direction. Thus, the internal space of the coupling header 90 can be configured to have a simple structure merely vertically partitioned in each stage.

C

In the outdoor heat exchanger 11 (heat exchanger) according to one or more embodiments, the first heat exchange path 60A has the configuration in which the first heat exchange sections are connected in series so that, when the heat exchanger 11 is used as the evaporator for the refrigerant, the refrigerant flows through the first leeward upper side heat exchange section 61AU, the first windward upper side heat exchange section 62AU, the first windward lower side heat exchange section 62AL, and the first leeward lower side heat exchange section 61AL in this order (refer to FIGS. 4 to 9). However, the connection configuration between the first heat exchange sections 61AU, 61AL, 62AU, 62AL is not limited thereto.

Figure 12:
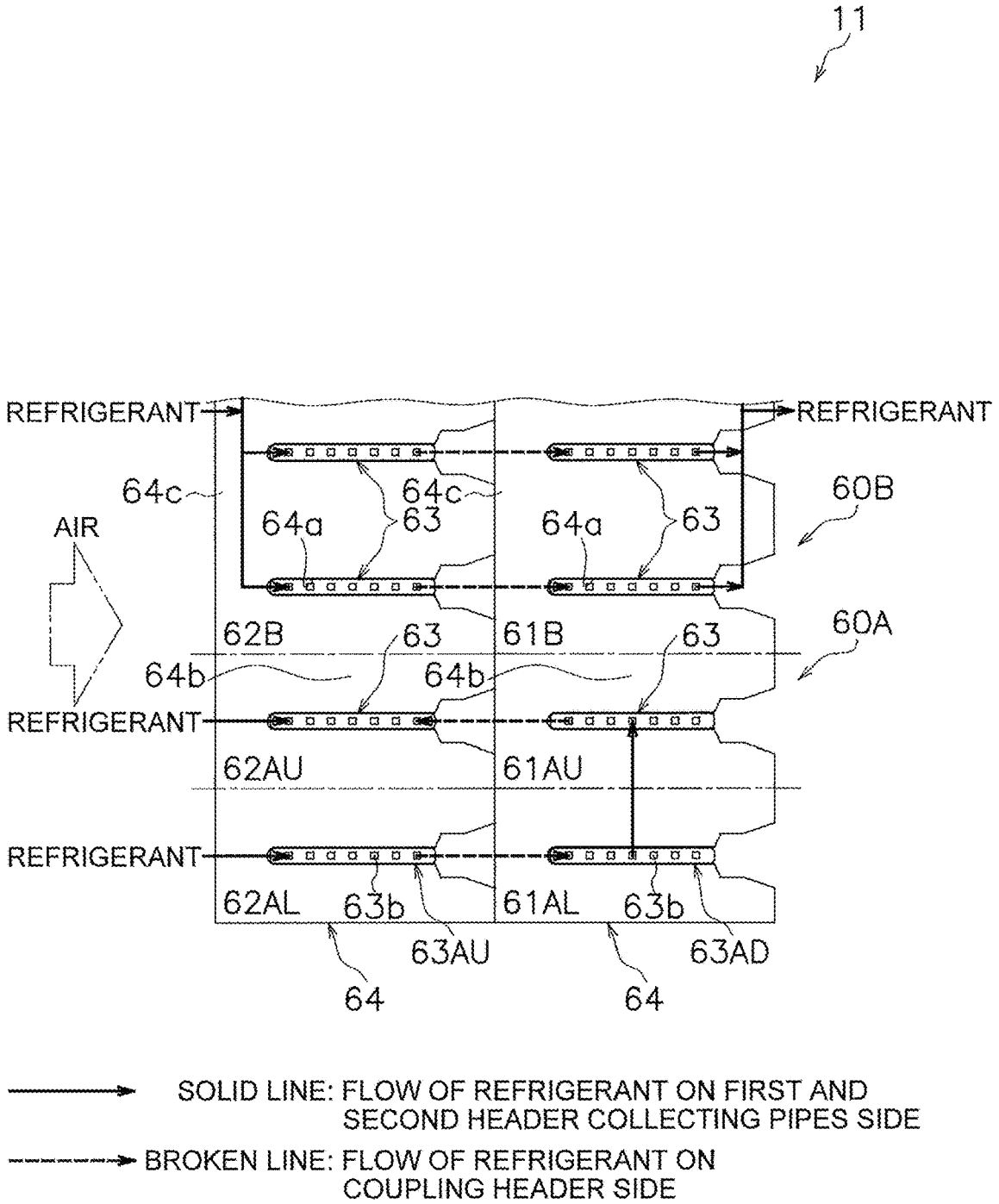
FIG. 12 is a diagram illustrating an outdoor heat exchanger as a heat exchanger according to Modification C of one or more embodiments and corresponding to FIG. 9.

For example, as illustrated in FIG. 12, the first heat exchange path 60A may have a configuration in which the first heat exchange sections are connected in series so that, when the heat exchanger 11 is used as the evaporator for the refrigerant, the refrigerant flows through the first windward lower side heat exchange section 62AL, the first leeward lower side heat exchange section 61AL, the first leeward upper side heat exchange section 61AU, and the first windward upper side heat exchange section 62AU in this order. When the heat exchanger 11 is used as the radiator for the refrigerant, the refrigerant flows in the opposite direction.

Also in the present modification, similarly to the embodiments described above, the path effective length LA of the first heat exchange path 60A is longer than the path effective length LB to LJ of each of the other heat exchange paths 60B to 60J. Thus, it is possible to reduce frost formation in the lowermost heat exchange path 60A to reduce unmelted frost in the defrosting operation.

Further, in the present modification, when the heat exchanger 11 is used as the radiator for the refrigerant, the first windward upper side heat exchange section 62AU located on the windward side in the row direction serves as the entrance of the first heat exchange path 60A. Thus, in the defrosting operation, when the refrigerant in a gas state is introduced into the first heat exchange path 60A, the refrigerant in a gas state flows into the first windward upper side heat exchange section 62AU. That is, in the present modification, in the defrosting operation, similarly to Modification A described above, the first windward lower side heat exchange section 62AL located on the windward side in the row direction is located on the upstream side in the flow of the refrigerant. Thus, in the present modification, among the first windward lower side heat exchange section 62AL, the first windward upper side heat exchange section 62AU, the first leeward lower side heat exchange section 61AL, and the first leeward upper side heat exchange section 61AU which constitute the first heat exchange path 60A, the refrigerant in a gas state can be introduced into the first windward upper side heat exchange section 62AU located on the windward side in the row direction to actively heat and melt frost adhered to the first windward upper side heat exchange section 62AU located on the windward side in the row direction. Accordingly, in the present modification, it is possible to further reduce unmelted frost in the first heat exchange path 60A in the defrosting operation.

Further, in the present modification, similarly to Modification A described above (refer to FIG. 10), the first liquid-side gateway space 72AU and the first gas-side gateway space 72AL are formed in the second header collecting pipe 80. However, the vertical positions of the first liquid-side gateway space 72AU and the first gas-side gateway space 72AL are reversed. More specifically, the first liquid-side gateway space 72AU communicates with the first windward lower side heat exchange section 62AL, and the first gas-side gateway space 72AL communicates with the first windward upper side heat exchange section 62AU. In the present modification, similarly to Modification A described above, the liquid-refrigerant side entrances of the heat exchange paths 60A to 60J are all disposed on the heat exchange sections 62AL, 62B to 62J on the windward side. Thus, all the liquid-side gateway spaces 72AU, 82B to 82J can be collectively formed in the second header collecting pipe 80. In addition, differently from Modification A described above, the first gas-side gateway space 72AL is not disposed between the first liquid-side gateway space 72AU and the second liquid-side gateway space 82B in the up-down direction, but disposed on the lower side of the first liquid-side gateway space 72AU. Thus, it is possible to simplify the structure of the second header collecting pipe 80 and reduce the length of the second header collecting pipe 80. Further, in the present modification, similarly to the embodiments described above, the return direction of all the heat exchange paths 60A to 60J in the coupling header 90 is the horizontal direction. Thus, the internal space of the coupling header 90 can be configured to have a simple structure merely vertically partitioned in each stage.

D

In the outdoor heat exchanger 11 (heat exchanger) according to one or more embodiments, the first heat exchange path 60A has the configuration in which the first heat exchange sections are connected in series so that, when the heat exchanger 11 is used as the evaporator for the refrigerant, the refrigerant flows through the first leeward upper side heat exchange section 61AU, the first windward upper side heat exchange section 62AU, the first windward lower side heat exchange section 62AL, and the first leeward lower side heat exchange section 61AL in this order (refer to FIGS. 4 to 9). However, the connection configuration between the first heat exchange sections 61AU, 61AL, 62AU, 62AL is not limited thereto.

Figure 13:
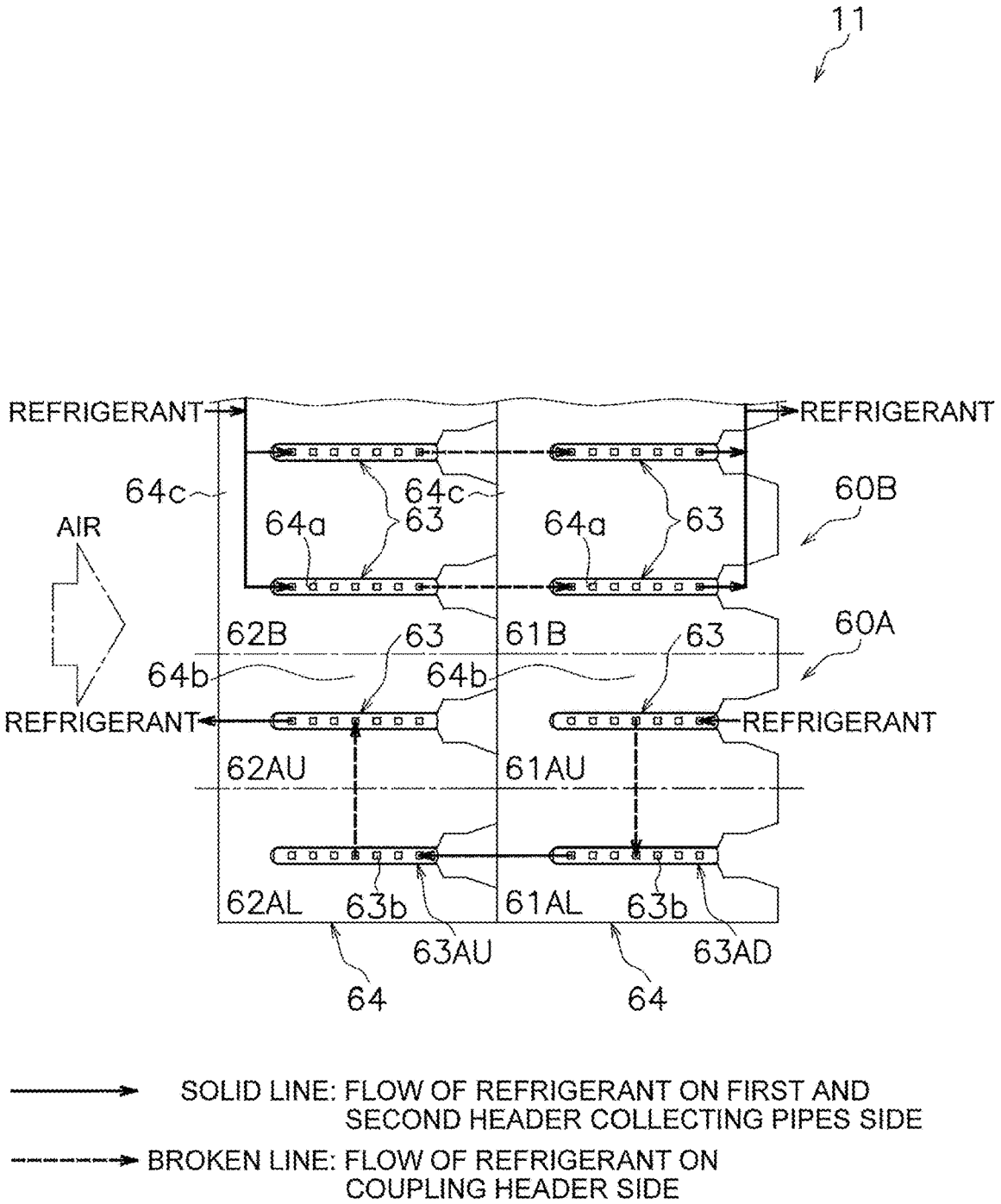
FIG. 13 is a diagram illustrating an outdoor heat exchanger as a heat exchanger according to Modification D of one or more embodiments and corresponding to FIG. 9.

For example, as illustrated in FIG. 13, the first heat exchange path 60A may have a configuration in which the first heat exchange sections are connected in series so that, when the heat exchanger 11 is used as the evaporator for the refrigerant, the refrigerant flows through the first leeward upper side heat exchange section 61AU, the first leeward lower side heat exchange section 61AL, the first windward lower side heat exchange section 62AL, and the first windward upper side heat exchange section 62AU in this order. When the heat exchanger 11 is used as the radiator for the refrigerant, the refrigerant flows in the opposite direction. In one or more embodiments, the partition plate 93 which partitions the first communication space 92A of the coupling header 90, the first communication space 92A corresponding to the first heat exchange path 60A, is disposed to vertically partition the first communication space 92A. However, the present modification requires vertical return connection between the first leeward upper side heat exchange section 61AU and the first leeward lower side heat exchange section 61AL and vertical return connection between the first windward lower side heat exchange section 62AL and the first windward upper side heat exchange section 62AU. Thus, a partition plate 93 (not illustrated) is disposed to partition the first communication space 92A into the windward side and the leeward side. Further, in one or more embodiments, the first communication space 82A of the second header collecting pipe 80, the first communication space 82A corresponding to the first heat exchange path 60A, serves as the first vertical return space. On the other hand, in the present modification, similarly to the partition plate 73 which vertically partitions the first communication space 72A of the first header collecting pipe 70, a partition plate (not illustrated) which vertically partitions the first communication space 82A is provided. Further, the present modification requires horizontal return connection between the first leeward lower side heat exchange section 61AL and the first windward lower side heat exchange section 62AL. Thus, a communication pipe (not illustrated) which allows the first communication space 72A of the first header collecting pipe 70 and the second communication space 82A of the second header collecting pipe 80 to communicate with each other is provided.

Also in the present modification, similarly to the embodiments described above, the path effective length LA of the first heat exchange path 60A is longer than the path effective length LB to LJ of each of the other heat exchange paths 60B to 60J. Thus, it is possible to reduce frost formation in the lowermost heat exchange path 60A to reduce unmelted frost in the defrosting operation.

Further, in the present modification, when the heat exchanger 11 is used as the evaporator for the refrigerant, the flow of air and the flow of the refrigerant in the first heat exchange path 60A have a counterflow relationship as a whole. Thus, in the heating operation, heat exchange between air and the refrigerant flowing through the first heat exchange path 60A is accelerated, which facilitates raising the temperature of the refrigerant flowing through the lowermost first heat exchange path 60A. Thus, it is possible to increase the effect of reducing frost formation in the first heat exchange path 60A.

Further, in the present modification, when the heat exchanger 11 is used as the radiator for the refrigerant, similarly to Modification C described above, the first windward upper side heat exchange section 62AU located on the windward side in the row direction serves as the entrance of the first heat exchange path 60A. Thus, in the defrosting operation, when the refrigerant in a gas state is introduced into the first heat exchange path 60A, the refrigerant in a gas state flows into the first windward upper side heat exchange section 62AU. That is, in the present modification, in the defrosting operation, similarly to Modification C described above, the first windward upper side heat exchange section 62AU located on the windward side in the row direction is located on the upstream side in the flow of the refrigerant. Thus, in the present modification, among the first windward lower side heat exchange section 62AL, the first windward upper side heat exchange section 62AU, the first leeward lower side heat exchange section 61AL, and the first leeward upper side heat exchange section 61AU which constitute the first heat exchange path 60A, the refrigerant in a gas state can be introduced into the first windward upper side heat exchange section 62AU located on the windward side in the row direction to actively heat and melt frost adhered to the first windward upper side heat exchange section 62AU located on the windward side in the row direction. Accordingly, in the present modification, it is possible to further reduce unmelted frost in the first heat exchange path 60A in the defrosting operation.

E

In the outdoor heat exchanger 11 (heat exchanger) according to one or more embodiments, the first heat exchange path 60A has the configuration in which the first heat exchange sections are connected in series so that, when the heat exchanger 11 is used as the evaporator for the refrigerant, the refrigerant flows through the first leeward upper side heat exchange section 61AU, the first windward upper side heat exchange section 62AU, the first windward lower side heat exchange section 62AL, and the first leeward lower side heat exchange section 61AL in this order (refer to FIGS. 4 to 9). However, the connection configuration between the first heat exchange sections 61AU, 61AL, 62AU, 62AL is not limited thereto.

Figure 14:
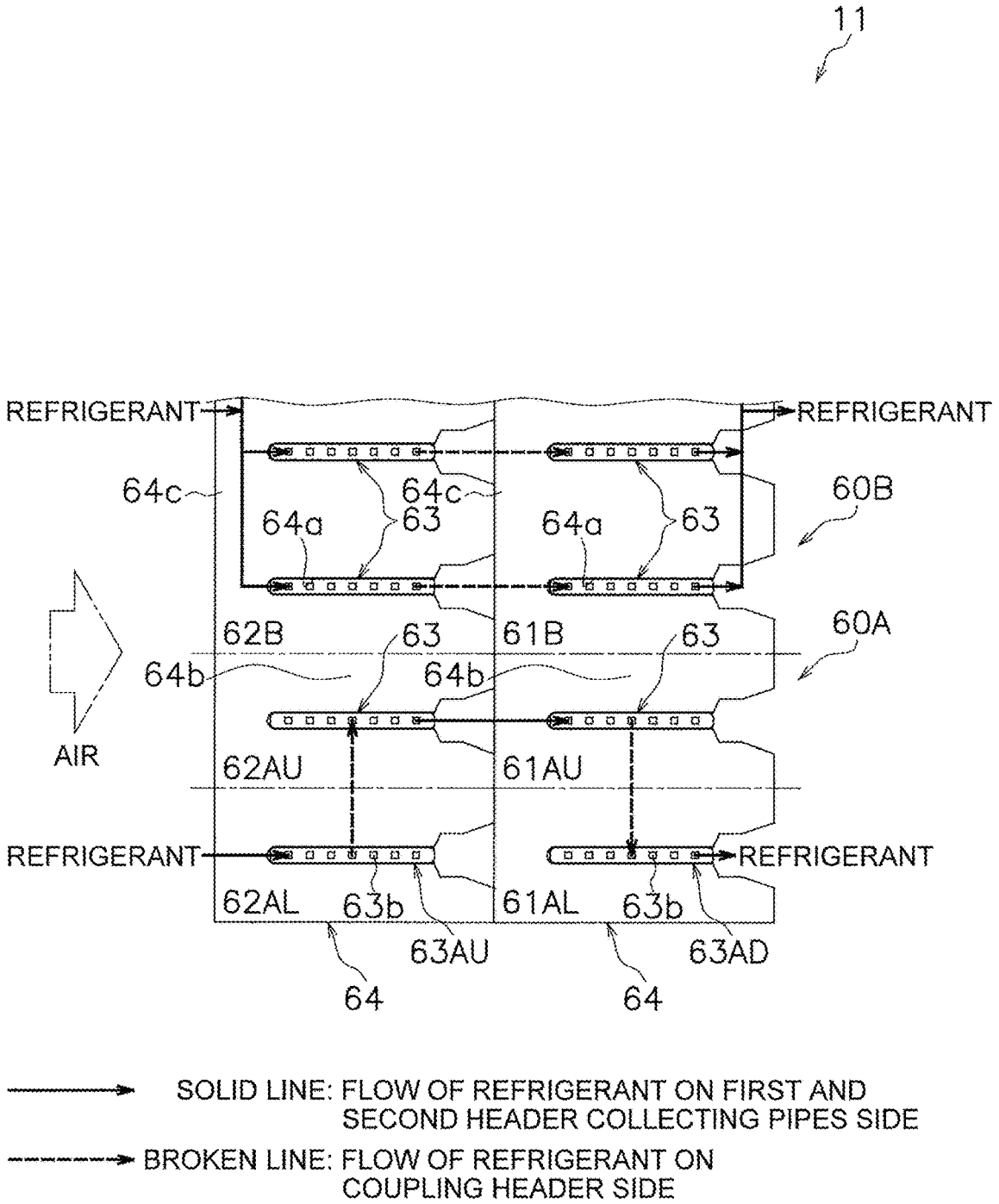
FIG. 14 is a diagram illustrating an outdoor heat exchanger as a heat exchanger according to Modification E of one or more embodiments and corresponding to FIG. 9.

For example, as illustrated in FIG. 14, the first heat exchange path 60A may have a configuration in which the first heat exchange sections are connected in series so that, when the heat exchanger 11 is used as the evaporator for the refrigerant, the refrigerant flows through the first windward lower side heat exchange section 62AL, the first windward upper side heat exchange section 62AU, the first leeward upper side heat exchange section 61AU, and the first leeward lower side heat exchange section 61AL in this order. When the heat exchanger 11 is used as the radiator for the refrigerant, the refrigerant flows in the opposite direction. Further, similarly to Modification D described above, the present modification is provided with a partition plate 93 (not illustrated) which partitions the first communication space 92A into the windward side and the leeward side, a partition plate (not illustrated) which vertically partitions the first communication space 82A, and a communication pipe (not illustrated) which allows the first communication space 72A of the first header collecting pipe 70 and the second communication space 82A of the second header collecting pipe 80 to communicate with each other.

Also in the present modification, similarly to the embodiments described above, the path effective length LA of the first heat exchange path 60A is longer than the path effective length LB to LJ of each of the other heat exchange paths 60B to 60J. Thus, it is possible to reduce frost formation in the lowermost heat exchange path 60A to reduce unmelted frost in the defrosting operation.

Further, in the present modification, when the heat exchanger 11 is used as the radiator for the refrigerant, the first leeward lower side heat exchange section 61AL serves as the entrance of the first heat exchange path 60A. Thus, similarly to the embodiments described above, in the defrosting operation, the temperature of the lowermost first heat exchange path 60A can be promptly raised by actively heating and evaporating the refrigerant in a liquid state accumulated in the first windward lower side heat exchange section 62AL. Accordingly, it is possible to further reduce unmelted frost in the first heat exchange path 60A.

Further, in the present modification, the gas-refrigerant side entrances of the heat exchange paths 60A to 60J are all disposed on the heat exchange sections 61AL, 61B to 61J on the leeward side. Thus, all the gas-side gateway spaces 72AL, 72B to 72J can be collectively formed in the first header collecting pipe 70. Further, in the present modification, the liquid-refrigerant side entrances of the heat exchange paths 60A to 60J are all disposed on the heat exchange sections 62AL, 62B to 62J on the windward side. Thus, all the liquid-side gateway spaces 82AL, 82B to 82J can be collectively formed in the second header collecting pipe 80.

F

In the outdoor heat exchanger 11 (heat exchanger) according to one or more embodiments, the first heat exchange path 60A has the configuration in which the first heat exchange sections are connected in series so that, when the heat exchanger 11 is used as the evaporator for the refrigerant, the refrigerant flows through the first leeward upper side heat exchange section 61AU, the first windward upper side heat exchange section 62AU, the first windward lower side heat exchange section 62AL, and the first leeward lower side heat exchange section 61AL in this order (refer to FIGS. 4 to 9). However, the connection configuration between the first heat exchange sections 61AU, 61AL, 62AU, 62AL is not limited thereto.

Figure 15:
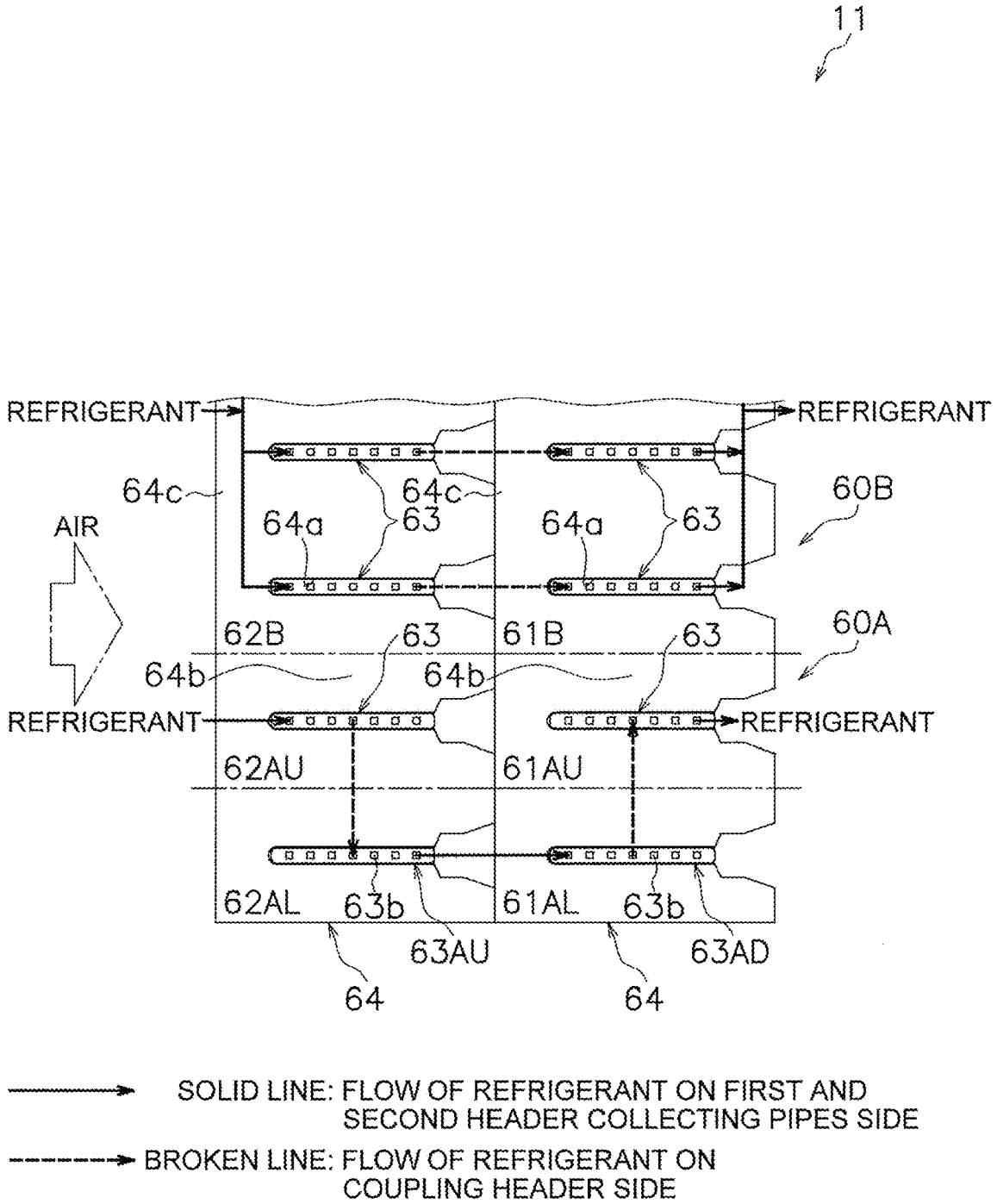
FIG. 15 is a diagram illustrating an outdoor heat exchanger as a heat exchanger according to Modification F of one or more embodiments and corresponding to FIG. 9.

For example, as illustrated in FIG. 15, the first heat exchange path 60A may have a configuration in which the first heat exchange sections are connected in series so that, when the heat exchanger 11 is used as the evaporator for the refrigerant, the refrigerant flows through the first windward upper side heat exchange section 62AU, the first windward lower side heat exchange section 62AL, the first leeward lower side heat exchange section 61AL, and the first leeward upper side heat exchange section 61AU in this order. When the heat exchanger 11 is used as the radiator for the refrigerant, the refrigerant flows in the opposite direction. Further, similarly to Modification D described above, the present modification is provided with a partition plate 93 (not illustrated) which partitions the first communication space 92A into the windward side and the leeward side, a partition plate (not illustrated) which vertically partitions the first communication space 82A, and a communication pipe (not illustrated) which allows the first communication space 72A of the first header collecting pipe 70 and the second communication space 82A of the second header collecting pipe 80 to communicate with each other.

Also in the present modification, similarly to the embodiments described above, the path effective length LA of the first heat exchange path 60A is longer than the path effective length LB to LJ of each of the other heat exchange paths 60B to 60J. Thus, it is possible to reduce frost formation in the lowermost heat exchange path 60A to reduce unmelted frost in the defrosting operation.

Further, in the present modification, the gas-refrigerant side entrances of the heat exchange paths 60A to 60J are all disposed on the heat exchange sections 61AU, 61B to 61J on the leeward side. Thus, all the gas-side gateway spaces 72AL, 72B to 72J can be collectively formed in the first header collecting pipe 70. Further, in the present modification, the liquid-refrigerant side entrances of the heat exchange paths 60A to 60J are all disposed on the heat exchange sections 62AU, 62B to 62J on the windward side. Thus, all the liquid-side gateway spaces 82AL, 82B to 82J can be collectively formed in the second header collecting pipe 80.

G

In the outdoor heat exchanger 11 (heat exchanger) according to one or more embodiments, the first heat exchange path 60A has the configuration in which the first heat exchange sections are connected in series so that, when the heat exchanger 11 is used as the evaporator for the refrigerant, the refrigerant flows through the first leeward upper side heat exchange section 61AU, the first windward upper side heat exchange section 62AU, the first windward lower side heat exchange section 62AL, and the first leeward lower side heat exchange section 61AL in this order (refer to FIGS. 4 to 9). However, the connection configuration between the first heat exchange sections 61AU, 61AL, 62AU, 62AL is not limited thereto.

Figure 16:
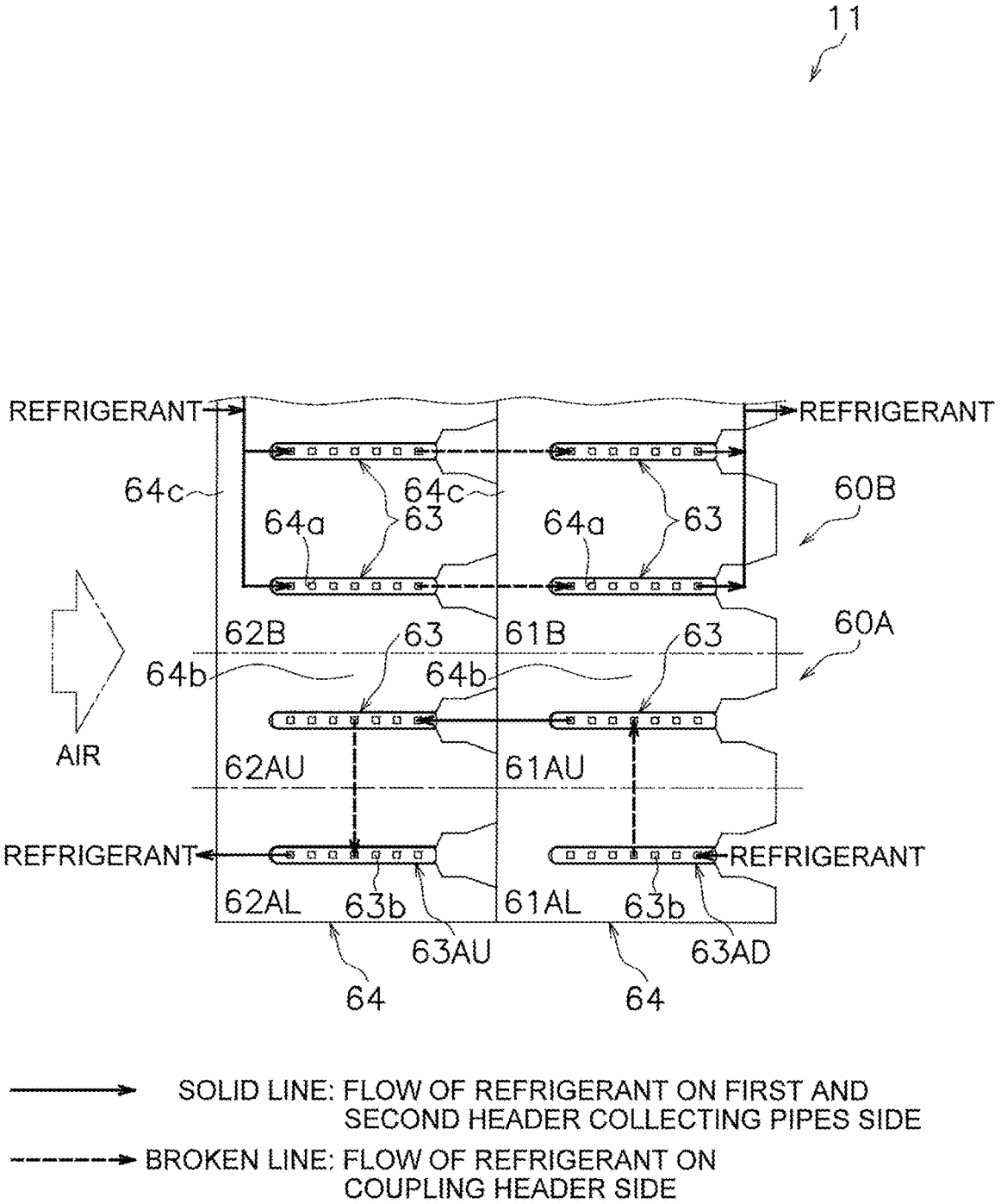
FIG. 16 is a diagram illustrating an outdoor heat exchanger as a heat exchanger according to Modification G of one or more embodiments and corresponding to FIG. 9.

For example, as illustrated in FIG. 16, the first heat exchange path 60A may have a configuration in which the first heat exchange sections are connected in series so that, when the heat exchanger 11 is used as the evaporator for the refrigerant, the refrigerant flows through the first leeward lower side heat exchange section 61AL, the first leeward upper side heat exchange section 61AU, the first windward upper side heat exchange section 62AU, and the first windward lower side heat exchange section 62AL in this order. When the heat exchanger 11 is used as the radiator for the refrigerant, the refrigerant flows in the opposite direction. Further, similarly to Modification D described above, the present modification is provided with a partition plate 93 (not illustrated) which partitions the first communication space 92A into the windward side and the leeward side, a partition plate (not illustrated) which vertically partitions the first communication space 82A, and a communication pipe (not illustrated) which allows the first communication space 72A of the first header collecting pipe 70 and the second communication space 82A of the second header collecting pipe 80 to communicate with each other.

Also in the present modification, similarly to the embodiments described above, the path effective length LA of the first heat exchange path 60A is longer than the path effective length LB to LJ of each of the other heat exchange paths 60B to 60J. Thus, it is possible to reduce frost formation in the lowermost heat exchange path 60A to reduce unmelted frost in the defrosting operation.

Further, in the present modification, when the heat exchanger 11 is used as the evaporator for the refrigerant, the flow of air and the flow of the refrigerant in the first heat exchange path 60A have a counterflow relationship as a whole. Thus, in the heating operation, heat exchange between air and the refrigerant flowing through the first heat exchange path 60A is accelerated, which facilitates raising the temperature of the refrigerant flowing through the lowermost first heat exchange path 60A. Thus, it is possible to increase the effect of reducing frost formation in the first heat exchange path 60A.

Further, in the present modification, when the heat exchanger 11 is used as the radiator for the refrigerant, the first windward lower side heat exchange section 62AL serves as the entrance of the first heat exchange path 60A. Thus, similarly to the embodiments described above, in the defrosting operation, the temperature of the lowermost first heat exchange path 60A can be promptly raised by actively heating and evaporating the refrigerant in a liquid state accumulated in the first windward lower side heat exchange section 62AL. Accordingly, it is possible to further reduce unmelted frost in the first heat exchange path 60A. Further, the first windward lower side heat exchange section 62AL is located on the windward side in the row direction. Thus, in the defrosting operation, when the refrigerant in a gas state is introduced into the first heat exchange path 60A, the refrigerant in a gas state flows into the first windward lower side heat exchange section 62AL. That is, in the present modification, in the defrosting operation, similarly to Modification A described above, the first windward lower side heat exchange section 62AL located on the windward side in the row direction is located on the upstream side in the flow of the refrigerant. Thus, in the present modification, among the first windward lower side heat exchange section 62AL, the first windward upper side heat exchange section 62AU, the first leeward lower side heat exchange section 61AL, and the first leeward upper side heat exchange section 61AU which constitute the first heat exchange path 60A, the refrigerant in a gas state can be introduced into the first windward lower side heat exchange section 62AL located on the windward side in the row direction to actively heat and melt frost adhered to the first windward lower side heat exchange section 62AL located on the windward side in the row direction. Accordingly, in the present modification, it is possible to further reduce unmelted frost in the first heat exchange path 60A in the defrosting operation.

H

In the outdoor heat exchangers 11 (heat exchangers) according to one or more embodiments and modifications thereof, the first heat exchange path includes two rows and two stages of flat pipes 63 (four flat pipes 63 in total) including the lowermost flat pipes 63AU, 63AD. The four flat pipes 63 constitute the respective heat exchange sections 61AU, 61AL, 62AU, 62AL. The four heat exchange sections are connected in series. However, the present disclosure is not limited thereto. For example, the first heat exchange path may include two rows and four stages of flat pipes 63 (eight flat pipes 63 in total) including the lowermost flat pipes 63AU, 63AD. Each two of the eight flat pipes 63 may constitute each of the heat exchange sections 61AU, 61AL, 62AU, 62AL. The four heat exchange sections may be connected in series.

Further, in the heat exchangers 11 according to one or more embodiments and modifications thereof, the number of rows of the heat exchange sections constituting the heat exchange paths is two. However, the present disclosure is not limited thereto. For example, the number of rows of the heat exchange sections constituting the heat exchange paths may be one. The first heat exchange path 60A may include a plurality of stages of flat pipes 63 vertically turned back a plurality of times and connected in series to make the path effective length of the first heat exchange path 60A longer than that of each of the other heat exchange paths 60B to 60J.

As described above, although, in the heat exchangers 11 according to one or more embodiments and modifications thereof, the number of stages of heat exchange paths (ten stages), the number of rows of heat exchange sections (two rows), the total number of flat pipes 63 (eighty-seven), and the number of flat pipes 63 constituting each of the heat exchange paths 60A to 60J are defined, these numbers are merely examples, and the present disclosure is not limited to these numbers.

(5) Outdoor Heat Exchanger According to One or More Embodiments

<Configuration>

Figure 17:
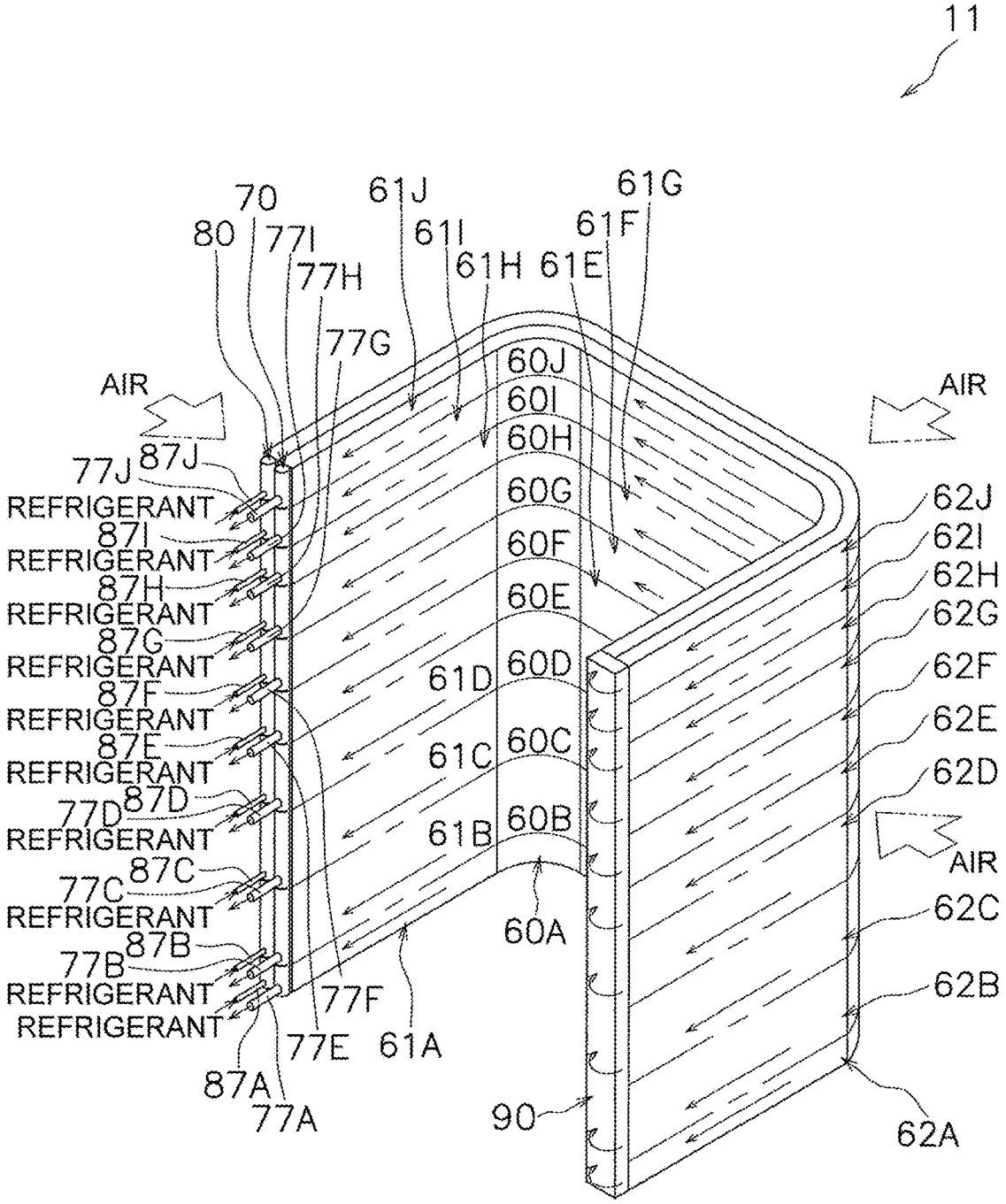
FIG. 17 is a schematic perspective view of an outdoor heat exchanger as a heat exchanger according to one or more embodiments.
Figure 18:
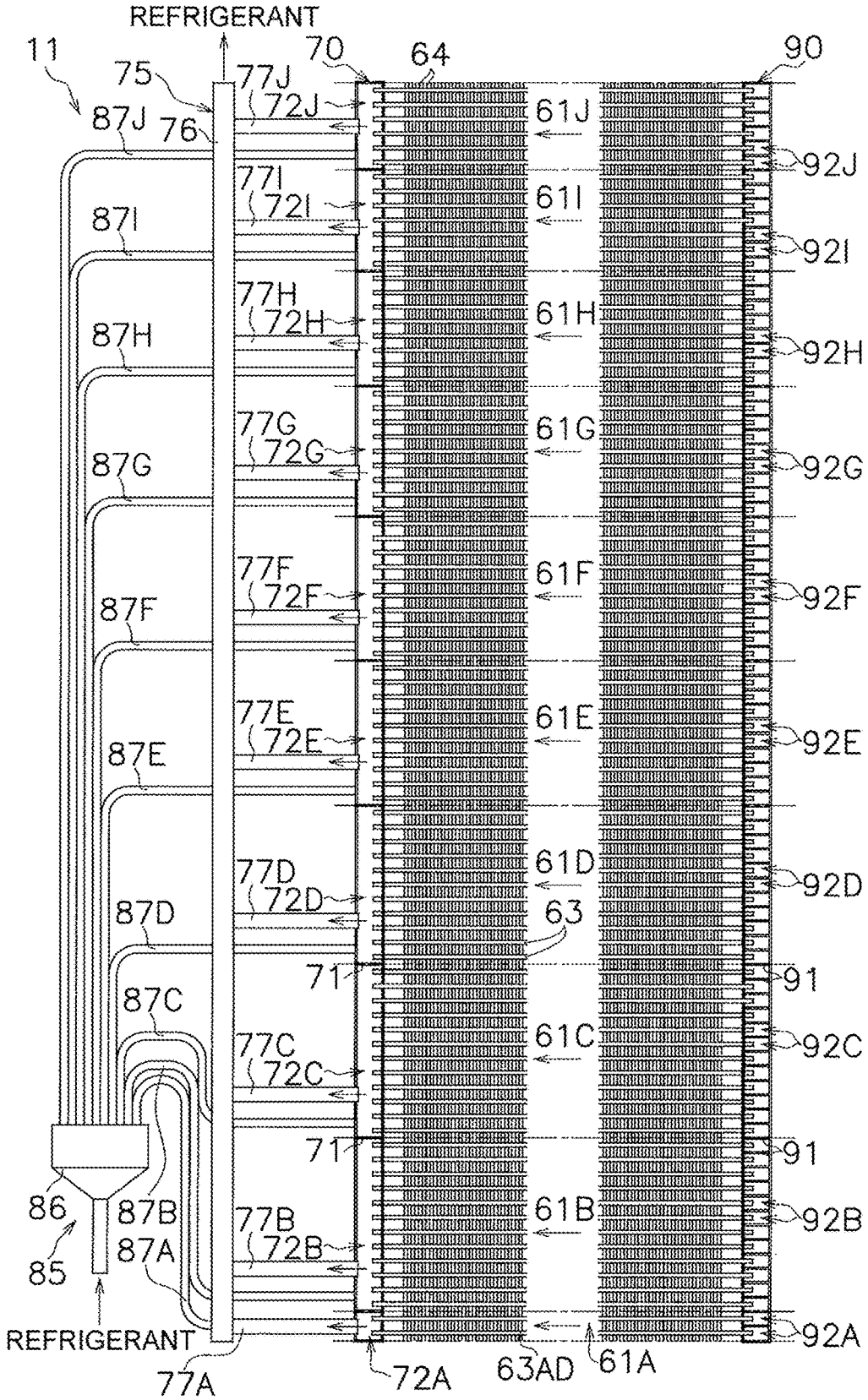
FIG. 18 is a schematic configuration diagram of the outdoor heat exchanger as the heat exchanger according to one or more embodiments (viewed from the leeward side).
Figure 19:
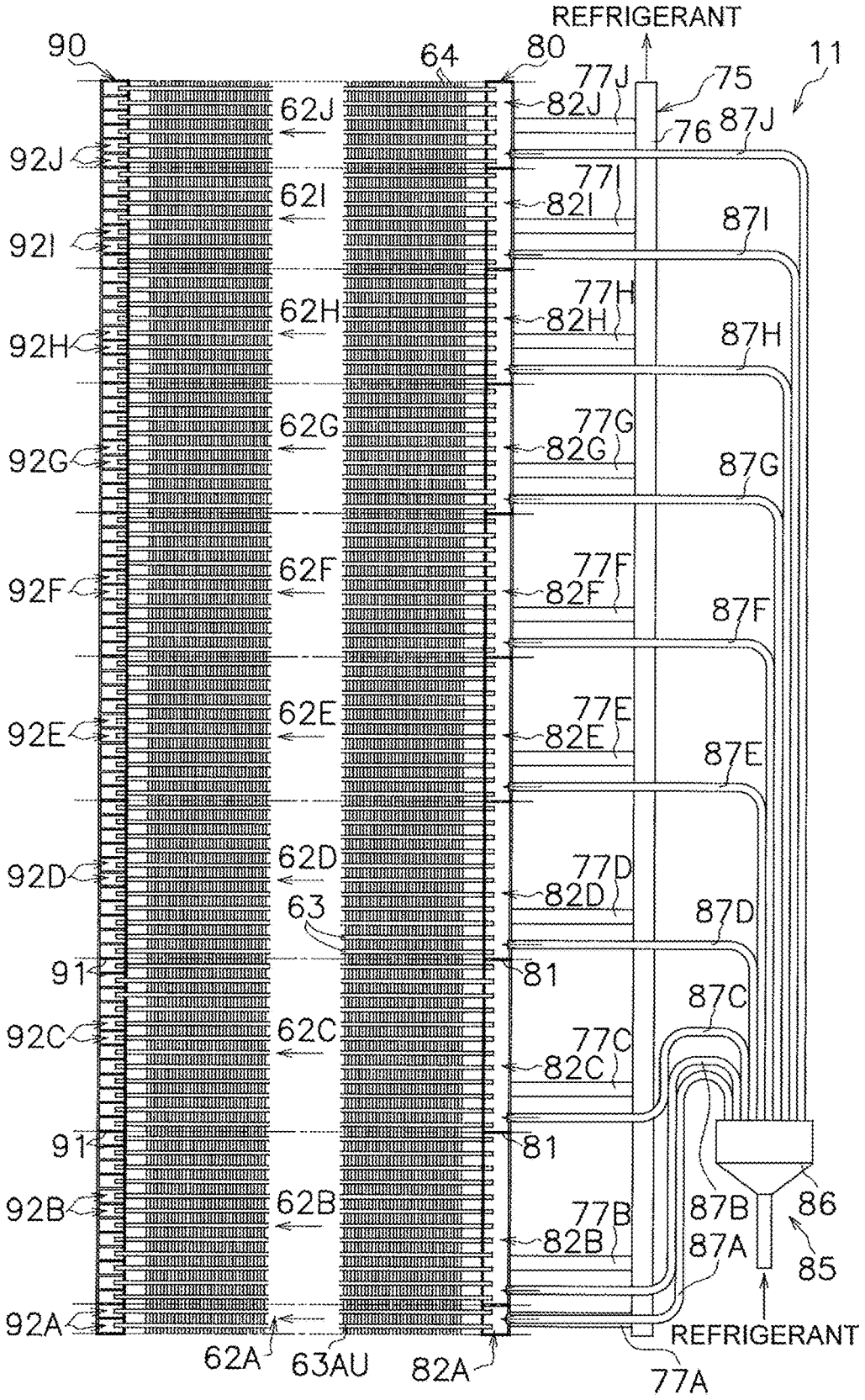
FIG. 19 is a schematic configuration diagram of the outdoor heat exchanger as the heat exchanger according to one or more embodiments (viewed from the windward side).
Figure 20:
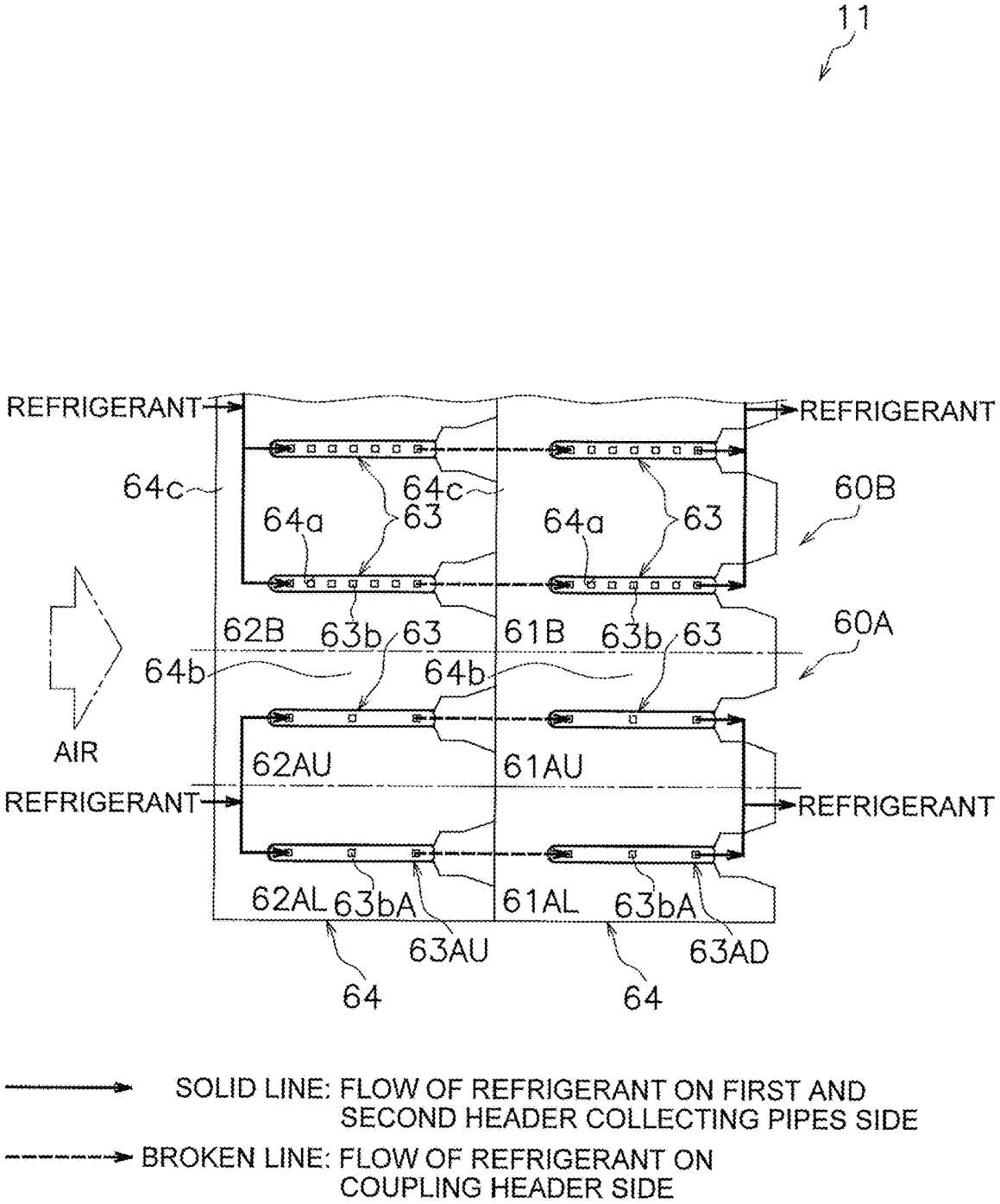
FIG. 20 is a diagram illustrating a path configuration near a first heat exchange path of the outdoor heat exchanger as the heat exchanger according to one or more embodiments.

FIG. 17 is a schematic perspective view of an outdoor heat exchanger 11 as a heat exchanger according to one or more embodiments. FIG. 18 is a schematic configuration diagram of the outdoor heat exchanger 11 as the heat exchanger according to one or more embodiments (viewed from the leeward side). FIG. 19 is a schematic configuration diagram of the outdoor heat exchanger 11 as the heat exchanger according to one or more embodiments (viewed from the windward side). FIG. 20 is a diagram illustrating a path configuration near a first heat exchange path 60A of the outdoor heat exchanger 11 as the heat exchanger according to one or more embodiments. In FIGS. 17 to 20, the arrows indicating the refrigerant flow direction shows the refrigerant flow direction in the heating operation (when the outdoor heat exchanger 11 functions as the evaporator for the refrigerant).

The outdoor heat exchanger 11 is a heat exchanger that exchanges heat between the refrigerant and outdoor air. The outdoor heat exchanger 11 mainly includes a first header collecting pipe 70, a second header collecting pipe 80, a coupling header 90, a plurality of flat pipes 63, and a plurality of fins 64. In one or more embodiments, the first header collecting pipe 70, the second header collecting pipe 80, the coupling header 90, the flat pipes 63, and the fins 64 are all made of aluminum or an aluminum alloy and joined to each other by, for example, brazing.

The first header collecting pipe 70 is a vertically long hollow tubular member whose upper and lower ends are closed. The first header collecting pipe 70 stands on one end side (in one or more embodiments, the left front end side in FIG. 17 or the left end side in FIG. 18) of the outdoor heat exchanger 11.

The second header collecting pipe 80 is a vertically long hollow tubular member whose upper and lower ends are closed. The second header collecting pipe 80 stands on one end side (in one or more embodiments, the left front end side in FIG. 17 or the right end side in FIG. 19) of the outdoor heat exchanger 11. In one or more embodiments, the second header collecting pipe 80 is disposed on the windward side in the air flow direction relative to the first header collecting pipe 70.

The coupling header 90 is a vertically long hollow tubular member whose upper and lower ends are closed. The second header collecting pipe 80 stands on one end side (in one or more embodiments, the right front end side in FIG. 17, the right end side in FIG. 18, or the left end side in FIG. 19) of the outdoor heat exchanger 11.

Each of the flat pipes 63 is a flat multi-perforated pipe including a flat part 63*a* which serves as a heat transfer surface and faces in the vertical direction and a passage 63*b* including a large number of small through holes through which the refrigerant flows, the passage 63*b* being formed inside the flat pipe 63. The flat pipes 63 are arranged in multiple stages in the up-down direction (stage direction) and arranged in multiple rows (in one or more embodiments, two rows) in the air flow direction (row direction). One end of each of the flat pipes 63 disposed on the leeward side in the air flow direction is connected to the first header collecting pipe 70, and the other end thereof is connected to the coupling header 90. One end of each of the flat pipes 63 disposed on the windward side in the air flow direction is connected to the second header collecting pipe 80, and the other end thereof is connected to the coupling header 90. The fins 64 partition a space between adjacent flat pipes 63 into a plurality of air flow passages through which air flows. Each of the fins 64 includes a plurality of cutouts 64*a* each of which horizontally extends long so that the flat pipes 63 can be inserted into the cutouts 64*a*. In one or more embodiments, the facing direction of the flat part 63*a* of the flat pipe 63 corresponds to the up-down direction (stage direction), and the longitudinal direction of the flat pipe 63 corresponds to the horizontal direction extending along the side face (in one or more embodiments, the right and left side faces) and the back face of a casing 40. Thus, the extending direction of the cutouts 64*a* indicates the horizontal direction (row direction) intersecting the longitudinal direction of the flat pipes 63 and also substantially coincides with the air flow direction (row direction) inside the casing 40. The cutout 64*a* extends long in the horizontal direction (row direction) so that the flat pipe 63 is inserted from the leeward side toward the windward side in the air flow direction. The shape of the cutout 64*a* of the fin 64 substantially coincides with the outer shape of the cross section of the flat pipe 63. The cutouts 64*a* of the fin 64 are formed at predetermined intervals in the up-down direction (stage direction) on the fin 64. The fin 64 includes a plurality of fin main parts 64*b* each of which is interposed between cutouts 64*a* adjacent in the up-down direction (stage direction) and a fin windward part 64*c* which extends continuously with the plurality of fin main parts 64*b* on the windward side in the air flow direction (row direction) relative to the cutouts 64*a*. The fins 64 are arranged in multiple rows (in one or more embodiments, two rows) in the direction in which air passes through the air flow passages (the air flow direction, the row direction) in a manner similar to the flat pipes 63.

In the outdoor heat exchanger 11, the flat pipes 63 are divided into a plurality of heat exchange paths 60A to 60J which are arrayed in multiple stages (in one or more embodiments, ten stages) in the up-down direction (stage direction). Further, the flat pipes 63 are arranged in multiple rows (in one or more embodiments, two rows) in the air flow direction of air passing through the air flow passages (row direction). Specifically, in one or more embodiments, the first heat exchange path 60A which is the lowermost heat exchange path, the second heat exchange path 60B, . . . , the ninth heat exchange path 60I, and the tenth heat exchange path 60J are formed in this order from bottom to top. The first heat exchange path 60A includes two stages and two rows of flat pipes 63 (four flat pipes 63 in total) including the lowermost flat pipes 63AU, 63AD. Each of the second and third heat exchange paths 60B, 60C includes twelve stages and two rows of flat pipes 63 (twenty-four flat pipes 63 in total). The fourth heat exchange path 60D includes eleven stages and two rows of flat pipes 63 (twenty-two flat pipes 63 in total). Each of the fifth and sixth heat exchange paths 60E, 60F includes ten stages and two rows of flat pipes 63 (twenty flat pipes 63 in total). The seventh heat exchange path 60G includes nine stages and two rows of flat pipes 63 (eighteen flat pipes 63 in total). The eighth heat exchange path 60H includes eight stages and two rows of flat pipes 63 (sixteen flat pipes 63 in total). The ninth heat exchange path 60I includes seven stages and two rows of flat pipes 63 (fourteen flat pipes 63 in total). The tenth heat exchange path 60J includes six stages and two rows of flat pipes 63 (twelve flat pipes 63 in total).

An internal space of the first header collecting pipe 70 is vertically partitioned by partition plates 71 so that communication spaces 72A to 72J respectively corresponding to the heat exchange paths 60A to 60J are formed. In the following description, the communication spaces 72A to 72J are referred to as the gas-side gateway spaces 72A to 72J.

The first gas-side gateway space 72A communicates with one end of each of two (first leeward side heat exchange section 61A) of the flat pipes 63 constituting the first heat exchange path 60A including the lowermost flat pipe 63AD. The two flat pipes are located on leeward side in the row direction. The second gas-side gateway space 72B communicates with one end of each of leeward twelve, in the row direction, of the flat pipes 63 constituting the second heat exchange path 60B (second leeward side heat exchange section 61B). The third gas-side gateway space 72C communicates with one end of each of leeward twelve, in the row direction, of the flat pipes 63 constituting the third heat exchange path 60C (third leeward side heat exchange section 61C). The fourth gas-side gateway space 72D communicates with one end of each of leeward eleven, in the row direction, of the flat pipes 63 constituting the fourth heat exchange path 60D (fourth leeward side heat exchange section 61D). The fifth gas-side gateway space 72E communicates with one end of each of leeward ten, in the row direction, of the flat pipes 63 constituting the fifth heat exchange path 60E (fifth leeward side heat exchange section 61E). The sixth gas-side gateway space 72F communicates with one end of each of leeward ten, in the row direction, of the flat pipes 63 constituting the sixth heat exchange path 60F (sixth leeward side heat exchange section 61F). The seventh gas-side gateway space 72G communicates with one end of each of leeward nine, in the row direction, of the flat pipes 63 constituting the seventh heat exchange path 60G (seventh leeward side heat exchange section 61G). The eighth gas-side gateway space 72H communicates with one end of each of leeward eight, in the row direction, of the flat pipes 63 constituting the eighth heat exchange path 60H (eighth leeward side heat exchange section 61H). The ninth gas-side gateway space 72I communicates with one end of each of leeward seven, in the row direction, of the flat pipes 63 constituting the ninth heat exchange path 60I (ninth leeward side heat exchange section 61I). The tenth gas-side gateway space 72J communicates with one end of each of leeward six, in the row direction, of the flat pipes 63 constituting the tenth heat exchange path 60J (tenth leeward side heat exchange section 61J).

An internal space of the second header collecting pipe 80 is vertically partitioned by partition plates 81 so that communication spaces 82A to 82J respectively corresponding to the heat exchange paths 60A to 60J are formed. In the following description, the communication spaces 82A to 82J are referred to as the liquid-side gateway spaces 82A to 82J.

The first liquid-side gateway space 82A communicates with one end of each of two (first windward side heat exchange section 62A) of the flat pipes 63 constituting the first heat exchange path 60A including the lowermost flat pipe 63AU. The two flat pipes are located on windward side in the row direction. The second liquid-side gateway space 82B communicates with one end of each of windward twelve, in the row direction, of the flat pipes 63 constituting the second heat exchange path 60B (second windward side heat exchange section 62B). The third liquid-side gateway space 82C communicates with one end of each of windward twelve, in the row direction, of the flat pipes 63 constituting the third heat exchange path 60C (third windward side heat exchange section 62C). The fourth liquid-side gateway space 82D communicates with one end of each of windward eleven, in the row direction, of the flat pipes 63 constituting the fourth heat exchange path 60D (fourth windward side heat exchange section 62D). The fifth liquid-side gateway space 82E communicates with one end of each of windward ten, in the row direction, of the flat pipes 63 constituting the fifth heat exchange path 60E (fifth windward side heat exchange section 62E). The sixth liquid-side gateway space 82F communicates with one end of each of windward ten, in the row direction, of the flat pipes 63 constituting the sixth heat exchange path 60F (sixth windward side heat exchange section 62F). The seventh liquid-side gateway space 82G communicates with one end of each of windward nine, in the row direction, of the flat pipes 63 constituting the seventh heat exchange path 60G (seventh windward side heat exchange section 62G). The eighth liquid-side gateway space 82H communicates with one end of each of windward eight, in the row direction, of the flat pipes 63 constituting the eighth heat exchange path 60H (eighth windward side heat exchange section 62H). The ninth liquid-side gateway space 82I communicates with one end of each of windward seven, in the row direction, of the flat pipes 63 constituting the ninth heat exchange path 60I (ninth windward side heat exchange section 62I). The tenth liquid-side gateway space 82J communicates with one end of each of windward six, in the row direction, of the flat pipes 63 constituting the tenth heat exchange path 60J (tenth windward side heat exchange section 62J).

An internal space of the coupling header 90 is vertically partitioned by partition plates 91 so that communication spaces 92A to 92J respectively corresponding to the heat exchange paths 60A to 60J are formed. In the following description, the communication spaces 92A to 92J are referred to as the horizontal return spaces 92A to 92J.

Each of the horizontal return spaces 92A to 92J communicates with the flat pipes 63 constituting the corresponding one of the heat exchange paths 60A to 60J. Specifically, the first horizontal return space 92A communicates the other end of each of windward two (first windward side heat exchange section 62A) of the flat pipes 63 constituting the first heat exchange path 60A including the lowermost flat pipe 63AU and the other end of each of leeward two (first leeward side heat exchange section 61A) of the flat pipes 63 constituting the first heat exchange path 60A including the lowermost flat pipe 63AD. The windward two flat pipes are located on leeward side in the row direction. The leeward two flat pipes are located on leeward side in the row direction. The second horizontal return space 92B communicates with the other end of each of windward twelve, in the row direction, of the flat pipes 63 constituting the second heat exchange path 60B (second windward side heat exchange section 62B) and the other end of each of leeward twelve, in the row direction, of the flat pipes 63 constituting the second heat exchange path 60B (second leeward side heat exchange section 61B). The third horizontal return space 92C communicates with the other end of each of windward twelve, in the row direction, of the flat pipes 63 constituting the third heat exchange path 60C (third windward side heat exchange section 62C) and the other end of each of leeward twelve, in the row direction, of the flat pipes 63 constituting the third heat exchange path 60C (third leeward side heat exchange section 61C). The fourth horizontal return space 92D communicates with the other end of each of windward eleven, in the row direction, of the flat pipes 63 constituting the fourth heat exchange path 60D (fourth windward side heat exchange section 62D) and the other end of each of leeward eleven, in the row direction, of the flat pipes 63 constituting the fourth heat exchange path 60D (fourth leeward side heat exchange section 61D). The fifth horizontal return space 92E communicates with the other end of each of windward ten, in the row direction, of the flat pipes 63 constituting the fifth heat exchange path 60E (fifth windward side heat exchange section 62E) and the other end of each of leeward ten, in the row direction, of the flat pipes 63 constituting the fifth heat exchange path 60E (fifth leeward side heat exchange section 61E). The sixth horizontal return space 92F communicates with the other end of each of windward ten, in the row direction, of the flat pipes 63 constituting the sixth heat exchange path 60F (sixth windward side heat exchange section 62F) and the other end of each of leeward ten, in the row direction, of the flat pipes 63 constituting the sixth heat exchange path 60F (sixth leeward side heat exchange section 61F). The seventh horizontal return space 92G communicates with the other end of each of windward nine, in the row direction, of the flat pipes 63 constituting the seventh heat exchange path 60G (seventh windward side heat exchange section 62G) and the other end of each of leeward nine, in the row direction, of the flat pipes 63 constituting the seventh heat exchange path 60G (seventh leeward side heat exchange section 61G). The eighth horizontal return space 92H communicates with the other end of each of windward eight, in the row direction, of the flat pipes 63 constituting the eighth heat exchange path 60H (eighth windward side heat exchange section 62H) and the other end of each of leeward eight, in the row direction, of the flat pipes 63 constituting the eighth heat exchange path 60H (eighth leeward side heat exchange section 61H). The ninth horizontal return space 92I communicates with the other end of each of windward seven, in the row direction, of the flat pipes 63 constituting the ninth heat exchange path 60I (ninth windward side heat exchange section 62I) and the other end of each of leeward seven, in the row direction, of the flat pipes 63 constituting the ninth heat exchange path 60I (ninth leeward side heat exchange section 61I). The tenth horizontal return space 92J communicates with the other end of each of windward six, in the row direction, of the flat pipes 63 constituting the tenth heat exchange path 60J (tenth windward side heat exchange section 62J) and the other end of each of leeward six, in the row direction, of the flat pipes 63 constituting the tenth heat exchange path 60J (tenth leeward side heat exchange section 61J). In one or more embodiments, the partition plates 91 are disposed so that the flat pipes 63 adjacent in the row direction communicate with each other at the other end. Accordingly, the horizontal return spaces 92A to 92J are formed so that the flat pipes 63 adjacent in the row direction communicate with each other at the other end. However, the present disclosure is not limited thereto. The partition plates 91 may not be disposed inside each of the heat exchange sections 61A to 61J, 62A to 62J so that the horizontal return spaces 92A to 92J are formed between the heat exchange sections 61A to 61J and 62A to 62J adjacent in the row direction.

Further, a liquid-side flow dividing member 85 which divides and feeds the refrigerant fed from the outdoor expansion valve 12 (refer to FIG. 1) into the liquid-side gateway spaces 82A to 82J in the heating operation and a gas-side flow dividing member 75 which divides and feeds the refrigerant fed from the compressor 8 (refer to FIG. 1)

into the gas-side gateway spaces 72A to 72J in the cooling operation are connected to the first header collecting pipe 70 and the second header collecting pipe 80.

The liquid-side flow dividing member 85 includes a liquid-side refrigerant flow divider 86 which is connected to the refrigerant pipe 20 (refer to FIG. 1) and liquid-side refrigerant flow dividing pipes 87A to 87F which extend from the liquid-side refrigerant flow divider 86 and are connected to the liquid-side gateway spaces 82A to 82J, respectively. Each of the liquid-side refrigerant flow dividing pipes 87A to 87F includes a capillary tube and has a length corresponding to a flow dividing ratio to each of the heat exchange paths 60A to 60J.

The gas-side flow dividing member 75 includes a gas-side refrigerant flow dividing header pipe 76 which is connected to the refrigerant pipe 19 (refer to FIG. 1) and gas-side refrigerant flow dividing branch pipes 77A to 77J which extend from the gas-side refrigerant flow dividing header pipe 76 and are connected to the gas-side gateway spaces 72A to 72J, respectively.

Accordingly, the heat exchange paths 60A to 60J include the windward side heat exchange sections 62A to 62J on the windward side in the row direction and the leeward side heat exchange sections 61A to 61J which are connected in series to the windward side heat exchange sections 62A to 62J on the leeward side of the windward side heat exchange sections 62A to 62J. More specifically, the first heat exchange path 60A has a configuration in which the two flat pipes 63 including the lowermost flat pipe 63AD and constituting the first leeward side heat exchange section 61A which communicates with the first gas-side gateway space 72A and the two flat pipes 63 including the lowermost flat pipe 63AD and constituting the first windward side heat exchange section 62A which is located on the windward side of the first leeward side heat exchange section 61A and communicates with the first liquid-side gateway space 82A are connected in series through the first horizontal return space 92A. The second heat exchange path 60B has a configuration in which the twelve flat pipes 63 constituting the second leeward side heat exchange section 61B which communicates with the second gas-side gateway space 72B and the twelve flat pipes 63 constituting the second windward side heat exchange section 62B which is located on the windward side of the second leeward side heat exchange section 61B and communicates with the second liquid-side gateway space 82B are connected in series through the second horizontal return space 92B. The third heat exchange path 60C has a configuration in which the twelve flat pipes 63 constituting the third leeward side heat exchange section 61C which communicates with the third gas-side gateway space 72C and the twelve flat pipes 63 constituting the third windward side heat exchange section 62C which is located on the windward side of the third leeward side heat exchange section 61C and communicates with the third liquid-side gateway space 82C are connected in series through the third horizontal return space 92C. The fourth heat exchange path 60D has a configuration in which the eleven flat pipes 63 constituting the fourth leeward side heat exchange section 61D which communicates with the fourth gas-side gateway space 72D and the eleven flat pipes 63 constituting the fourth windward side heat exchange section 62D which is located on the windward side of the fourth leeward side heat exchange section 61D and communicates with the fourth liquid-side gateway space 82D are connected in series through the fourth horizontal return space 92D. The fifth heat exchange path 60E has a configuration in which the ten flat pipes 63 constituting the fifth leeward side heat exchange section 61E which communicates with the fifth gas-side gateway space 72E and the ten flat pipes 63 constituting the fifth windward side heat exchange section 62E which is located on the windward side of the fifth leeward side heat exchange section 61E and communicates with the fifth liquid-side gateway space 82E are connected in series through the fifth horizontal return space 92E. The sixth heat exchange path 60F has a configuration in which the ten flat pipes 63 constituting the sixth leeward side heat exchange section 61F which communicates with the sixth gas-side gateway space 72F and the ten flat pipes 63 constituting the sixth windward side heat exchange section 62F which is located on the windward side of the sixth leeward side heat exchange section 61F and communicates with the sixth liquid-side gateway space 82F are connected in series through the sixth horizontal return space 92F. The seventh heat exchange path 60G has a configuration in which the nine flat pipes 63 constituting the seventh leeward side heat exchange section 61G which communicates with the seventh gas-side gateway space 72G and the nine flat pipes 63 constituting the seventh windward side heat exchange section 62G which is located on the windward side of the seventh leeward side heat exchange section 61G and communicates with the seventh liquid-side gateway space 82G are connected in series through the seventh horizontal return space 92G. The eighth heat exchange path 60H has a configuration in which the eight flat pipes 63 constituting the eighth leeward side heat exchange section 61H which communicates with the eighth gas-side gateway space 72H and the eight flat pipes 63 constituting the eighth windward side heat exchange section 62H which is located on the windward side of the eighth leeward side heat exchange section 61H and communicates with the eighth liquid-side gateway space 82H are connected in series through the eighth horizontal return space 92H. The ninth heat exchange path 60I has a configuration in which the seven flat pipes 63 constituting the ninth leeward side heat exchange section 61I which communicates with the ninth gas-side gateway space 72I and the seven flat pipes 63 constituting the ninth windward side heat exchange section 62I which is located on the windward side of the ninth leeward side heat exchange section 61I and communicates with the ninth liquid-side gateway space 82I are connected in series through the ninth horizontal return space 92I. The tenth heat exchange path 60J has a configuration in which the six flat pipes 63 constituting the tenth leeward side heat exchange section 61J which communicates with the tenth gas-side gateway space 72J and the six flat pipes 63 constituting the tenth windward side heat exchange section 62J which is located on the windward side of the tenth leeward side heat exchange section 61J and communicates with the tenth liquid-side gateway space 82J are connected in series through the tenth horizontal return space 92J.

In one or more embodiments, as illustrated in FIG. 20, the number of through holes (three in one or more embodiments) each serving as a passage 63*b*A for the refrigerant in each of the four flat pipes 63 constituting the first heat exchange path 60A is smaller than the number of through holes (seven in one or more embodiments) each serving as a passage 63*b* for the refrigerant in each of the flat pipes 63 constituting the other heat exchange paths 60B to 60J. In one or more embodiments, the size (the diameter and the passage cross-sectional area) of the through hole 63*b*A of the flat pipes constituting the first heat exchange path 60A is equal to the size of the through hole 63*b* of the flat pipes constituting the other heat exchange paths 60B to 60D.

(Operation (Flow of Refrigerant)>

Next, the flow of the refrigerant in the outdoor heat exchanger 11 having the above configuration will be described.

In the cooling operation, the outdoor heat exchanger 11 functions as a radiator for the refrigerant discharged from the compressor 8 (refer to FIG. 1). In the cooling operation, the refrigerant flows in a direction opposite to the direction indicated by arrows showing the refrigerant flows in FIGS. 17 to 20.

The refrigerant discharged from the compressor 8 (refer to FIG. 1) is fed to the gas-side flow dividing member 75 through the refrigerant pipe 19 (refer to FIG. 1). The refrigerant fed to the gas-side flow dividing member 75 is divided into the gas-side refrigerant flow dividing branch pipes 77A to 77J from the gas-side refrigerant flow dividing header pipe 76 and fed to the gas-side gateway spaces 72AL, 72B to 72J of the first header collecting pipe 70.

The refrigerant fed to each of the gas-side gateway spaces 72A to 72J is divided into the flat pipes 63 constituting the corresponding one of the leeward side heat exchange sections 61A to 61J of the heat exchange paths 60A to 60J. The refrigerant fed to these flat pipes 63 radiates heat by heat exchange with outdoor air while flowing through the passages 63*b*, and is fed to the flat pipes 63 constituting each of the windward side heat exchange sections 62A to 62J of the heat exchange paths 60A to 60J though the corresponding one of the horizontal return spaces 92A to 92J of the coupling header 90. The refrigerant fed to these flat pipes 63 further radiates heat by heat exchange with outdoor air while passing through the passages 63*b*, and flows of the refrigerant merge with each other in each of the liquid-side gateway spaces 82A to 82J of the second header collecting pipe 80. That is, the refrigerant passes through the heat exchange paths 60A to 60J in the order from the leeward side heat exchange sections 61A to 61J to the windward side heat exchange sections 62A to 62J. At this time, the refrigerant radiates heat until the refrigerant becomes a saturated liquid state or a subcooled liquid state from a superheated gas state.

The refrigerant fed to the liquid-side gateway spaces 82A to 82J is fed to the liquid-side refrigerant flow dividing pipes 87A to 87J of the liquid-side refrigerant flow dividing member 85, and flows of the refrigerant merge with each other in the liquid-side refrigerant flow divider 86. The refrigerant merged in the liquid-side refrigerant flow divider 86 is fed to the outdoor expansion valve 12 (refer to FIG. 1) through the refrigerant pipe 20 (refer to FIG. 1).

In the heating operation, the outdoor heat exchanger 11 functions as an evaporator for the refrigerant decompressed by the outdoor expansion valve 12 (refer to FIG. 1). In the heating operation, the refrigerant flows in the direction indicated by the arrows showing the refrigerant flows in FIGS. 17 to 20.

The refrigerant decompressed in the outdoor expansion valve 12 is fed to the liquid-side refrigerant flow dividing member 85 through the refrigerant pipe 20 (refer to FIG. 1). The refrigerant fed to the liquid-side refrigerant flow dividing member 85 is divided into the liquid-side refrigerant flow dividing pipes 87A to 87F from the liquid-side refrigerant flow divider 86 and fed to the liquid-side gateway spaces 82A to 82J of the first and second header collecting pipes 70, 80.

The refrigerant fed to each of the liquid-side gateway spaces 82A to 82J is divided into the flat pipes 63 constituting the corresponding one of the windward side heat exchange sections 62A to 62J of the heat exchange paths 60A to 60J. The refrigerant fed to these flat pipes 63 is heated by heat exchange with outdoor air while flowing through the passages 63*b* and fed to the flat pipes 63 constituting each of the leeward side heat exchange sections 62A to 62J of the heat exchange paths 60A to 60J through the corresponding one of the horizontal return spaces 92A to 92J of the coupling header 90. The refrigerant fed to these flat pipes 63 is further heated by heat exchange with outdoor air while flowing through the passages 63*b*, and flows of the refrigerant merge with each other in each of the gas-side gateway spaces 72A to 72J of the first header collecting pipe 70. That is, the refrigerant passes through the heat exchange paths 60A to 60J in the order from the windward side heat exchange sections 62A to 62J to the leeward side heat exchange sections 61A to 61J. At this time, the refrigerant is heated until the refrigerant becomes a superheated gas state from a liquid state or a gas-liquid two-phase state by evaporation.

The refrigerant fed to the gas-side gateway spaces 72A to 72J is fed to the gas-side refrigerant flow dividing branch pipes 77A to 77J of the gas-side refrigerant flow dividing member 75, and flows of the refrigerant merge with each other in the gas-side refrigerant flow dividing header pipe 76. The refrigerant merged in the gas-side refrigerant flow dividing header pipe 76 is fed to the suction side of the compressor 8 (refer to FIG. 1) through the refrigerant pipe 19 (refer to FIG. 1).

In the defrosting operation, the outdoor heat exchanger 11 functions as a radiator for the refrigerant discharged from the compressor 8 (refer to FIG. 1) in a manner similar to the cooling operation. The flow of the refrigerant in the outdoor heat exchanger 11 in the defrosting operation is similar to that in the cooling operation. Thus, description thereof will be omitted. However, differently from the cooling operation, the refrigerant mainly radiates heat while melting frost adhered to the heat exchange paths 60A to 60J in the defrosting operation.

<Characteristics>

The outdoor heat exchanger 11 (heat exchanger) according to one or more embodiments and the air conditioning apparatus 1 including the outdoor heat exchanger 11 have characteristics as described below.

A

As described above, the heat exchanger 11 according to one or more embodiments includes the plurality of flat pipes 63 vertically arrayed, each of the flat pipes 63 including the passage for the refrigerant formed inside thereof, and the fins 64 which partition the space between adjacent flat pipes 63 into the air flow passages through which air flows. The flat pipes 63 are divided into a plurality of (ten in one or more embodiments) heat exchange paths 60A to 60J arrayed in multiple stages in the stage direction. Further, when the cross-sectional area of the passage 63*b* in each of the heat exchange paths 60A to 60J is defined as the path effective cross-sectional area SA to SJ, the path effective cross-sectional area SA of the first heat exchange path 60A is smaller than the path effective cross-sectional area SB to SJ of each of the other heat exchange paths 60B to 60J Specifically, each of the second to tenth heat exchange paths 60B to 60J includes the flat pipes 63 each of which includes the seven through holes each serving as the passage 63*b* for the refrigerant. Thus, the path effective cross-sectional area SB to SJ of each of the second to tenth heat exchange paths 60B to 60J is the total passage cross-sectional area of the seven through holes each serving as the passage 63*b* for the refrigerant. When the passage cross-sectional area of each through hole is denoted by s, each path effective cross-sectional area SB to SJ is 7×s. The first heat exchange path 60A includes the flat pipes 63 (including the lowermost flat pipes 63AU, 63AD) each of which includes the three through holes each serving as the passage 63*b*A for the refrigerant. Thus, the path effective cross-sectional area SA of the first heat exchange path 60A is the total passage cross-sectional area of the three through holes each serving as the passage 63*b* for the refrigerant. When the passage cross-sectional area of each through hole is denoted by s, the path effective cross-sectional area SA is 3×s. In this manner, the path effective cross-sectional area SA of the first heat exchange path 60A is smaller than the path effective cross-sectional area SB to SJ of each of the other heat exchange paths 60B to 60J.

On the other hand, in the conventional heat exchanger, the same number of flat pipes having the same shape (in the pipe length, and the size and the number of through holes each serving as the refrigerant passage) are connected in series in each heat exchange path. That is, in the conventional heat exchanger described above, the path effective cross-sectional area is equal between the heat exchange paths. When the conventional heat exchanger having such a configuration is employed in the air conditioning apparatus that performs the heating operation (when the heat exchanger is used as the evaporator for the refrigerant) and the defrosting operation (when the heat exchanger is used as the radiator for the refrigerant) in a switching manner, the amount of frost formation in the lowermost heat exchange path tends to increase in the heating operation. First, the reason thereof will be described.

In the conventional configuration, in the heating operation, the refrigerant in a liquid state tends to flow into the lowermost heat exchange path including the lowermost flat pipe, and flows out of the lowermost heat exchange path with the temperature of the refrigerant not sufficiently raised. As a result, the amount of frost formation in the lowermost heat exchange path tends to increase. That is, it is estimated that, in the configuration of the conventional heat exchanger, the reason why the amount of frost formation in the lowermost heat exchange path tends to increase is that, in the heating operation, the refrigerant in a liquid state tends to flow into the lowermost heat exchange path, and flows out of the lowermost heat exchange path with the temperature of the refrigerant not sufficiently raised.

Thus, in one or more embodiments, differently from the conventional heat exchanger, the path effective cross-sectional area SA of the lowermost first heat exchange path 60A including the lowermost flat pipes 63AU, 63AD is smaller than the path effective cross-sectional area SB to SJ of each of the other heat exchange paths 60B to 60J as described above.

When the heat exchanger 11 having such a configuration is employed in the air conditioning apparatus 1 which performs the heating operation and the defrosting operation in a switching manner, a flow resistance of the refrigerant in the first heat exchange path 60A can be increased by the small path effective cross-sectional area SA of the first heat exchange path 60A. Thus, the refrigerant in a liquid state becomes less likely to flow into the first heat exchange path 60A in the heating operation, which facilitates raising the temperature of the refrigerant flowing through the lowermost heat exchange path 60A. Accordingly, it is possible to reduce frost formation in the first heat exchange path 60A. As a result, unmelted frost in the first heat exchange path 60A in the defrosting operation can be reduced as compared to the case where the conventional heat exchanger is employed.

In this manner, in one or more embodiments, it is possible to reduce frost formation in the lowermost heat exchange path 60A to reduce unmelted frost in the defrosting operation by employing the heat exchanger 11 having the above configuration in the air conditioning apparatus 1 which performs the heating operation and the defrosting operation in a switching manner.

In one or more embodiments, in order to obtain the configuration in which the path effective cross-sectional area SA of the lowermost first heat exchange path 60A including the lowermost flat pipes 63AU, 63AD is smaller than the path effective cross-sectional area SB to SJ of each of the other heat exchange paths 60B to 60J, each of the flat pipes 63 constituting the first heat exchange path 60A is formed to have less through holes than each of the flat pipes 63 constituting the other heat exchange paths 60B to 60J. However, the present disclosure is not limited thereto. For example, flat pipes 63 having the same shape (in the pipe length, and the size and the number of through holes each serving as the refrigerant passage) may be used in all the heat exchange paths 60A to 60J, and parts which close some of the through holes 63*b*A of the flat pipes 63 constituting the first heat exchange path 60A may be formed in the first gateway spaces 72A, 82A of the first and second header collecting pipes 70, 80 to reduce the number of through holes 63*b*A in the first heat exchange path 60A.

B

As described above, in the heat exchanger 11 according to one or more embodiments, the path effective cross-sectional area SA of the first heat exchange path 60A is 0.4 times the path effective cross-sectional area SB to SJ of each of the other heat exchange paths 60B to 60J. Thus, the path effective cross-sectional area SA of the first heat exchange path 60A is sufficiently small Therefore, it is possible to sufficiently increase the flow resistance of the refrigerant in the first heat exchange path 60A to increase the effect of reducing frost formation in the lowermost heat exchange path 60A.

The path effective cross-sectional area SA of the first heat exchange path 60A is not limited to 0.4 times the path effective cross-sectional area SB to SJ of each of the other heat exchange paths 60B to 60J. However, in order to obtain a sufficient effect of increasing the flow resistance of the refrigerant, the path effective cross-sectional area SA of the first heat exchange path 60A may be equal to or smaller than 0.5 times the path effective cross-sectional area SB to SJ of each of the other heat exchange paths 60B to 60J.

C

As described above, in the heat exchanger 11 according to one or more embodiments, the number of flat pipes 63 constituting the first heat exchange path 60A is smaller than the number of flat pipes 63 constituting each of the other heat exchange paths 60B to 60J.

When the configuration in which the number of flat pipes 63 constituting the first heat exchange path 60A is smaller than the number of flat pipes 63 constituting each of the other heat exchange paths 60B to 60J is employed, a drift tends to occur when the refrigerant is divided and introduced into the heat exchange paths 60A to 60J.

However, in one or more embodiments, as described above, the configuration in which the path effective cross-sectional area SA of the first heat exchange path 60A is smaller than the path effective cross-sectional area SB to SJ of each of the other heat exchange paths 60B to 60J is employed to increase the flow resistance of the refrigerant in the first heat exchange path 60A. Thus, it is possible to reduce the occurrence of a drift when the refrigerant is divided and introduced into the heat exchange paths 60A to 60J.

Further, in one or more embodiments, in the second heat exchange paths 60B to 60J other than the first heat exchange path 60A, the number of flat pipes 63 of the heat exchange section corresponding to a part where the velocity of air obtained by the outdoor fan 15 (fan) is low is larger than the number of flat pipes 63 of the heat exchange section corresponding to a part where the velocity of air obtained by the outdoor fan 15 (fan) is high. This is because, in a heat exchanger which exchanges heat between a refrigerant and air, the heat exchange efficiency is higher in a part where the velocity of air is higher and the heat exchange efficiency is lower in a part where the velocity of air is lower. Specifically, the number of flat pipes 63 constituting the ninth heat exchange path 60I (fourteen in total in seven stages and two rows) where the velocity of air is lower than that in the tenth heat exchange section 60J is larger than the number of flat pipes 63 constituting the tenth heat exchange path 60J (twelve in total in six stages and two rows) where the velocity of air is highest. In this manner, the heat exchange path on the lower side where the velocity of air is lower has a larger number of flat pipes 63 constituting the heat exchange path.

Thus, in one or more embodiments, in the most part of the heat exchanger 11 (the heat exchange paths 60B to 60J other than the lowermost first heat exchange path 60A), the heat exchange path on the lower side where the velocity of air is lower has a larger number of flat pipes 63 constituting the heat exchange path so as to correspond to the relationship between the air velocity distribution and the heat exchange efficiency. Further, in the lowermost first heat exchange path 60A including the lowermost flat pipes 63AU, 63AD, the path effective cross-sectional area SA is reduced and the number of flat pipes 63 is reduced taking into consideration the amount of frost formation and unmelted frost differently from the other heat exchange paths 60B to 60J.

D

As described above, in the heat exchanger 11 according to one or more embodiments, each of the fins 64 includes the cutouts 64*a* into which the flat pipes 63 are inserted, the cutouts 64*a* extending from the leeward side toward the windward side in the air flow direction of air passing through the air flow passages, the fin main parts 64*b* each of which is interposed between adjacent cutouts 64*a*, and the fin windward part 64*c* which extends continuously with the fin main parts 64*b* on the windward side in the air flow direction relative to the cutouts 64*a*.

In the heat exchanger 11 having such a fin configuration, the amount of frost adhered to the fin windward part 64*c* tends to increase in the defrosting operation. Thus, unmelted frost in the lowermost first heat exchange path 60A may increase in the defrosting operation.

However, as described above, one or more embodiments employ the configuration in which the path effective cross-sectional area SA of the first heat exchange path 60A is longer than the path effective cross-sectional area SB to SJ of each of the other heat exchange paths 60B to 60J. Thus, it is possible to reduce frost formation in the lowermost heat exchange path 60A including frost adhered to the fin windward part 64*c* to reduce unmelted frost in the defrosting operation.

<Modifications>

A

In the outdoor heat exchanger 11 (heat exchanger) according to one or more embodiments, in order to obtain the configuration in which the path effective cross-sectional area SA of the lowermost first heat exchange path 60A including the lowermost flat pipes 63AU, 63AD is set smaller than the path effective cross-sectional area SB to SJ of each of the other heat exchange paths 60B to 60J, the number of through holes 63*b*A of each of the flat pipes 63 constituting the first heat exchange path 60A is set smaller than the number of through holes 63*b* of each of the flat pipes 63 constituting the other heat exchange paths 60B to 60J (refer to FIGS. 17 to 20). However, the configuration in which the path effective cross-sectional area SA of the lowermost first heat exchange path 60A including the lowermost flat pipes 63AU, 63AD is set smaller than the path effective cross-sectional area SB to SJ of each of the other heat exchange paths 60B to 60J is not limited thereto.

Figure 21:
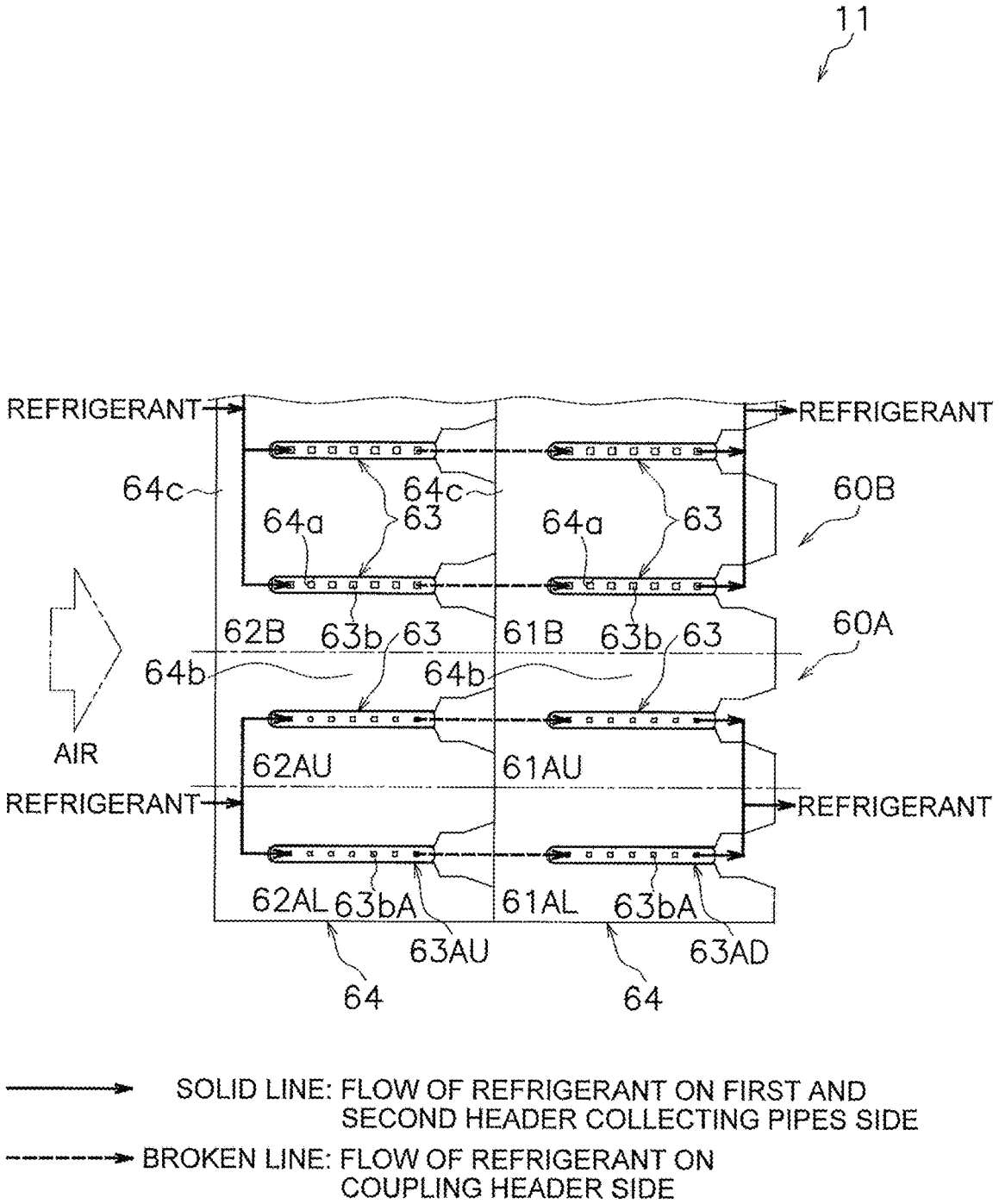
FIG. 21 is a diagram illustrating an outdoor heat exchanger as a heat exchanger according to Modification A of one or more embodiments and corresponding to FIG. 20.

For example, as illustrated in FIG. 21, the size of each of the through hole 63*b*A of the flat pipes 63 constituting the first heat exchange path 60A may be set smaller than the size of each of the through hole 63*b* of the flat pipes 63 constituting the other heat exchange paths 60B to 60J to obtain the configuration in which the path effective cross-sectional area SA of the lowermost first heat exchange path 60A is set smaller than the path effective cross-sectional area SB to SJ of each of the other heat exchange paths 60B to 60J.

Also in the present modification, similarly to the embodiments described above, the path effective cross-sectional area SA of the first heat exchange path 60A is smaller than the path effective cross-sectional area SB to SJ of each of the other heat exchange paths 60B to 60J Thus, it is possible to reduce frost formation in the lowermost heat exchange path 60A to reduce unmelted frost in the defrosting operation.

Further, also in this case, in order to sufficiently increase the flow resistance of the refrigerant in the first heat exchange path 60A, the path effective cross-sectional area SA of the first heat exchange path 60A may be equal to or smaller than 0.5 times the path effective cross-sectional area SB to SJ of each of the other heat exchange paths 60B to 60J. In the configuration as illustrated in FIG. 21 in which flat pipes including square through holes are used, for example, the size (longitudinal or lateral length) of each of the square through holes 63*b*A of the flat pipes 63 constituting the first heat exchange path 60A may be set equal to or smaller than 0.7 times the size (longitudinal or lateral length) of each of the square through holes 63*b* of the flat pipes 63 constituting the other heat exchange paths 60B to 60J to make the passage cross-sectional area 0.5 times or smaller.

B

In the outdoor heat exchanger 11 (heat exchanger) according to one or more embodiments, in order to obtain the configuration in which the path effective cross-sectional area SA of the lowermost first heat exchange path 60A including the lowermost flat pipes 63AU, 63AD is set smaller than the path effective cross-sectional area SB to SJ of each of the other heat exchange paths 60B to 60J, the number of through holes 63*b*A of each of the flat pipes 63 constituting the first heat exchange path 60A is set smaller than the number of through holes 63*b* of each of the flat pipes 63 constituting the other heat exchange paths 60B to 60J (refer to FIGS. 17 to 20). Further, in the outdoor heat exchanger 11 (heat exchanger) of Modification A described above, in order to obtain the configuration in which the path effective cross-sectional area SA of the lowermost first heat exchange path 60A including the lowermost flat pipes 63AU, 63AD is set smaller than the path effective cross-sectional area SB to SJ of each of the other heat exchange paths 60B to 60J, the size of each of the through holes 63*b*A of the flat pipes 63 constituting the first heat exchange path 60A is set smaller than the size of each of the through holes 63*b* of the flat pipes 63 constituting the other heat exchange paths 60B to 60J.

However, a method for obtaining the configuration in which the path effective cross-sectional area SA of the lowermost first heat exchange path 60A including the lowermost flat pipes 63AU, 63AD is set smaller than the path effective cross-sectional area SB to SJ of each of the other heat exchange paths 60B to 60J is not limited to any one of the above methods, and both of the methods may be employed at the same time. That is, the number of through holes 63*b*A of each of the flat pipes 63 constituting the first heat exchange path 60A may be set smaller than the number of through holes 63*b* of each of the flat pipes 63 constituting the other heat exchange paths 60B to 60J, and, at the same time, the size of each of the through holes 63*b*A of the flat pipes 63 constituting the first heat exchange path 60A may be set smaller than the size of each of the through holes 63*b* of the flat pipes 63 constituting the other heat exchange paths 60B to 60J.

Also in the present modification, similarly to the embodiments described above, the path effective cross-sectional area SA of the first heat exchange path 60A is smaller than the path effective cross-sectional area SB to SJ of each of the other heat exchange paths 60B to 60J Thus, it is possible to reduce frost formation in the lowermost heat exchange path 60A to reduce unmelted frost in the defrosting operation.

C

In the outdoor heat exchangers 11 (heat exchangers) according to one or more embodiments and modifications thereof, the first heat exchange path includes two rows and two stages of flat pipes 63 (four flat pipes 63 in total) including the lowermost flat pipes 63AU, 63AD. However, the present disclosure is not limited thereto. For example, the first heat exchange path may include two rows and one stage of flat pipes (two flat pipes 63 in total), that is, may include only the lowermost flat pipes 63AU, 63AD, and each of the two flat pipes 63 may constitute each of the heat exchange sections 61A, 62A. Alternatively, the first heat exchange path may include two rows and three stages of flat pipes 63 (six flat pipes 63 in total) including the lowermost flat pipes 63AU, 63AD, and each three of the six flat pipes 63 may constitute each of the heat exchange sections 61A, 62A.

Further, in the heat exchangers 11 according to one or more embodiments and modifications thereof, the number of rows of heat exchange sections constituting the heat exchange paths is two. However, the present disclosure is not limited thereto. For example, the number of rows of heat exchange sections constituting the heat exchange paths may be one, and the path effective cross-sectional area SA of the first heat exchange path 60A may be set smaller than the path effective cross-sectional area SB to SJ of each of the other heat exchange paths 60B to 60J by the size or the number of through holes 63*b*, 63*b*A.

As described above, although, in the heat exchangers 11 according to one or more embodiments and modifications thereof, the number of stages of heat exchange paths (ten stages), the number of rows of heat exchange sections (two rows), the total number of flat pipes 63 (eighty-seven), and the number of flat pipes 63 constituting each of the heat exchange paths 60A to 60J are defined, these numbers are merely examples, and the present disclosure is not limited to these numbers.

(6) Outdoor Heat Exchanger According to One or More Embodiments

In the outdoor heat exchangers 11 (heat exchangers) of the embodiments described above and modifications thereof, in order to reduce frost formation in the lowermost heat exchange path 60A to reduce unmelted frost in the defrosting operation, the path effective length LA of the lowermost first heat exchange path 60A including the lowermost flat pipes 63AU, 63AD is set longer than the path effective length LB to LJ of each of the other heat exchange paths 60B to 60J. Further, in the outdoor heat exchangers 11 (heat exchangers) of the embodiments described above and modifications thereof, the path effective cross-sectional area SA of the lowermost first heat exchange path 60A including the lowermost flat pipes 63AU, 63AD is set smaller than the path effective cross-sectional area SB to SJ of each of the other heat exchange paths 60B to 60J.

However, a method for reducing frost formation in the lowermost heat exchange path 60A to reduce unmelted frost in the defrosting operation is not limited to any one of the above methods, and both of the methods may be employed at the same time. That is, the path effective length LA of the lowermost first heat exchange path 60A including the lowermost flat pipes 63AU, 63AD may be set longer than the path effective length LB to LJ of each of the other heat exchange paths 60B to 60J, and, at the same time, the path effective cross-sectional area SA of the lowermost first heat exchange path 60A including the lowermost flat pipes 63AU, 63AD may be set smaller than the path effective cross-sectional area SB to SJ of each of the other heat exchange paths 60B to 60J.

Also in one or more embodiments, similarly to the embodiments described above, it is possible to reduce frost formation in the lowermost heat exchange path 60A to reduce unmelted frost in the defrosting operation.

The present invention is widely applicable to a heat exchanger including a plurality of flat pipes arranged in multiple stages in a stage direction corresponding to the up-down direction, each of the flat pipes including a passage for a refrigerant formed inside thereof, and a plurality of fins that partition a space between adjacent flat pipes into a plurality of air flow passages through which air flows, the flat pipes being divided into a plurality of heat exchange paths arrayed in multiple stages in the stage direction.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

60A to 60J heat exchange path
61A to 61J, 62A to 62J heat exchange section
61AL first leeward lower side heat exchange section
61AU first leeward upper side heat exchange section
62AL first windward lower side heat exchange section
62AU first windward upper side heat exchange section
63, 63AU, 63AD flat pipe
63*b*, 63*b*A passage for refrigerant, through hole
64 fin
64*a* cutout
64*b* fin main part
64*c* fin windward part

PATENT LITERATURE

Patent Literature 1: WO 2013/161799 A

The invention claimed is:

1. A heat exchanger comprising:

flat pipes disposed in multiple stages in a stage direction corresponding to an up-down direction, wherein each of the flat pipes comprises a passage for a refrigerant inside thereof; and fins that partition a space between adjacent two of the flat pipes into air flow passages through which air flows, wherein the flat pipes are divided into heat exchange paths arrayed in multiple stages in the stage direction, one of the heat exchange paths is a first heat exchange path that comprises a lowermost one of the flat pipes, a path effective length of the first heat exchange path is longer than a path effective length of any of the other heat exchange paths, wherein the path effective length is a length of the passage from one end to another end of a flow of the refrigerant in each of the heat exchange paths, and a number of the flat pipes constituting the first heat exchange path is smaller than a number of the flat pipes constituting any of the other heat exchange paths.

2. The heat exchanger according to claim 1, wherein the path effective length of the first heat exchange path is equal to or longer than twice the path effective length of any of the other heat exchange paths.

3. The heat exchanger according to claim 1, wherein the first heat exchange path comprises:

a first lower side heat exchange section comprising the lowermost one of the flat pipes; and a first upper side heat exchange section connected in series to the first lower side heat exchange section on an upper side of the first lower side heat exchange section.

4. The heat exchanger according to claim 3, wherein the heat exchanger is used as a radiator for the refrigerant, and the first lower side heat exchange section serves as an entrance of the first heat exchange path.

5. The heat exchanger according to claim 1, wherein each of the heat exchange paths comprises a plurality of heat exchange sections connected in series, and a number of the heat exchange sections constituting the first heat exchange path is larger than a number of the heat exchange sections constituting any of the other heat exchange paths.

6. The heat exchanger according to claim 1, wherein the flat pipes are disposed in multiple rows in a row direction corresponding to an air flow direction of the air passing through the air flow passages, each of the heat exchange paths other than the first heat exchange path comprises:

a windward side heat exchange section on a windward side in the row direction; and a leeward side heat exchange section connected in series to the windward side heat exchange section on a leeward side of the windward side heat exchange section, the first heat exchange path comprises:

a first windward lower side heat exchange section comprising the lowermost flat pipe on the windward side in the row direction, a first windward upper side heat exchange section on an upper side of the first windward lower side heat exchange section, a first leeward lower side heat exchange section comprising the lowermost flat pipe on the leeward side of the windward side heat exchange sections; and a first leeward upper side heat exchange section on an upper side of the first leeward lower side heat exchange section, and the first windward lower side heat exchange section, the first windward upper side heat exchange section, the first leeward lower side heat exchange section, and the first leeward upper side heat exchange section are connected in series.

7. The heat exchanger according to claim 6, wherein the heat exchanger is used as a radiator for the refrigerant, and the first windward lower side heat exchange section or the first leeward lower side heat exchange section serves as an entrance of the first heat exchange path.

8. The heat exchanger according to claim 6, wherein the heat exchanger is used as a radiator for the refrigerant, and the first windward lower side heat exchange section or the first windward upper side heat exchange section serves as an entrance of the first heat exchange path.

9. The heat exchanger according to claim 1, wherein each of the fins includes cutouts into which the flat pipes are inserted, the cutouts extend from a leeward side toward a windward side in an air flow direction of the air passing through the air flow passages, fin main parts are each interposed between adjacent two of the cutouts, and a fin windward part extends continuously with the fin main parts on the windward side in the air flow direction relative to the cutouts.

10. An air conditioning apparatus comprising the heat exchanger according to claim 1.

* * * * *